US007050022B2

(12) United States Patent
Kigo et al.

(10) Patent No.: US 7,050,022 B2
(45) Date of Patent: May 23, 2006

(54) DISPLAY AND ITS DRIVING METHOD

(75) Inventors: Shigeo Kigo, Neyagawa (JP); Mitsuhiro Kasahara, Hirakata (JP); Mitsuhiro Mori, Ibaraki (JP); Jumpéi Hashiguchi, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 239 days.

(21) Appl. No.: 10/363,269

(22) PCT Filed: Sep. 7, 2001

(86) PCT No.: PCT/JP01/07792

§ 371 (c)(1),
(2), (4) Date: Mar. 10, 2003

(87) PCT Pub. No.: WO02/23518

PCT Pub. Date: Mar. 21, 2002

(65) Prior Publication Data

US 2003/0169214 A1 Sep. 11, 2003

(30) Foreign Application Priority Data

Sep. 13, 2000 (JP) ..... 2000-277878
Sep. 3, 2001 (JP) ..... 2001-266383

(51) Int. Cl.
*G09G 3/28* (2006.01)

(52) U.S. Cl. ..... 345/66; 315/169.4

(58) Field of Classification Search ..... 345/60, 345/66, 204, 207, 211–214; 315/169.4
See application file for complete search history.

(56) References Cited

U.S. PATENT DOCUMENTS 6,111,556 A * 8/2000 Moon ..... 345/60
6,466,186 B1 * 10/2002 Shimizu et al. ..... 345/60
2001/0005188 A1 6/2001 Watanabe

FOREIGN PATENT DOCUMENTS

| | | |
|---|---|---|
| JP | 2-87189 | 3/1990 |
| JP | 11344952 | 12/1999 |
| JP | 2000172223 | 6/2000 |
| JP | 2000181405 | 6/2000 |
| JP | 2000206919 | 7/2000 |
| JP | 2001184024 | 7/2001 |

OTHER PUBLICATIONS

English Language Abstract of JP Appln. No. 2001-184024.

(Continued)

*Primary Examiner*—Amr A. Awad
*Assistant Examiner*—Tom Sheng
(74) *Attorney, Agent, or Firm*—Greenblum & Bernstein, P.L.C.

(57) ABSTRACT

A subfield lighting rate measuring unit detects a lighting rate for each subfield, and a subfield processor controls a scan driver and a sustain driver so that a recovery time of each sustain pulse, a resonance time of LC resonance and a sustain period become longer as the detected lighting rate for each subfield becomes smaller.

23 Claims, 41 Drawing Sheets

OTHER PUBLICATIONS

English Language Abstract of JP Appln. No. 2001-181405.
English Language Abstract of JP Appln. No. HEI 11-344952.
English Language Abstract of JP Appln. No. HEI 2-87189.
English Language Abstract and partial English Translation of JP Appln. No. 2000-172223.
English Language Abstract and partial English Translation of JP Appln. No. 2000-206919.

* cited by examiner

| DRIVE WAVEFORM | | | | |
|---|---|---|---|---|
| QA | ON | ON | ON | ON |
| QB | ON | ON | ON | OFF |
| QC | ON | ON | OFF | OFF |
| QD | ON | OFF | OFF | OFF |

FIG. 18

| DRIVE WAVEFORM | | | | |
|---|---|---|---|---|
| QA' | ON | ON | ON | OFF |
| QB' | ON | ON | OFF | OFF |
| QC' | ON | OFF | OFF | OFF |
| QD' | OFF | OFF | OFF | OFF |

DISPLAY AND ITS DRIVING METHOD

TECHNICAL FIELD

The present invention relates to a display device that selectively discharges a plurality of discharge cells to display an image and a method of driving such a display device.

BACKGROUND ART

Plasma display devices using PDPs (plasma display panels) have the advantage capable of being thinner and having larger screens. Such plasma display devices display images by utilizing light emission which occurs in the discharge of discharge cells constituting pixels.

FIG. 47 is a circuit diagram showing the structure of a sustain driver in a conventional plasma display device.

As shown in FIG. 47, a sustain driver 600 includes a recovery capacitor C11, a recovery coil L11, switches SW11, SW12, SW21 and SW22, and diodes D11 and D12.

The switch SW11 is connected between a power supply terminal V11 and a node N11, and the switch SW12 is connected between the node N11 and a ground terminal. The power supply terminal V11 is supplied with a sustain voltage Vsus. The node N11 is connected to, e.g., 480 sustain electrodes. A panel capacitance Cp corresponding to all capacitances among the plurality of sustain electrodes and the ground terminal is illustrated in FIG. 47.

The recovery capacitor C11 is connected between a node N13 and the ground terminal. The switch SW21 and the diode D11 are connected in series between the node N13 and a node N12, and the diode 12 and the switch SW22 are connected in series between the nodes N12 and N13. The recovery coil L11 is connected between the nodes N11 and N12.

FIG. 48 is a timing chart showing the operation in a sustain time period of the sustain driver 600 shown in FIG. 47. FIG. 48 shows a voltage at the node N11 and the operation of the switches SW21, SW11, SW22 and SW12.

First, in a time period Ta, the switch SW21 turns on, while the switch SW12 turns off. At this time, the switches SW11 and SW22 are off. Accordingly, LC resonance caused by the recovery coil L11 and the panel capacitance Cp makes the voltage at the node N11 rise to a peak voltage Vp, so that the charges stored in the recovery capacitor C11 are supplied to the panel capacitance Cp. At this time, when the voltage at the node N11 exceeds a discharge starting voltage in a sustain period, sustain discharge is started.

Then, in a time period Tb, the switch SW21 turns off, while the switch SW11 turns on. Accordingly, the node N11 is connected to the power supply terminal V11, so that the voltage at the node N11 rises sharply. The voltage at the node N11 is fixed to the sustain voltage Vsus in a time period Tc.

Then, in a time period Td, the switch SW11 turns off, while the switch SW22 turns on. Accordingly, the LC resonance caused by the recovery coil L11 and the panel capacitance Cp makes the voltage at the node N11 gently drop, so that the charges are recovered from the panel capacitance Cp to the recovery capacitor C11.

Finally, in a time period Te, the switch SW22 turns off, while the switch SW12 turns on. This causes the voltage at the node N11 to sharply drop, so that the voltage is fixed to a ground potential.

Repeating the above operation in the sustain time period causes periodical sustain pulses Psu to be applied to the plurality of sustain electrodes. At the time the sustain pulses Psu rise, a discharge is carried out in discharge cells, and sustain discharge is then made. Further, the charges in the panel capacitance Cp are recovered by the recovery capacitor C11 in a time period Td. The recovered charges are again supplied to the panel capacitance Cp in the time period Ta, thereby accomplishing reduced power consumption.

In the conventional sustain driver, however, power is consumed due to ON resistances of field-effect transistors used as the switches SW21 and SW22, losses caused by the diodes D11 and D12, a DC resistance of the recovery coil L11, resistances of the electrodes forming the panel capacitance Cp, and the like, so that reactive power is produced, in the time periods Ta and Td to be a recovery time.

This reactive power LP is expressed by the following equation where Vsus is the sustain voltage of sustain pulses Psu, Vp is a peak voltage in the recovery time, and F is the number of sustain pulses for one second.

$$LP=Cp\times Vsus\times(Vsus-Vp)\times F$$

If a longer recovery time is set, then the peak voltage Vp due to LC resonance can be made higher, enabling reduced reactive power; however, if a longer recovery time is set in the case of a high lighting rate, then stable discharge cannot be made. Therefore, a shorter recovery time is set for every lighting rate.

Thus, in the conventional plasma display device, the peak voltage Vp in the recovery time decreases, thereby failing to sufficiently reduce the reactive power and the power consumption in the case of a low lighting rate.

DISCLOSURE OF THE INVENTION

An object of the present invention is to provide a display device that enables stable discharge even if a lighting rate varies as well as enabling reduced reactive power and reduced power consumption, and provide a method of driving such a display device.

A display device according to one aspect of the present invention is a display device that displays an image by causing a plurality of discharge cells to selectively discharge, including: recovery means for recovering charges stored in the discharge cells to drive a drive pulse by using the recovered charges; and detection means for detecting a lighting rate of any of the plurality of discharge cells, which are to be turned on at the same time, wherein the plurality of discharge cells includes a capacitive load; and the recovery means includes inductance means having at least one inductance element that has one end connected to the capacitive load, and resonance driving means for driving the drive pulse by LC resonance of the capacitive load and the inductance element. The display device further includes control means for controlling the recovery means so as to vary a recovery time in which the drive pulse is driven by the recovery means and a resonance time of the LC resonance, depending on the lighting rate detected by the detection means.

In the display device in accordance with the present invention, the drive pulse is driven by the LC resonance of the capacitive load and the inductance element, while the lighting rate of any of the plurality of discharge cells, which are to be turned on at the same time, is detected, and the recovery time, in which the drive pulse is driven, and the resonance time of the LC resonance are varied depending on the lighting rate. This allows the drive pulse to be driven in an optimum recovery time and in an optimum resonance time of the LC resonance depending on the lighting rate. Accordingly, when the lighting rate is larger, the recovery time is made shorter to enable stable discharge, and the resonance time is also made shorter to enable reduced reactive power. Conversely, when the lighting rate is smaller, the recovery time is made longer to enable reduced reactive power. Consequently, even though the lighting rate varies, the stable discharge can be carried out with achievement of the reduced reactive power and the reduced power consumption.

The display device may further includes conversion means for converting image data in one field into image data in each of a plurality of subfields divided from the one field in order to carry out a gray scale display by causing discharge of any of the discharge cells selected for each subfield; the detection means includes subfield lighting rate detection means for detecting a lighitng rate for each subfield; and the control means may control the recovery means so as to vary the recovery time and the resonance time of LC resonance depending on the lighting rate for each subfield detected by the subfield lighting rate detection means.

In this case, since it is possible to vary the recovery time and the resonance time of LC resonance depending on the lighting rate detected for each subfield, it is possible to optimize the recovery time and the resonance time of LC resonance depending on the lighting rate even in the case of the gray scale display.

The control means may control the recovery means so that the recovery time becomes longer as the lighting rate detected by the detection means becomes smaller.

In this case, since the recovery time is set longer as the detected lighting rate is smaller, the recovery time is set longer to enable decreased reactive power in the case of a smaller lighting rate, while the recovery time is set shorter to enable stable discharge in the case of a larger lighting rate.

The control means may control the recovery means so that the resonance time of LC resonance becomes longer as the lighting rate detected by the detection means becomes smaller.

In this case, since the resonance time of LC resonance is set longer as the detected lighting rate becomes smaller, the recovery time is set longer to enable decreased reactive power in the case of a smaller lighting rate, while the resonance time of LC resonance is set shorter to enable stable discharge and more decreased reactive power in the case of a larger lighting rate.

The control means may control the recovery means so as to vary a discharge recovery time of the recovery time, in which discharge cells discharge depending on the lighting rate detected by the detection means, and so as not to vary a non-discharge recovery time of the recovery time, in which the discharge cells do not discharge is not varied.

In this case, since the discharge recovery time of the recovery time, in which discharge cells discharge, is varied depending on the detected lighting rate, it is possible to optimize the discharge recovery time depending on the detected lighting rate and reduce reactive power as well as achieve stable discharge. Further, since the non-discharge recovery time of the recovery time, in which the discharge cells do not discharge, is not varied, it is possible to simplify the control of a drive waveform in this period and thus simplify circuit configurations.

The control means may control the recovery means so that the non-discharge recovery time of the recovery time, in which the discharge cells do not discharge, becomes longer than the discharge recovery time, in which the discharge cells discharge, depending on the lighting rate detected by the detection means.

In this case, since the non-discharge recovery time is set longer than the discharge recovery time depending on the detected lighting rate, the non-discharge recovery time that requires no consideration of discharge stability is set still longer to enable more reduced reactive power.

A display device according to another aspect of the present invention is a display device that displays an image by causing a plurality of discharge cells to selectively discharge, including: recovery means for recovering charges stored in the discharge cells to drive a drive pulse by using the stored charges; and detection means for detecting a lighting rate of any of the plurality of discharge cells, which are to be turned on at the same time, wherein the plurality of discharge cells include a capacitive load; and the recovery means includes inductance means having at least one inductance element that has one end connected to the capacitive load, and resonance driving means for driving the drive pulse by LC resonance caused by the capacitive load and the inductance element. The display device further includes control means for controlling the recovery means so as to vary a resonance time of the LC resonance depending on the lighting rate detected by the detection means.

In the display device in accordance with the present invention, since the drive pulse is driven by the LC resonance of the capacitive load and the inductance element, and also the resonance time of the LC resonance is varied depending on the detected lighting rate, it is possible to set the resonance time of the LC resonance to an optimum value depending on the detected lighting rate. Accordingly, it is possible to make a stable discharge voltage constant by increasing an inductance value of the inductance element to set the resonance time longer in the case of a smaller lighting rate, while decreasing the inductance value of the inductance element to set the resonance time shorter in the case of a larger lighting rate. In the case of a larger lighting rate, in particular, the resonance time is set shorter to enable stable discharge, and recovery efficiency is increased to enable decreased reactive power. In addition, it is possible to increase discharge stability by setting a recovery time constant. Consequently, even though the lighting rate varies, it is possible to carry out stable discharge and reduce reactive power and thus power consumption.

The inductance means includes variable inductance means capable of varying an inductance value. The control means may vary the inductance value of the variable inductance means depending on the lighting rate detected by the detection means.

In this case, since it is possible to vary the inductance value depending on the detected lighting rate, it is possible to set an optimum inductance value depending on the lighting rate and enhance the recovery efficiency.

The variable inductance means may include a plurality of inductance elements connected in parallel and selection means controlled by the control means for selecting a given inductance element of the plurality of inductance elements.

In this case, since it is possible to select a given inductance element of the plurality of inductance elements connected in parallel, it is made possible by combining any of the plurality of inductance elements, to realize various inductance values and set an optimum inductance value depending on the lighting rate.

The variable inductance means may include a plurality of inductance elements connected in series and selection means controlled by the control means for selecting a given inductance element of the plurality of inductance elements.

In this case, since it is possible to select a given inductance element of the plurality of inductance elements connected in series, it is made possible by combining any of inductance element of the plurality of inductance elements, to realize various inductance values and set an optimum inductance value depending on the lighting rate.

The recovery means further includes a capacitive element for recovering charges from the capacitive load; the variable inductance means includes a first inductance element; the resonance driving means includes first switch means connected to the first inductance means between the capacitive load and the capacitive element; and the variable inductance means further includes a second inductance element and second switch means connected in series to opposite ends of the first inductance element. The control means may control the on/off states of the first and second switch means.

In this case, since the second inductance element can be connected in parallel to the first inductance element depending on the lighting rate, it is possible to set an optimum inductance value depending on the lighting rate by using a composite inductance value of the first and second inductance elements and an inductance value of the first inductance element.

The recovery means further includes a capacitive element for recovering charges from the capacitive load; the variable inductance means includes a first inductance element; the resonance driving means includes first switch means connected in series to the first inductance element between the capacitive load and the capacitive element; the variable inductance means further includes a second inductance element and second switch means connected in series between the capacitive load and the capacitive element. The control means may control the on/off states of the first and second switch means.

In this case, since the on/off states of the first and second switch means are controlled depending on the lighting rate, it is possible to set an optimum inductance value depending on the lighting rate by using a composite inductance value of the first and second inductance elements as well as inductance values of the first and second inductance elements. Moreover, since only one switch means is provided between the capacitive load and the capacitive element, it is possible to reduce a loss caused by the switch means to a required minimum and further decrease reactive power.

The resonance driving means further includes a third inductance element and third switch means connected in series between the capacitive load and the capacitive element. The control means may turn on at least one of the first switch means and the second switch means in a discharge recovery time of a recovery time, in which discharge cells discharge, while the control means may turn on the third switch means in a non-discharge recovery time of the recovery time, in which said discharge cells do not discharge.

In this case, since the on/off states of the first and second switch means are controlled so that at least one of the first and second inductance elements is connected between the capacitive load and the capacitive element in the discharge recovery time, it is possible to set an optimum inductance value in the discharge recovery time depending on the lighting rate by using the composite inductance value of the first and second inductance elements as well as the inductance values of the first and second inductance elements.

Moreover, since the on/off states of the third switch means are controlled so that the third inductance element is connected between the capacitive load and the capacitive element in the non-discharge recovery time, it is possible to set an inductance value of the third inductance element and more decrease the reactive power in view of only the decrease of reactive power, not in view of the discharge stability of discharge cells in the non-discharge recovery time.

The resonance driving means further includes third switch means connected in parallel to the first switch means; and the variable inductance means further includes fourth switch means connected in parallel to the second switch means. The control means may control the on/off states of the first to fourth switch means.

In this case, since it is possible to independently control the on/off states of the first to fourth switch means, it is possible to independently control the resonance time at the rising of the drive pulse and that at the falling of the drive pulse, and also, the second inductance element is used in common at the rising and falling of the sustain pulse, thereby enabling a simplified circuit configuration.

The control means may control the on/off states of the first and second switch means so that the second switch means is turned on after the first switch means is turned on.

In this case, since the first and second inductance elements are connected in parallel after the connection of the capacitive element and the first inductance element, it is made possible to vary the inductance value into various values and set an optimum inductance value depending on the lighting rate, by changing a ratio of a time period that only the inductance value of the first inductance element is employed and a time period that the composite inductance value of the first and second inductance elements is employed.

The display device further includes conversion means for converting image data in one field into image data in each of a plurality of subfields divided from one field in order to carry out a gray scale display by causing discharge of any of discharge cells selected for each subfield. The detection means includes subfield lighting rate detection means for detecting a lighting rate for each subfield. The control means may control a time period that the second switch means is turned on, depending on the lighting rate for each subfield detected by the subfield lighting rate detection means.

In this case, since the time period in which the second switch means is turned on is controlled depending on the lighting rate detected for each subfield, it is possible to vary the inductance value depending on the lighting rate for each subfield and optimize the inductance value depending on the lighting rate even in the case of the gray scale display.

The first and second switch means may be any one of a set of field-effect transistor and a diode connected in series, a set of two field-effect transistors connected in series, and an insulated-gate bipolar transistor.

In this case, since the first and second switch means are formed of any one of the set of series-connected field-effect transistor and diode, the set of the series-connected two field-effect transistors, and the insulated-gate bipolar transistor, a switching operation can be carried out by each of those elements. The use of the series-connected two field-effect transistors can especially reduce a loss in the switch means.

The control means may control the recovery means so that the resonance time of LC resonance becomes longer as the lighting rate detected by the detection means becomes smaller.

In this case, since the resonance time of LC resonance is set longer as the detected lighting rate becomes smaller, it is made possible to make the stable discharge voltage constant by increasing the resonance time in the case of a smaller lighting rate, while decreasing the resonance time in the case of a larger lighting rate. In the case of a larger lighting rate, in particular, the resonance time is set shorter to enable stable discharge, and the reactive power may be reduced by improving the recovery efficiency.

The control means may vary the period of the drive pulse depending on the lighting rate detected by the detection means.

In this case, since it is possible to vary the period of the drive pulse depending on the lighting rate, it is possible to lengthen the period of the drive pulse to sufficiently ensure the recovery time in the case of a smaller lighting rate.

A method of driving a display device according to a further aspect of the present invention is a method of driving a display device that displays an image by causing a plurality of discharge cells to selectively discharge, wherein the plurality of discharge cells include a capacitive load; and the display device includes inductance means having at least one inductance element that has one end connected to the capacitive load, the method including the steps of: recovering charges stored in the discharge cells to drive a drive pulse by LC resonance of the capacitive load and the inductance element by using the recovered charges; detecting a lighting rate of any of the plurality of discharge cells, which are to be turned on at the same time; and varying a recovery time in which the drive pulse is driven in the recovery step and a resonance time of LC resonance, depending on the lighting rate detected by the detection step.

In the display device driving method in accordance with the present invention, the drive pulse is driven by the LC resonance of the capacitive load and the inductance element, and also, the lighting rate of any of the plurality of discharge cells, which are to be turned on at the same time, is detected, so that the recovery time, in which the drive pulse is driven, and the resonance time of LC resonance are varied depending on the lighting rate. This enables the drive pulse to be driven in an optimum recovery time and in an optimum resonance time of LC resonance corresponding to the lighting rate. Therefore, when the lighting rate is larger, the recovery time is set shorter to enable stable discharge, and also, the resonance time is set shorter to enable decreased reactive power. Conversely, when the lighting rate is smaller, the recovery time is set longer to enable the decreased reactive power. Consequently, even though the lighting rate varies, it is possible to carry out the stable discharge and decrease the reactive power and thus power consumption.

A method of driving a display device according to a further aspect of the present invention is a method of driving a display device that displays an image by causing a plurality of discharge cells to selectively discharge, wherein the plurality of discharge cells include a capacitive load; and the display device includes inductance means having at least one inductance element that has one end connected to the capacitive load, the method including the steps of: recovering charges stored in the discharge cells to drive a drive pulse by LC resonance of the capacitive load and the inductance element by using the recovered charges; detecting a lighting rate of any of the plurality of discharge cells which are to be turned on at the same time; and varying a resonance time of the LC resonance depending on the lighting rate detected by the detection step.

In the display device driving method in accordance with the present invention, since the drive pulse is driven by the LC resonance of the capacitive load and the inductance element, and also, the resonance time of the LC resonance is varied depending on the detected lighting rate, it is possible to set the resonance time of the LC resonance to an optimum time depending on the detected lighting rate. Accordingly, it is made possible to make a stable discharge voltage constant by increasing an inductance value of the inductance element to set the resonance time longer in the case of a smaller lighting rate, while decreasing the inductance value to set the resonance time shorter in the case of a larger lighting rate. In the case of a larger lighting rate, in particular, the resonance time is set shorter to enable stable discharge, and recovery efficiency is improved to enable decreased reactive power. Further, discharge stability can be enhanced by making a recovery time constant. Consequently, even though the lighting rate is varied, it is possible to carry out the stable discharge and reduce the reactive power and thus power consumption.

A display device according to a further aspect of the present invention is a display device that displays an image by causing a plurality of discharge cells to selectively discharge, including: a recovery circuit that recovers charges stored in the discharge cells to drive a drive pulse by using the recovered charges; and a detection circuit that detects a lighting rate of any of the plurality of discharge cells, which are to be turned on at the same time, wherein the plurality of discharge cells include a capacitive load; and the recovery circuit includes an inductance circuit having at least one inductance element that has one end connected to the capacitive load, and a resonance driving circuit that drives the drive pulses by LC resonance of the capacitive load and the inductance element. The display device further includes a control circuit that controls the recovery circuit so as to vary a recovery time in which the drive pulse is driven by the recovery circuit and a resonance time of the LC resonance depending on the lighting rate detected by the detection circuit.

In the display device in accordance with the present invention, the drive pulse is driven by the LC resonance of the capacitive load and the inductance element; the lighting rate of any of the plurality of discharge cells, which are to be turned on at the same time, is detected; and the recovery time in which the drive pulse is driven and the resonance time of the LC resonance are varied depending on the lighting rate. This makes it possible to drive the drive pulse in an optimum recovery time and an optimum resonance time of the LC resonance corresponding to the lighting rate. Therefore, when the lighting rate is larger, the recovery time is set shorter to enable the stable discharge, and the resonance time is set shorter to enable the decreased reactive power. Conversely, when the lighting rate is smaller, the recovery time is set longer to enable the decreased reactive power. Consequently, even though the lighting rate is varied, it is possible to carry out the stable discharge and reduce the reactive power and power consumption.

A display device according to a further aspect of the present invention is a display device that displays an image by causing a plurality of discharge cells to selectively discharge, including: a recovery circuit that recovers charges stored in the discharge cells to drive a drive pulse by using the recovered charges; and a detection circuit that detects a lighting rate of any of the plurality of discharge cells, which are to be turned on at the same time, wherein the plurality of discharge cells include a capacitive load; and the recovery circuit includes an inductance circuit having at least one inductance element that has one end connected to the capacitive load, and a resonance driving circuit that drives the drive pulse by LC resonance of the capacitive load and the inductance element. The display device further includes a control circuit that controls the recovery circuit so as to vary a resonance time of the LC resonance depending on the lighting rate detected by the detection circuit.

In the display device in accordance with the present invention, since the drive pulse is driven by the LC resonance of the capacitive load and the inductance element, and also the resonance time of the LC resonance is varied depending on the detected lighting rate, it is possible to set the resonance time of the LC resonance to an optimum time depending on the detected lighting rate. Accordingly, it is made possible to make a stable discharge voltage constant by increasing an inductance value of the inductance element to set the resonance time longer in the case of a smaller lighting rate, while decreasing the inductance value to set the resonance time shorter in the case of a larger lighting rate. In the case of a larger lighting rate, in particular, the resonance time is set shorter to enable stable discharge, and recovery efficiency is improved to enable decreased reactive power. Further, discharge stability can be enhanced by making a recovery time constant. Consequently, even though the lighting rate is varied, it is possible to carry out the stable discharge and reduce the reactive power and thus power consumption.

BRIEF DESCRIPTION OF DRAWINGS

FIG. 18 is a schematic diagram showing the on/off states of respective transistors in the variable inductance unit shown in FIG. 17 and driving waveforms obtained at the time sustain pulses rise corresponding to respective states.

BEST MODE FOR CARRYING OUT THE INVENTION

Figure 1:
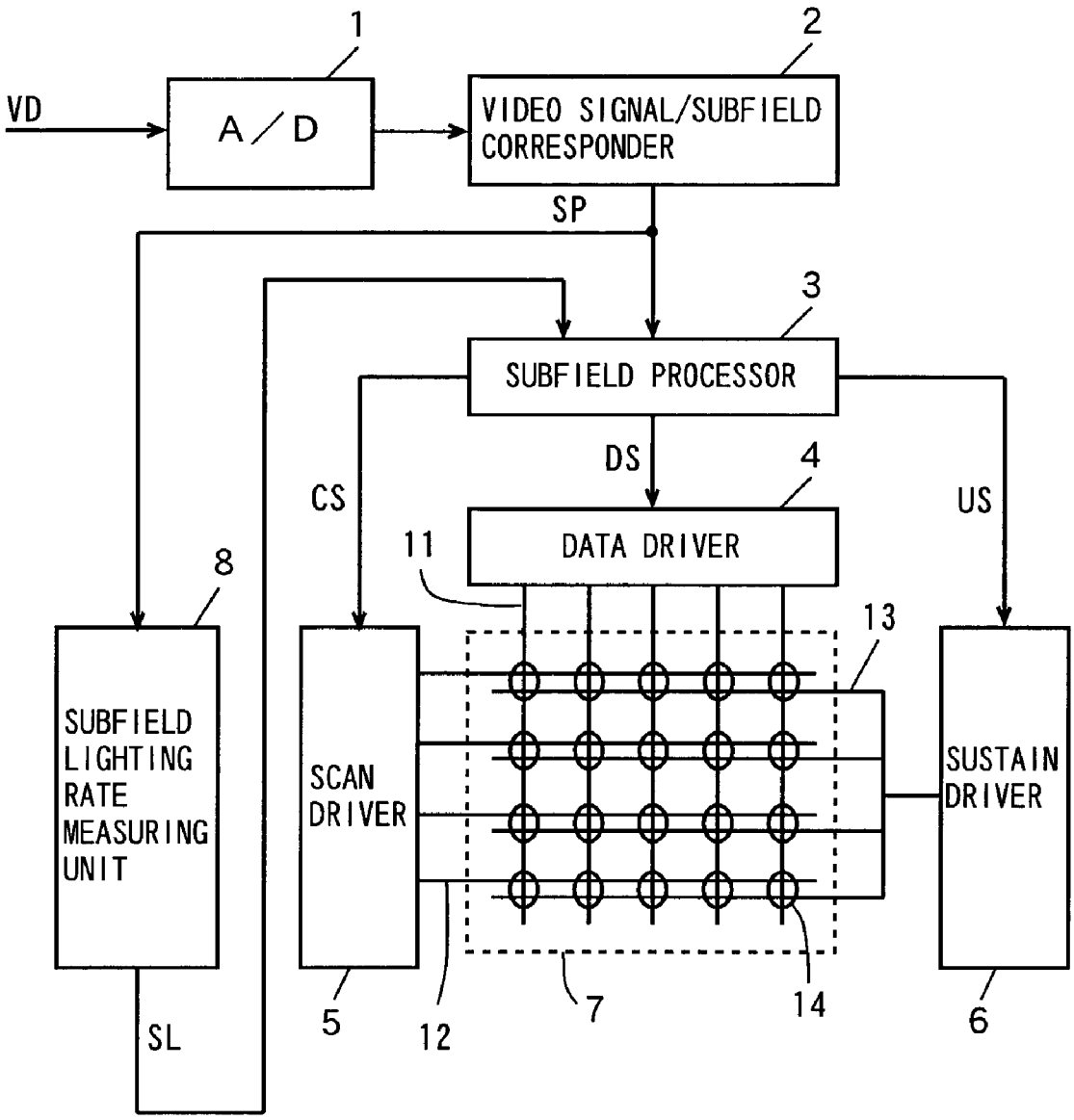
FIG. 1 is a block diagram showing the structure of a plasma display device according to a first embodiment of the present invention.

Description will now be made on an AC type plasma display device as one example of a display device in accordance with the present invention. FIG. 1 is a block diagram showing the structure of a plasma display device according to a first embodiment of the present invention.

The plasma display of FIG. 1 includes an A/D converter (analog-to-digital converter) 1, a video signal/subfield corresponder 2, a subfield processor 3, a data driver 4, a scan driver 5, a sustain driver 6, a PDP (plasma display panel) 7 and a subfield lighting rate measuring unit 8.

The A/D converter 1 is supplied with a video signal VD. The A/D converter 1 converts an analog video signal VD into digital image data to output the image data to the video signal/subfield corresponder 2. In order to display by dividing one field into a plurality of subfields, the video signal/subfield corresponder 2 produces image data SP for each subfield from image data in one field to output the produced image data SP to the subfield processor 3 and the subfield lighting rate measuring unit 8.

The subfield lighting rate measuring unit 8 detects a lighting rate of discharge cells 14 that are simultaneously driven on the PDP 7, from the image data SP for each subfield, so as to output the result of the detection as a subfield lighting rate signal SL to the subfield processor 3.

If the minimum unit of a discharge space that can independently be controlled to be put into a lighting/non-lighting state is referred to as a discharge cell, the lighting rate is given by the following equation:

(Lighting rate)=(Number of discharge cells that are turned on simultaneously)/(Number of all discharge cells on PDP)

Specifically, the subfield lighting rate measuring unit 8 separately calculates the respective lighting rates of all subfields by using video signal information decomposed into one-bit information representing the lighting/non-lighting of the discharge cells for each of subfields that are generated by the video signal/subfield corresponder 2. The measuring unit 8 then outputs the results of the calculation as the subfield lighting rate signal SL to the subfield processor 3.

For example, the subfield lighting rate measuring unit 8 includes a counter therein. The measuring unit 8 finds the total number of discharge cells that are turned on for each subfield by increasing the value of the counter one at a time when the video signal information, which are decomposed into the one-bit information representing lighting/non-lighting, represents lighting, and divides the found total number by the number of all discharge cells on the PDP 7, so as to find the lighting rate.

The subfield processor 3 produces a data driver driving control signal DS, a scan driver driving control signal CS and a sustain driver driving control signal US from the image data SP for each subfield, the subfield lighting rate signal SL and the like and outputs those signals DS, CS and US to the data driver 4, the scan driver 5 and the sustain driver 6, respectively.

The PDP 7 includes a plurality of address electrodes (data electrodes) 11, a plurality of scan electrodes 12 and a plurality of sustain electrodes 13. The plurality of address electrodes 11 are arranged in the vertical direction of a screen, while the plurality of scan electrodes 12 and the plurality of sustain electrodes 13 are arranged in the horizontal direction of the screen. The plurality of sustain electrodes 13 are connected in common. The discharge cells are formed at respective crossing points of the address electrodes 11, the scan electrodes 12 and the sustain electrodes 13. Discharge cells 14 each constitute pixels on the screen.

The data driver 4 is connected to the plurality of address electrodes 11 in the PDP 7. The scan driver 5 includes driving circuits therein each provided for each scan electrode 12. Each of the driving circuits is connected to its corresponding scan electrode 12 in the PDP 7. The sustain driver 6 is connected to the plurality of sustain electrodes 13 in the PDP 7.

The data driver 4 applies write pulses to corresponding address electrodes 11 in the PDP 7 in response to the image data SP in a write time period on the basis of the data driver driving control signal DS. The scan driver 5 applies write pulses in turn to the plurality of scan electrodes 12 in the PDP 7 while shifting shift pulses in a vertical scanning direction in the write time period on the basis of the scan driver driving control signal CS. Consequently, address discharges are carried out in corresponding discharge cells 14.

The scan driver 5 applies periodical sustain pulses to the plurality of scan electrodes 12 in the PDP 7 in a sustain time period on the basis of the scan driver driving control signal CS. On the other hand, the sustain driver 6 simultaneously applies sustain pulses which are shifted in phase by 180° from the sustain pulses of the scan electrodes 12, to the plurality of sustain electrodes 13 in the PDP 7 in the sustain time period on the basis of the sustain driver driving control signal US. Consequently, sustain discharges are carried out in the corresponding discharge cell 14.

In the above sustain time period, the scan driver 5 and the sustain driver 6 vary the waveform and the period of sustain pulses in response to the subfield lighting rate signal SL on the basis of the scan driver driving control signal CS and the sustain driver driving control signal US, as will be described later.

In the plasma display device shown in FIG. 1, an ADS (Address Display-Period Separation) method is adopted as a gray scale display driving method. In the ADS method, one field (1/60 seconds=16.67 ms) is divided on a time basis into a plurality of subfields.

In the case of a 256 gray scale display by 8 bits, for example, one field is divided into 8 subfields SF1 to SF8. The respective subfields SF1 to SF8 are weighted with respective brightness values of 1, 2, 4, 8, 16, 32, 64 and 128. Combination of those subfields SF1 to SF8 makes it possible to adjust the level of brightness on 256 gray scales from 0 to 255, thereby enabling the gray scale display. The number of subfields to be divided, the values of subfields to be weighted and the like are not particularly limited to those in the above example but can be subject to various alterations. In order to reduce a pseudo contour of a moving picture, for example, the subfield SF8 may be divided into two subfields, to set the value with which these divided two subfields are weighted to 64.

Figure 2:
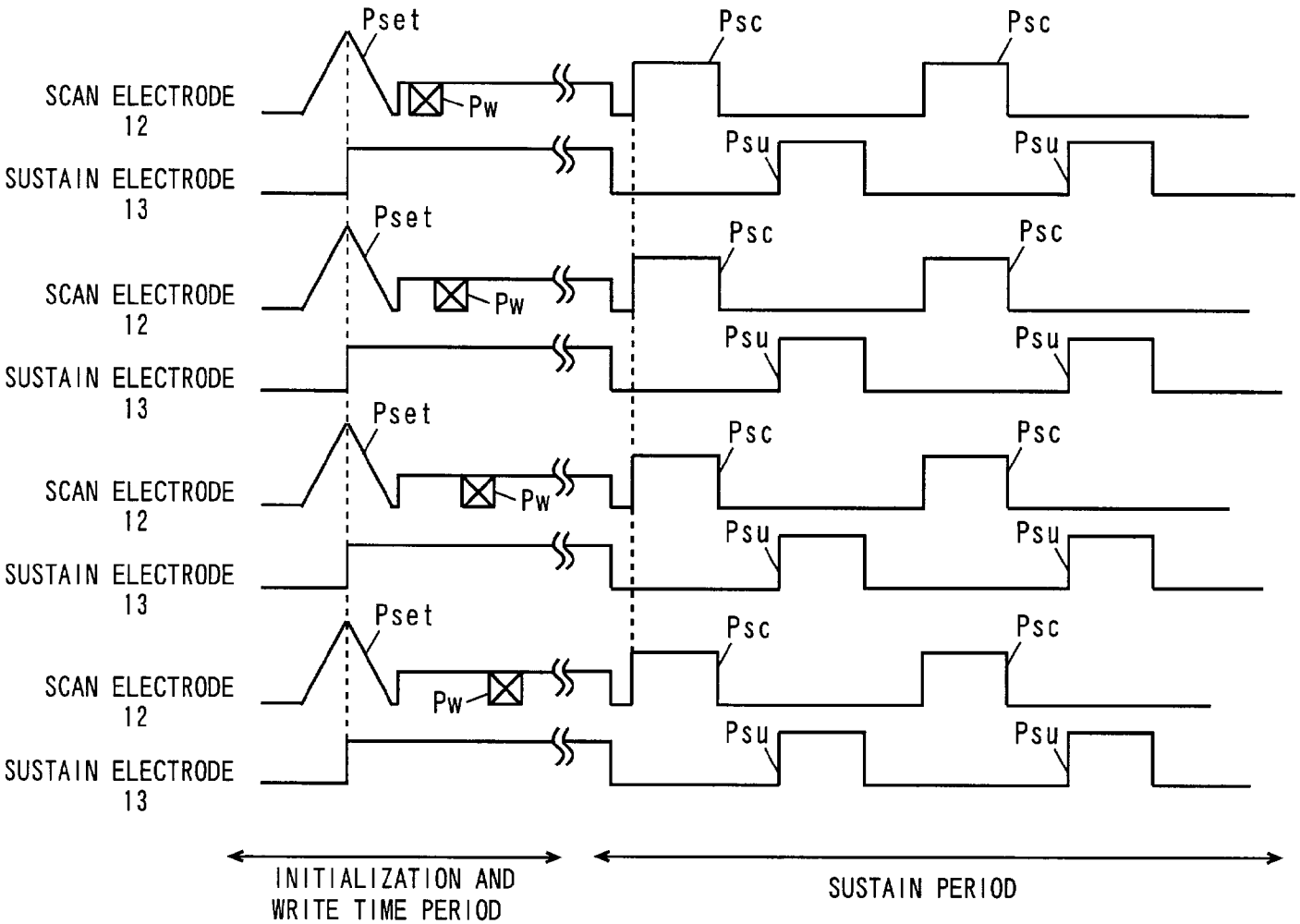
FIG. 2 is a timing chart showing one example of driving voltages of scan electrodes and sustain electrodes in the PDP of FIG. 1.

FIG. 2 is a timing chart showing one example of a driving voltage of the scan electrodes 12 and the sustain electrodes 13 in the PDP 7 of FIG. 1.

In an initialization and write time period, initialization pulses (setup pulses) Pset are simultaneously applied to the plurality of scan electrodes 12. After that, write pulses Pw are applied in turn to the plurality of scan electrodes 12. This causes address discharges in corresponding discharge cells in the PDP 7.

Then, in a sustain time period, sustain pulses Psc are periodically applied to the plurality of scan electrodes 12, while sustain pulses Psu are periodically applied to the plurality of sustain electrodes 13. The phase of the sustain pulses Psu is shifted by 180° from that of sustain pulses Psc. This causes sustain discharges subsequent to the address discharges.

Figure 3:
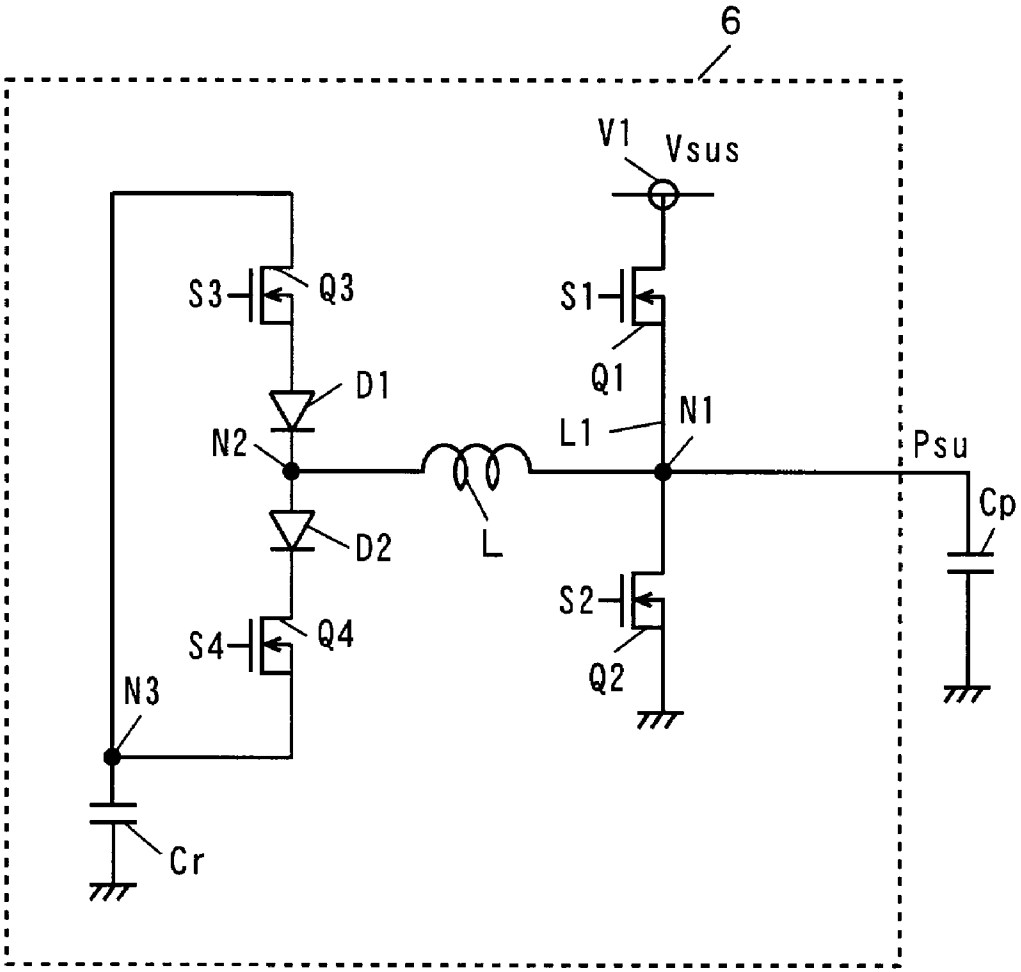
FIG. 3 is a circuit diagram showing the structure of a sustain driver shown in FIG. 1.

FIG. 3 is a circuit diagram showing the structure of the sustain driver shown in FIG. 1. Since the scan driver 5 is structured and operates similarly to the sustain driver 6, a detailed description on the scan driver 5 will not be given. A detailed description will be made only on the sustain driver 6.

The sustain driver 6 shown in FIG. 3 includes FETs (field-effect transistors; hereinafter referred to as transistors) Q1 to Q4, a recovery capacitor Cr, a recovery coil L and diodes D1 and D2.

The transistor Q1 has its one end connected to a power supply terminal V1, the other end connected to a node N1 and its gate supplied with a control signal S1. A sustain voltage Vsus is applied to the power supply terminal V1. The transistor Q2 has its one end connected the node N1, the other end connected to a ground terminal and its gate supplied with a control signal S2.

While the node N1 is connected to, for example, 480 sustain electrodes 13, a panel capacitance Cp corresponding to all capacitances provided between the plurality of sustain electrodes 13 and the ground terminal is illustrated in FIG. 3. This respect is similarly applied to sustain drivers presented in other embodiments in the following.

The recovery capacitor Cr is connected between a node N3 and the ground terminal. The transistor Q3 and the diode D1 are connected in series between the node N3 and a node N2. The diode D2 and the transistor Q4 are connected in series between the nodes N2 and N3. The transistor Q3 has its gate provided with a control signal S3, while the transistor Q4 has its gate provided with a control signal S4. The recovery coil L is connected between the nodes N2 and N1.

Figure 4:
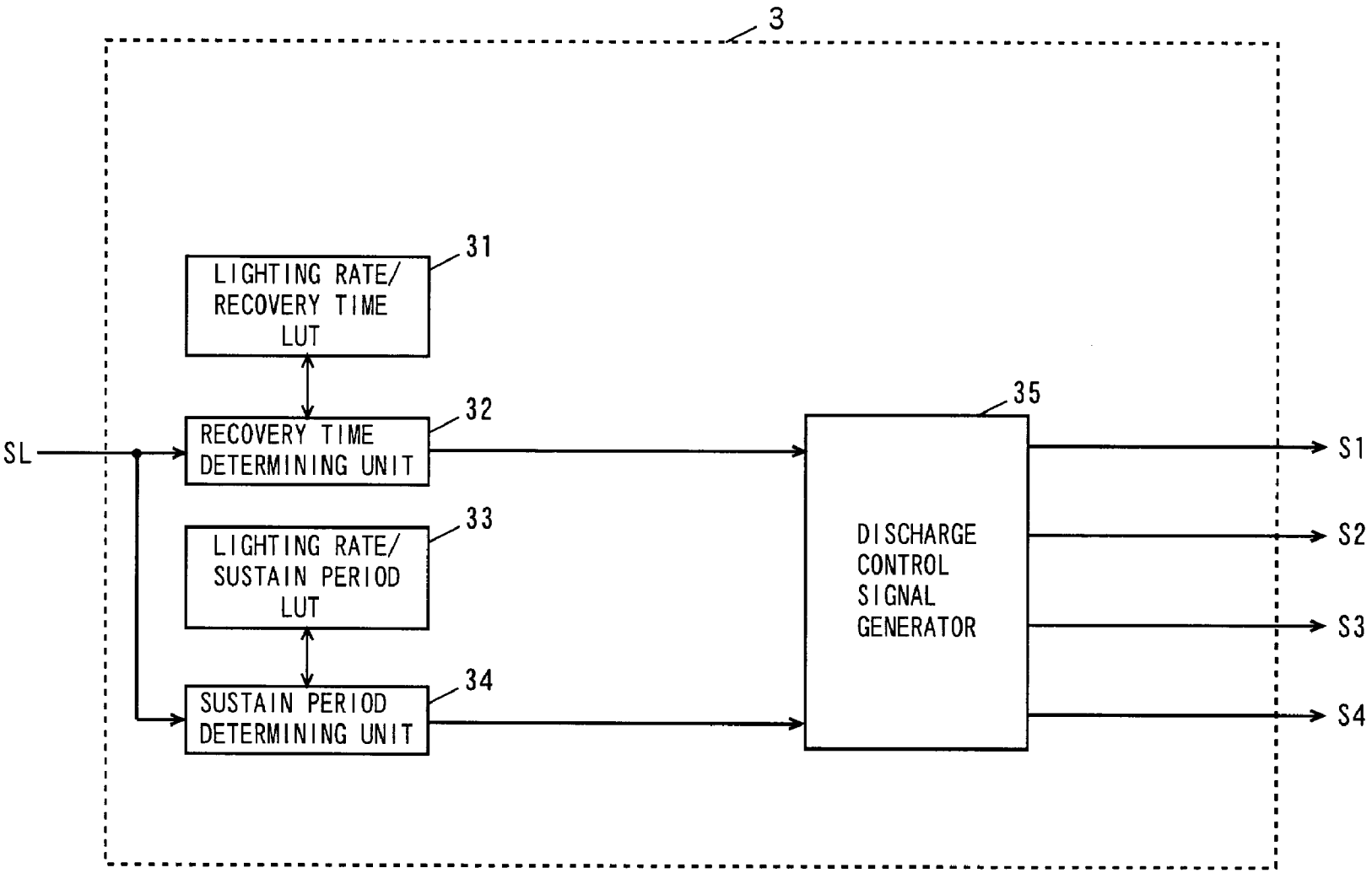
FIG. 4 is a block diagram showing the structure of a subfield processor shown in FIG. 1.

FIG. 4 is a block diagram showing the structure of the subfield processor 3 of FIG. 1.

The subfield processor 3 shown in FIG. 4 includes a lighting rate/recovery time LUT (Look-up Table) 31, a recovery time determining unit 32, a lighting rate/sustain period LUT 33, a sustain period determining unit 34 and a discharge control signal generator 35.

The lighting rate/recovery time LUT 31 is connected to the recovery time determining unit 32 and stores therein in a table format the relationship between a lighting rate and a recovery time based on experimental data. For example, 1300 ns is stored as the recovery time with respect to the lighting rate of 0 to 10%, 1100 ns as the recovery time with respect to the lighting rate of 0 to 50%, 900 ns as the recovery time with respect to the lighting rate of 50 to 80%, 700 ns as the recovery time with respect to the lighting rate of 80 to 90%, and 600 ns with respect to the lighting rate of 90 to 100%. Here, the recovery time means a time period in which each sustain pulse Psu is driven by LC resonance caused by the recovery coil L and the panel capacitance Cp.

The recovery time determining unit 32 is connected to the discharge control signal generator 35 and reads a corresponding recovery time from the lighting rate/recovery time LUT 31 in response to the subfield lighting rate signal SL output from the subfield lighting rate measuring unit 8, so as to output the read recovery time to the discharge control signal generator 35. Determination of the recovery time is not particularly limited to the above example that the relationship between the lighting rate and the recovery time based on experimental data is stored in a table format, but the recovery time corresponding to the lighting rate may be evaluated by an approximate expression representing the relationship between the lighting rate and the recovery time.

The lighting rate/sustain period LUT 33 is connected to the sustain period determining unit 34 and stores in a table format the relationship between the lighting rate and a sustain period based on experimental data. For example, 8 μs is stored as the sustain period with respect to the lighting rate of 0 to 50%, 7 μs as the sustain period with respect to the lighting rate of 50 to 80%, and 6 μs as the sustain period with respect to the lighting rate of 80 to 100%. Here, the sustain period means the period of each sustain pulse Psu.

The sustain period determining unit 34 is connected to the discharge control signal generator 35 and reads from the lighting rate/sustain period LUT 33 a corresponding sustain period in response to the subfield lighting rate signal SL output from the subfield lighting rate measuring unit 8, so as to output the read sustain period to the discharge control signal generator 35. Determination of the sustain period is not particularly limited to the above example that the relationship between the lighting rate and the sustain period based on experimental data is stored in the table format, but an approximate expression and the like representing the relationship between the lighting rate and the sustain period may be employed.

The discharge control signal generator 35 outputs control signals S1 to S4 as the sustain driver driving control signal US so that the sustain driver 6 outputs sustain pulses Psu in the recovery time determined by the recovery time determining unit 32 and in the sustain period determined by the sustain period determining unit 34.

The scan driver 5 is also controlled by the subfield processor 3 similarly to the above, and the waveform and the period of sustain pulses to be applied to the scan electrodes 12 are likewise controlled on the basis of the lighting rate of subfields.

In this embodiment, the transistors Q3, Q4, the recovery capacitor Cr, the recovery coil L and the diodes D1, D2 correspond to recovery means; the subfield lighting rate measuring unit 8 corresponds to detection means and subfield lighting rate detection means; the subfield processor 3 corresponds to control means; and the video signal/subfield corresponder 2 corresponds to conversion means. The recovery coil L corresponds to inductance means and an inductance element; and the transistors Q3, Q4, the recovery capacitor Cr and the diodes D1, D2 correspond to resonance driving means.

Figure 5:
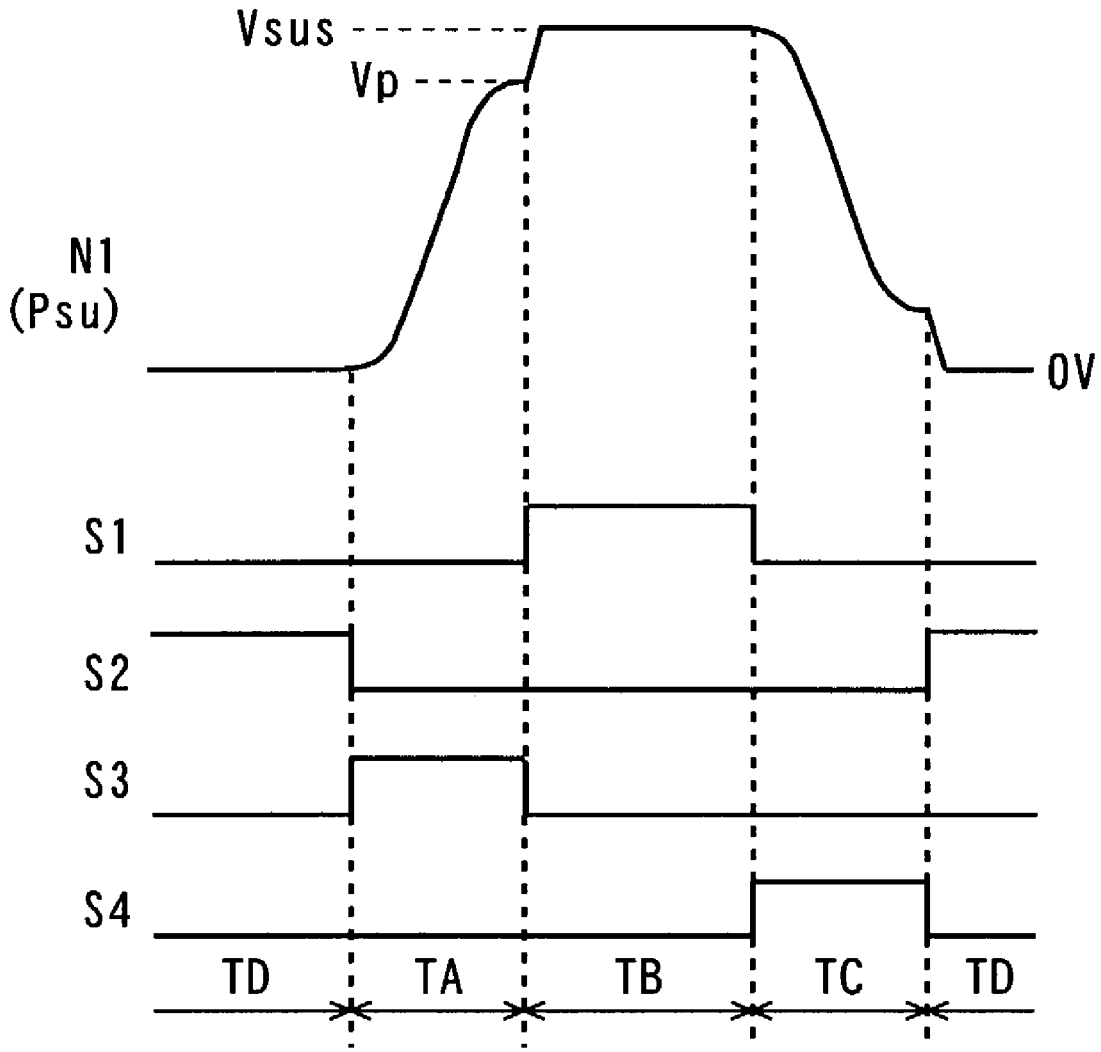
FIG. 5 is a timing chart showing one example of the operation of the sustain driver shown in FIG. 3 in a sustain time period.

FIG. 5 is a timing chart showing one example of the operation of the sustain driver of FIG. 3 in the sustain time period. FIG. 5 illustrates the voltage at the node N1 and control signals S1 to S4 input to the transistors Q1 to Q4 shown in FIG. 3.

First, in a time period TA, the control signal S2 attains a low level to turn the transistor Q2 off, while the control signal S3 attains a high level to turn the transistor Q3 on. At this time, the control signal S1 is at a low level and the transistor Q1 is off, while the control signal S4 is at a low level and the transistor Q4 is off. Accordingly, the recovery capacitor Cr is connected to the recovery coil L via the transistor Q3 and the diode D1, and the LC resonance caused by the recovery coil L and the panel capacitance Cp causes the voltage at the node N1 to rise from a ground potential to a peak voltage Vp.

At this time, when the voltage at the node N1 exceeds a discharge starting voltage in the sustain time period, discharge cells 14 start discharge, and sustain discharge is then carried out. The charges stored in the recovery capacitor Cr are exerted to the panel capacitance Cp via the diode D1 and the recovery coil L.

Then, in a time period TB, the control signal S1 attains a high level to turn the transistor Q1 on, while the control signal S3 attains a low level to turn the transistor Q3 off. Accordingly, the node N1 is connected to the power supply terminal V1, and the voltage at the node N1 increases and is then fixed to the sustain voltage Vsus.

Then, in a time period TC, the control signal S1 attains a low level to turn the transistor Q1 off, while the control signal S4 attains a high level to turn the transistor Q4 on. Accordingly, the recovery capacitor Cr is connected to the recovery coil L via the diode 2 and the transistor Q4. The LC resonance caused by the recovery coil L and the panel capacitance Cp causes a gradual decrease of the voltage at the node N1. At this time, the charges stored in the panel capacitance Cp are stored in the recovery capacitor Cr via the recovery coil L, the diode D2 and the transistor Q4, so that the charges are recovered.

In a time period TD, the control signal S2 attains a high level to turn the transistor Q2 on, while the control signal S4 attains a low level to turn the transistor Q4 off. Accordingly, the node N1 is connected to the ground terminal, and the voltage at the node N1 falls and is then fixed to a ground potential.

In the example shown in FIG. 5, the time periods TA and TC are recovery times: the time period TA is a discharge recovery time in which discharge cells discharge, while the time period TC is a non-discharge recovery time in which discharge cells do not discharge.

If the time required for sustain pulses Psu to reach a peak due to the LC resonance caused by the recovery coil L and the panel capacitance Cp is a resonance time Tr, the resonance time Tr is expressed by the following equation:

$$Tr=\pi(L\cdot Cp)^{1/2}$$

where, L is an inductance value of the recovery coil L, and Cp is a capacitance of the panel capacitance Cp.

Therefore, in the example shown in FIG. 5, since the sustain pulse Psu reach the peak voltage Vp in the end of the time period TA due to the LC resonance caused by the recovery coil L and the panel capacitance Cp, the time period TA is also the resonance time.

Such periodical sustain pulses Psu that cause the discharge of the discharge cells 14 when the pulses rise from the ground potential to the sustain voltage Vsus can be applied to the plurality of sustain electrodes 13 by repetition of the above-described operation in the sustain time period. Similarly, the sustain pulses Psc that have the same waveform as that of the above sustain pulses Psu and are shifted in phase by 180° are periodically applied also to the scan electrodes 12 by the scan driver 5.

Figure 6:
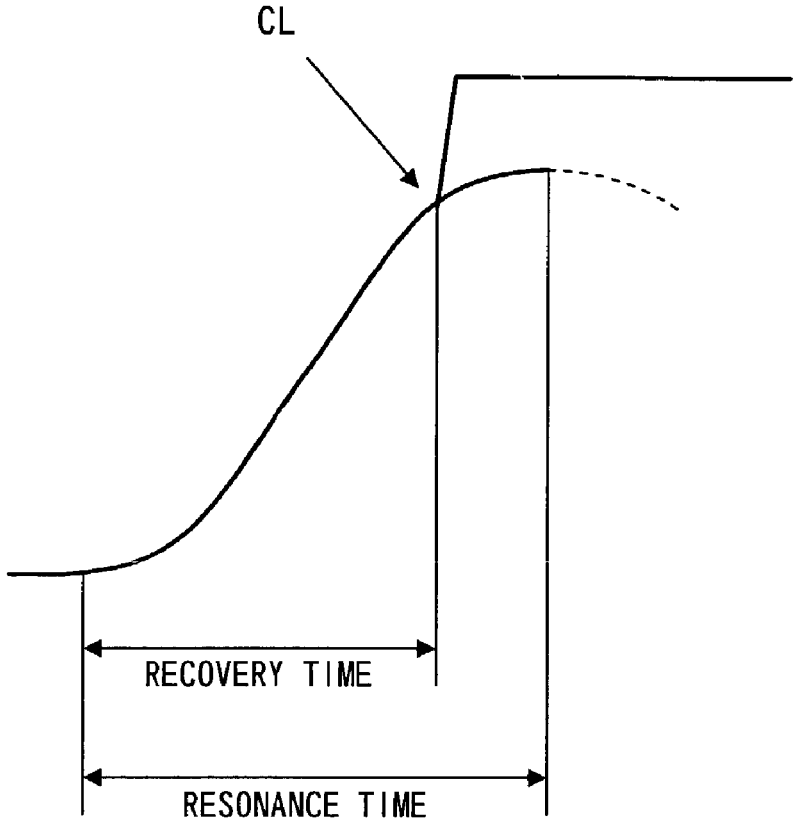
FIG. 6 is a waveform diagram for use in explanation of a recovery time and a resonance time.

FIG. 6 is a waveform diagram for use in explaining the recovery time and the resonance time. In FIG. 6, CL represents timing at which the node N1 of FIG. 3 is clamped to a power supply voltage (sustain voltage Vsus). The recovery time is a time period required from the time when recovery starts until the time when the node N1 is clamped to the power supply voltage. On the other hand, the resonance time is a time period required from the time when recovery starts until the time when the node N1 reaches an inherent peak voltage with the waveform caused by the LC resonance.

Figure 7:
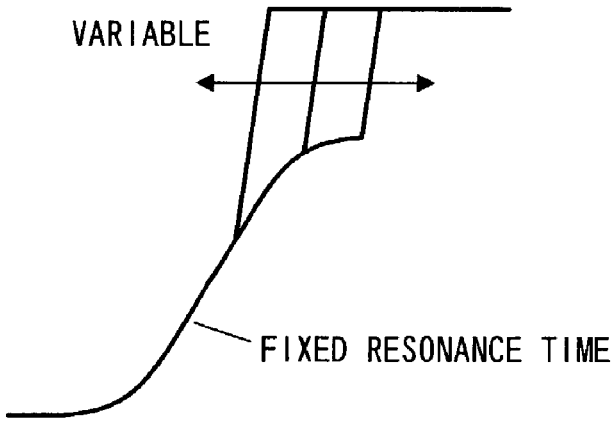
FIG. 7 is a waveform diagram for use in explanation of variable control in the recovery time.

FIG. 7 is a waveform diagram for use in explaining variable control of the recovery time. When the resonance time is fixed and the recovery time is varied, there is a variation in the increased amount of the voltage at the node N1 from the time when the node N1 is connected to the power supply terminal V1 with the transistor Q1 turning on, until the time when the voltage at the node N1 reaches the power supply voltage. This results in a variable loss of reactive power. In this case, the reactive power loss becomes smaller as the recovery time becomes longer.

Figure 8:
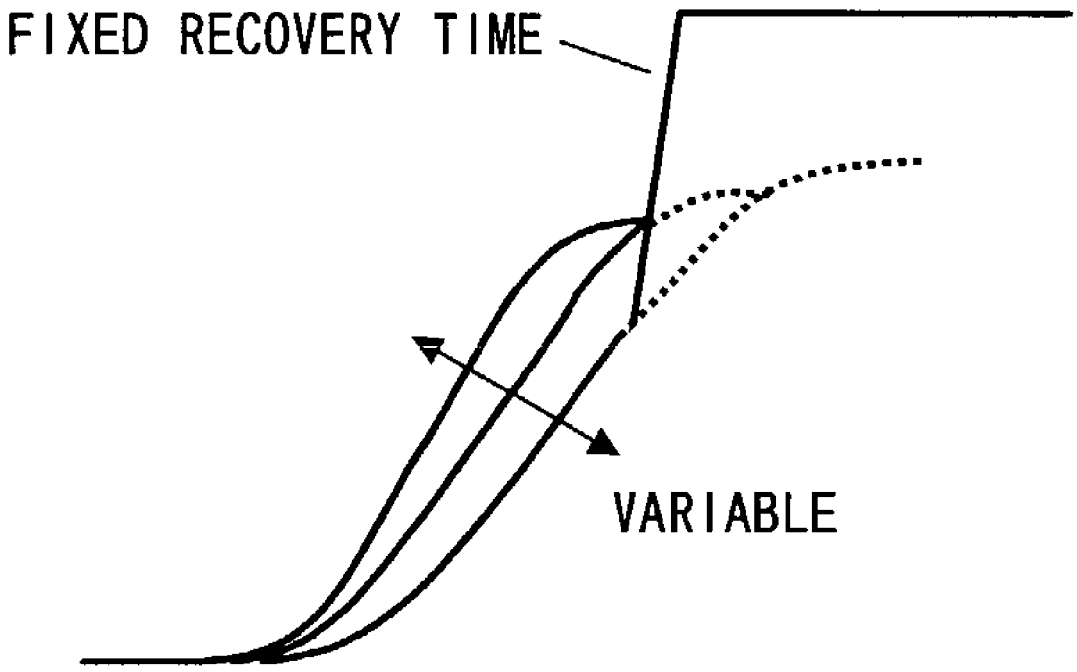
FIG. 8 is a waveform diagram for use in explanation of variable control in the resonance time.

FIG. 8 is a waveform diagram for use in explaining variable control of the resonance time. When the recovery time is fixed and the resonance time is varied, there is a variation in the increased amount of the voltage at the node N1 from the time when the node N1 is connected to the power supply terminal V1 with the transistor Q1 turning on, until the time when the voltage at the node N1 reaches the power supply voltage. This results in a variable loss of reactive power. In this case, the reactive power loss becomes smaller as the resonance time becomes shorter.

Description will now be made on operations for controlling the recovery time and the sustain period of sustain pulses by the subfield processor 3 shown in FIG. 1.

Figure 9:
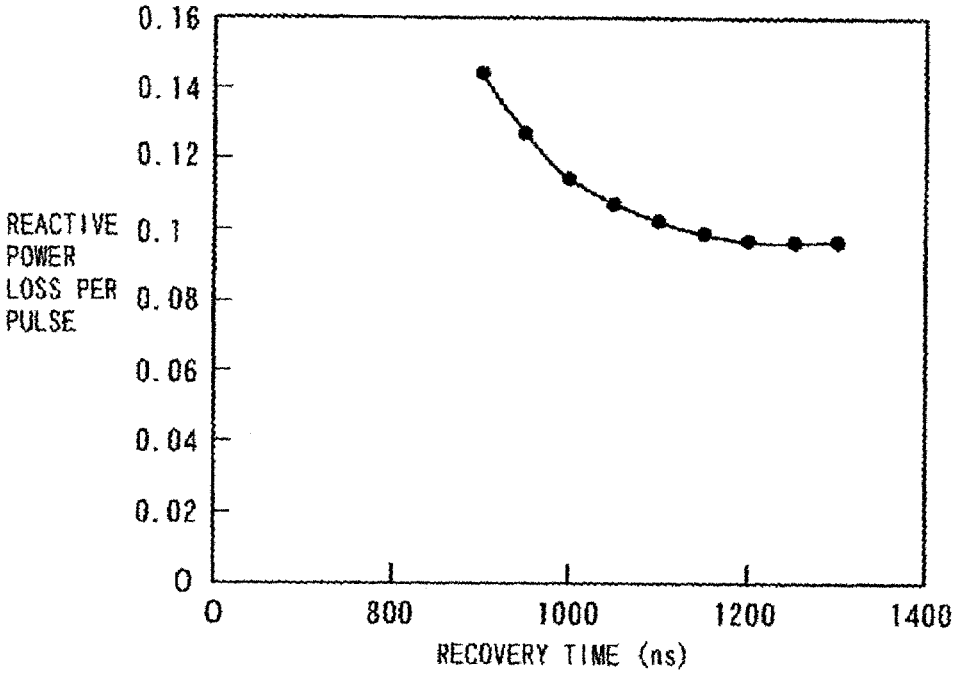
FIG. 9 is a diagram showing one example of the relationship between a recovery time and a reactive power loss.

FIG. 9 is a diagram showing an example of the relationship between the recovery time and the reactive power loss, which exhibits data representing measurements of the reactive power loss per pulse obtained when the resonance time is fixed to 1300 ns and the recovery time is varied. It is found that the reactive power loss per pulse becomes smaller as the recovery time becomes longer, as shown in FIG. 9.

Figure 10:
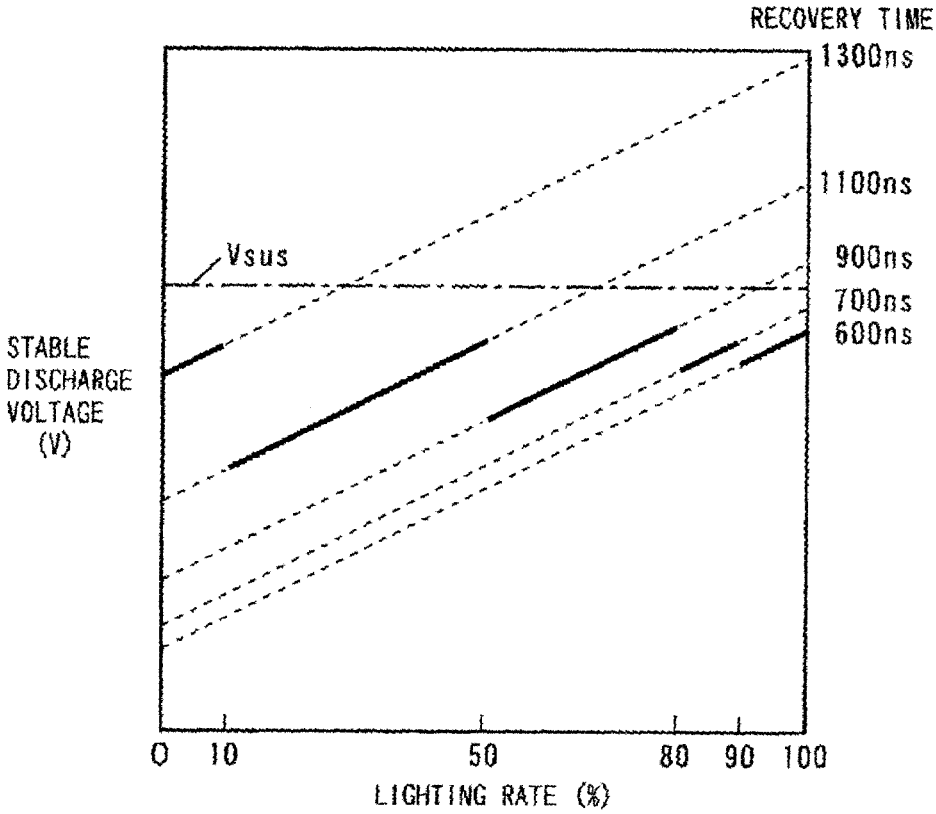
FIG. 10 is a diagram showing one example of the relationship between a lighting rate in each recovery time and a stable discharge voltage at which stable discharge can be carried out.

FIG. 10 is a diagram showing an example of the relationship between lighting rates provided in respective recovery times and a stable discharge voltage at which stable discharge can be carried out. It is understood that the stable discharge voltage becomes higher as the recovery time becomes longer even in the case of the same lighting rate, as shown in FIG. 10. In the case where the recovery time is 1300 ns, for example, it is understood that stable discharge can be carried out at or below the sustain voltage Vsus of sustain pulses when the lighting rate is in the range of 0 to 10%, whereas stable discharge cannot be carried out at the sustain voltage Vsus at the time when the lighting rate exceeds approximately 25%.

Thus, when the recovery time is shorter, stable discharge can be carried out in the case of a larger lighting rate as well as in the case of a smaller lighting rate. Conversely, when the recovery time is longer, stable luminescence can be made in the case of a smaller lighting rate, whereas stable discharge cannot be made in the case of a larger lighting rate.

Therefore, in this embodiment, the recovery time is set longer in the case of a smaller lighting rate, whereas the recovery time is set shorter in the case of a larger lighting rate, so that the reactive power is reduced in the case of a smaller lighting rate while stable discharge is carried out in both cases of smaller and larger lighting rates.

Specifically, the recovery time is set to 1300 ns in the range of the lighting rate from 0 to 10%, 1100 ns in the lighting rate range of from 10 to 50%, 900 ns in the range of from 50 to 80%, 700 ns in the range of from 80 to 90%, and 600 ns in the range of from 90 to 100%, by using the solid lines shown in FIG. 10.

That is, the subfield processor 3 generates control signals S1 to S4 so that the time period TA may be 1300 ns in the case of the lighting rate being 0 to 10%, generates the signals S1 to S4 so that the time period TA may be 1100 ns in the case of the lighting rate being 10 to 50%, generates the same so that the time period TA may be 900 ns in the case of the lighting rate being 50 to 80%, generates the same so that the time period TA may be 700 ns in the case of the lighting rate being 80 to 90%, and generates the same so that the time period TA may be 600 ns in the case of the lighting rate being 90 to 100%.

Consequently, stable discharge can be made with respect to all lighting rates at a sufficiently low voltage in comparison with the sustain voltage Vsus, and also, the recovery time is set longer as the lighting rate becomes smaller, thereby reducing the reactive power with the decrease of the lighting rate.

In addition, the subfield processor 3 generates control signals S1 to S4 so that the sustain period may be 8 μs in the case of the lighting rate being 0 to 10%, generates the same so that the sustain period may be 7 μs in the case of the lighting rate being 10 to 50%, and generates the same so that the sustain period may be 6 μs in the case of the lighting rate being 80 to 100%. This makes it possible to ensure the sufficient recovery time with the period of drive pulses set longer in the case of a smaller lighting rate.

In this embodiment, as described above, the lighting rate for each subfield is detected, and the recovery time and the sustain period of sustain pulses are set longer as the detected lighting rate for each subfield becomes smaller. Accordingly, stable discharge can be carried out with the recovery time set shorter in the case of a larger lighting rate, while the reactive power can be reduced with the recovery time set longer in the case of a smaller lighting rate. Consequently, even though the lighting rate is variable, the stable discharge can be carried out with the decreased reactive power and the decreased power consumption.

Furthermore, the plasma display device in this embodiment can be realized with a simple circuit configuration.

While both the recovery time and the sustain period are varied depending on the lighting rate in this embodiment, only the recovery time may be varied.

Figure 11:
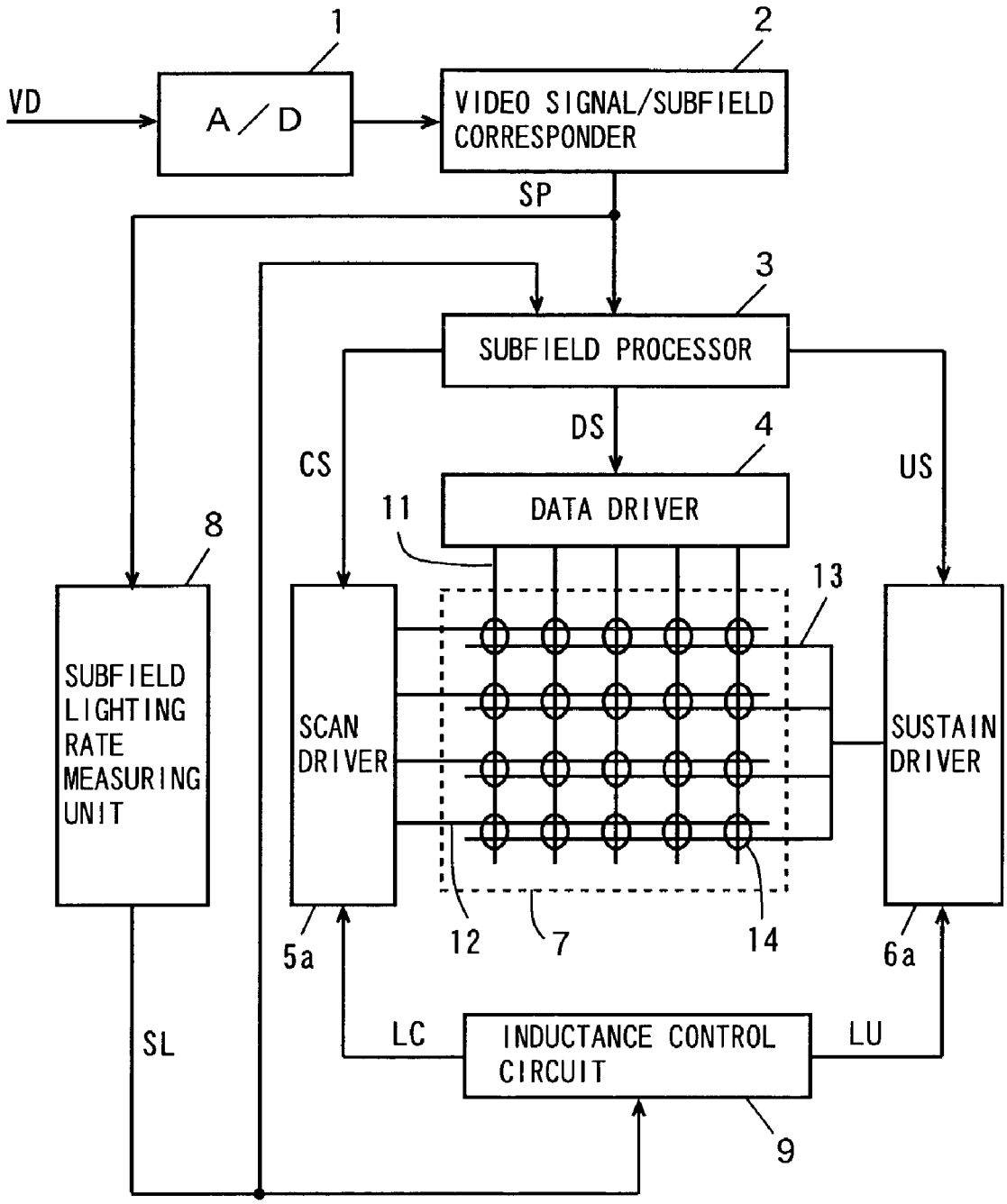
FIG. 11 is a block diagram showing the structure of a plasma display device according to a second embodiment of the present invention.

Description will now be made on a plasma display device according to a second embodiment of the present invention. FIG. 11 is a block diagram showing the structure of the plasma display device according to the second embodiment of the present invention.

The plasma display device of FIG. 11 differs from that of FIG. 1 in that an inductance control circuit 9 is added that varies an inductance value of a scan driver 5*a* and that of a sustain driver 6*a* depending on the lighting rate for each subfield. Since the plasma display device of FIG. 11 is the same as that of FIG. 1 with respect to the remaining parts, identical parts are denoted with identical symbols, and only the control of the resonance time depending on the lighting rate will be described in detail as a different part. Like the first embodiment, the recovery time and the sustain period are controlled depending on the lighting rate also in this embodiment.

The inductance control circuit 9 shown in FIG. 11 receives a subfield lighting rate signal SL output from a subfield lighting rate measuring unit 8 to output to the scan driver 5*a* and the sustain driver 6*a*, respectively, inductance control signals LC and LU for controlling the inductance value that contributes to the LC resonance depending on the lighting rate for each subfield.

Figure 12:
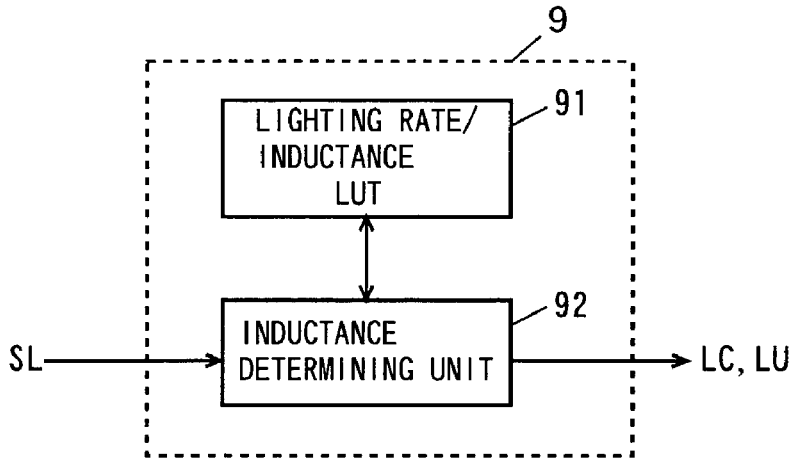
FIG. 12 is a block diagram showing the structure of an inductance control circuit shown in FIG. 11.

FIG. 12 is a block diagram showing the structure of the inductance control circuit 9 shown in FIG. 11. The inductance control circuit 9 of FIG. 12 includes a lighting rate/inductance LUT 91 and an inductance determining unit 92.

The lighting rate/inductance LUT 91 is connected to the inductance determining unit 92 and stores in a table format the relationship between the lighting rate and the inductance value contributing to the LC resonance based on experimental data. For example, 1800 nH is stored as the inductance value with respect to the lighting rate of 0 to 50%, 1300 nH as the inductance value with respect to the lighting rate of 50 to 80%, 520 nH as the inductance value with respect to the lighting rate of 80 to 90%, and 360 nH as the inductance value with respect to the lighting rate of 90 to 100%.

The inductance determining unit 92 reads a corresponding inductance value from the lighting rate/inductance LUT 91 in response to the subfield lighting rate signal SL output from the subfield lighting rate measuring unit 8, so as to output to the scan driver 5*a* and the sustain driver 6*a*, respectively, the inductance control signals LC and LU for setting the inductance values that contribute to the LC resonance of the scan driver 5*a* and the sustain driver 6*a* at the read inductance value. Determination of the inductance value is not particularly limited to the above example that the relationship between the lighting rate and the inductance value based on experimental data is stored in a table format, but the inductance value corresponding to the lighting rate may be evaluated by an approximate expression representing the relationship between the lighting rate and the inductance value.

In accordance with the above described structure, the inductance control circuit 9 controls the inductance values contributing to the LC resonance of the scan driver 5*a* and the sustain driver 6*a* depending on the lighting rate measured by the subfield lighting rate measuring unit 8.

Figure 13:
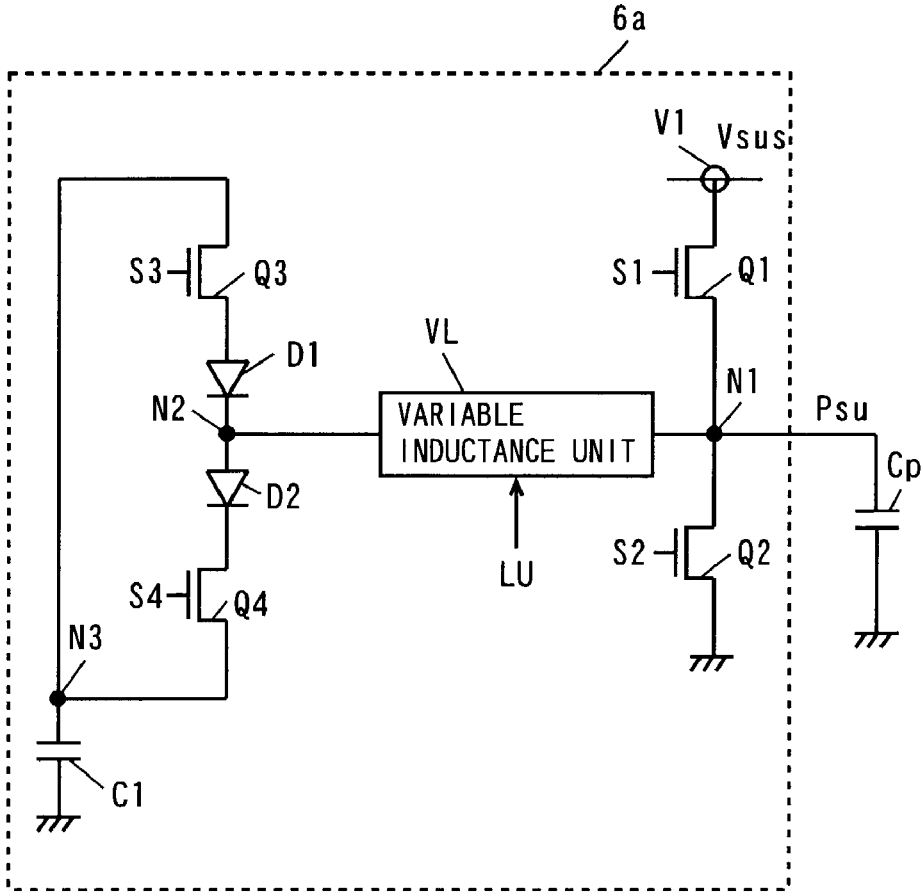
FIG. 13 is a circuit diagram showing the structure of a sustain driver shown in FIG. 11.

FIG. 13 is circuit diagram showing the structure of the sustain driver shown in FIG. 11. Since the scan driver 5*a* in this embodiment is also configured and operates similarly to the sustain driver 6*a*, a detailed description as to the scan driver 5*a* will not be given. Only the sustain driver 6*a* will now be described in detail.

The sustain driver 6*a* of FIG. 13 differs from the sustain driver 6 of FIG. 3 in that the recovery coil L is replaced with a variable inductance unit VL that varies the inductance value on the basis of the inductance control signal LU. Since the remaining parts are the same as those in the sustain driver 6 shown in FIG. 3, the identical parts are denoted with the identical symbols, and only the different parts will now be describe in detail.

The variable inductance unit VL of FIG. 13 is connected between nodes N2 and N1 and varies the inductance value on the basis of the inductance control signal LU output from the inductance control circuit 9.

Figures 14, 15:
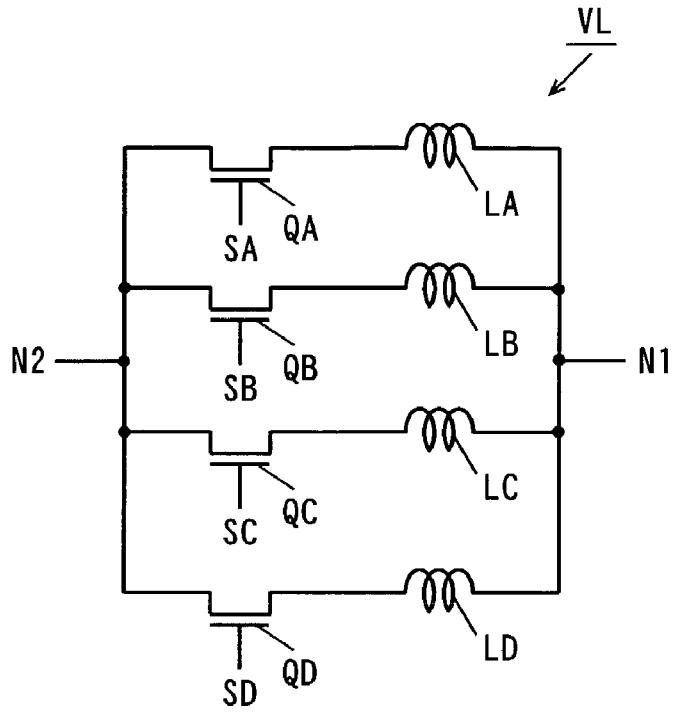
FIG. 14 is a circuit diagram showing the structure of one example of a variable inductance unit shown in FIG. 13.
FIG. 15 is a schematic diagram showing the on/off states of respective transistors in the variable inductance unit shown in FIG. 14 and driving waveforms obtained at the time sustain pulses rise corresponding to respective states.

FIG. 14 is a circuit diagram showing an example of the variable inductance unit VL shown in FIG. 13. The variable inductance unit VL of FIG. 14 includes recovery coils LA to LD and transistors QA to QD.

The recovery coil LA and the transistor QA are connected in series between the nodes N1 and N2, and the recovery coils LB to LD and the transistor QB to QD are likewise connected in series, respectively, between the nodes N1 and N2. The transistors QA to QD have their gates provided with inductance control signals SA to SD, respectively. The inductance control signals SA to SD are signals output as the inductance control signal LU from the inductance determining unit 92 shown in FIG. 12.

In this embodiment, the transistors Q3, Q4, the recovery capacitor Cr, the variable inductance unit VL and the diodes D1 and D2 correspond to recovery means; the subfield processor 3 and the inductance control circuit 9 correspond to control means; the variable inductance unit VL corresponds to inductance means and variable inductance means; the recovery coils LA to LD correspond to inductance elements; and the transistors QA to QD correspond to selection means. The other parts are the same as those in the first embodiment.

FIG. 15 is a schematic diagram showing the on/off states of the transistors QA to QD in the variable inductance unit VL of FIG. 14 and drive waveforms provided at the time when sustain pulses Psu rise corresponding to the respective states.

With reference to FIG. 15, in the case where the lighting rate is from 90 to 100%, if inductance control signals SA to SD are output at a high level from the inductance determining unit 92 to turn the transistors QA to QD on, then the recovery coils LA to LD are connected in parallel between the nodes N2 and N1. Accordingly, a composite inductance value of the variable inductance unit VL becomes a minimum value, e.g., 360 nH, and the resonance time is 600 ns. As a result, the drive waveform provided at the time when the sustain pulses Psu rise becomes such a drive waveform as to have a lower peak voltage Vp and a shorter recovery time.

Next, in the case where the lighting rate is from 80 to 90%, if the inductance control signals SA to SC are output at a high level from the inductance determining unit 92, while the inductance control signal SD is output at a low level therefrom to turn the transistors QA to QC on and the transistor QD off, then the recovery coils LA to LC are connected in parallel between the nodes N2 and N1. Accordingly, the composite inductance value of the variable inductance unit VL becomes a larger value, e.g., 680 nH, and the resonance time is 800 ns. As a result, the drive waveform provided at the time when the sustain pulses Psu rise has a higher peak voltage Vp and a longer recovery time.

In the case where the lighting rate is from 50 to 80%, if the inductance control signals SA and SB are output at a high level from the inductance determining unit 92, while the inductance control signals SC and SD are output at a low level therefrom to turn the transistors QA and QB on and the transistors QC and QD off, then the recovery coils LA and LB are connected in parallel between the nodes N2 and N1. Accordingly, the composite inductance value of the variable inductance unit VL becomes a still larger value, e.g., 1300 nH, and the resonance time is 1100 ns. As a result, the drive waveform of the sustain pulses Psu has a still higher peak voltage Vp and a still longer recovery time.

Finally, in the case where the lighting rate is from 0to 50%, if the inductance control signal SA is output at a high level from the inductance determining unit 92, while the inductance control signals SB to SD are output at a low level therefrom to turn the transistor QA on and the transistors QB to QD off, then only the recovery coil LA is connected between the nodes N2 and N1. Accordingly, the inductance value of the variable inductance unit VL becomes the inductance value of the recovery coil LA, that is, a maximum inductance value, e.g., 1800 nH, and the resonance time is 1300 ns. As a result, the drive waveform of the sustain pulses Psu has a maximum peak voltage and the longest recovery time.

Figure 16:
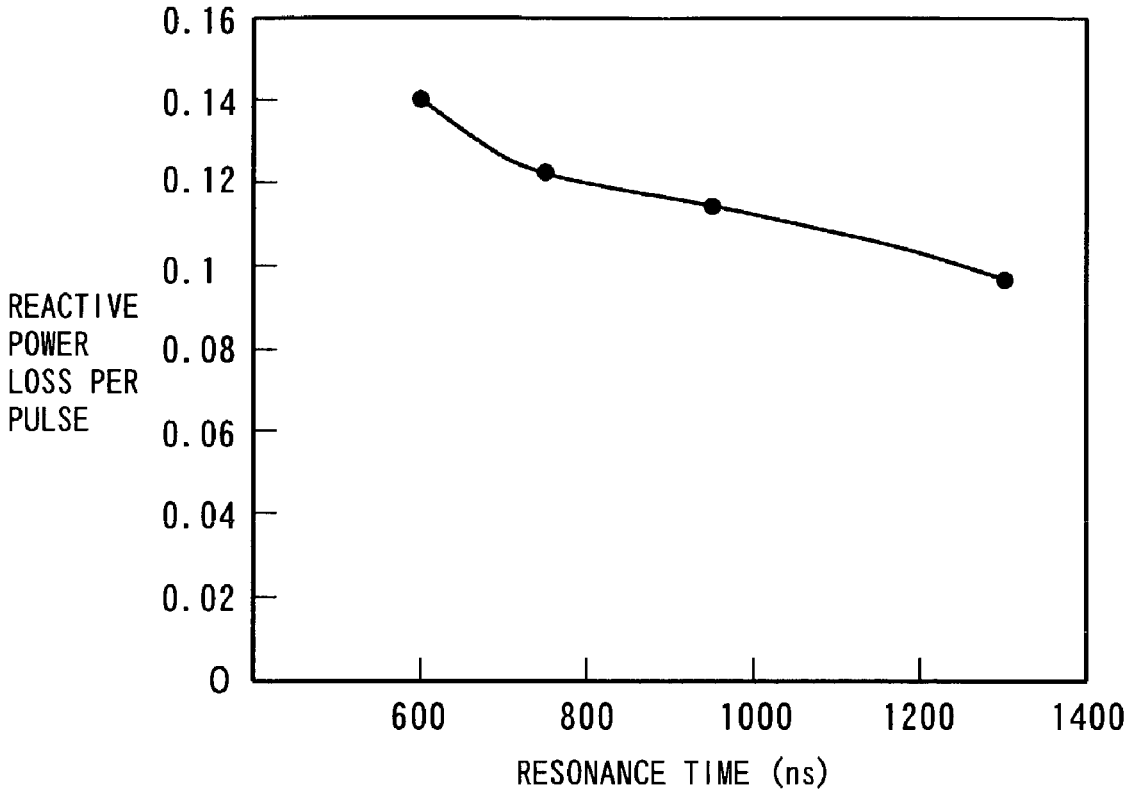
FIG. 16 is a diagram showing one example of the relationship between a resonance time and a reactive power loss.

FIG. 16 is a diagram showing an example of the relationship between the resonance time and the loss of reactive power. It is understood as shown in FIG. 16 that the reactive power loss per pulse becomes decreased as the resonance time becomes increased. Therefore, the reactive power loss per pulse can be decreased by the increase of the inductance value contributing to the LC resonance.

This is because as the inductance value becomes increased, a recovery efficiency $\eta$ (=Vp/Vsus×100 (%)) becomes increased, and when the sustain voltage Vsus of the sustain pulses is constant, the peak voltage Vp in the recovery time is increased, enabling decreased reactive power.

In this embodiment like the first embodiment, as described above, the recovery time and the sustain period are controlled depending on the lighting rate for each subfield, and also, the inductance value of the variable inductance unit VL and the resonance time are increased as the lighting rate for each subfield becomes decreased. Therefore, since it is possible to set the inductance value larger and the resonance time longer in the case of a lower lighting rate, the reactive power can be more decreased with the improved recovery efficiency.

Figure 17:
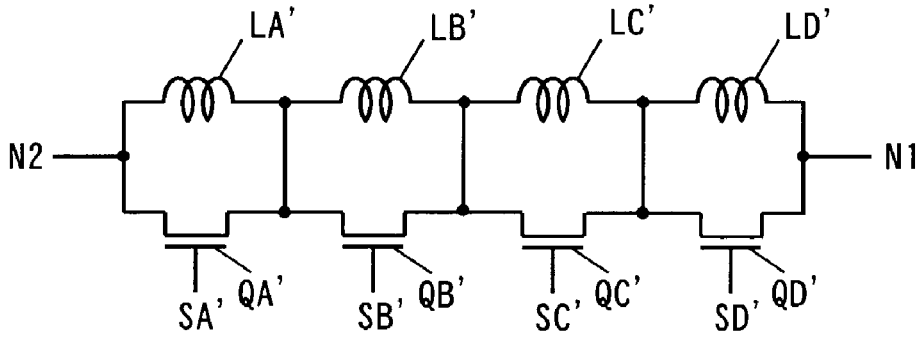
FIG. 17 is a circuit diagram showing the structure of another example of the variable inductance unit shown in FIG. 13.

FIG. 17 is a circuit diagram showing the structure of another example of the variable inductance unit LU shown in FIG. 13.

The variable inductance unit of FIG. 17 includes recovery coils LA' to LD' and transistors QA' to QD'.

The recovery coil LA' and the transistor QA' are connected in parallel. Likewise, the recovery coils LB' to LD' are connected in parallel to the transistors QB' to QD', respectively. Those recovery coils LA' to LD' and transistors QA' to QD' connected in parallel are connected in series between nodes N2 and N1. The transistors QA' to QD' have their respective gates provided with inductance control signals SA' to SD', respectively. The inductance control signals SA' to SD' are signals output as the inductance control signal LU from the inductance determining unit 92 shown in FIG. 12.

FIG. 18 is a schematic diagram showing the on/off states of the transistors QA' to QD' in the variable inductance unit of FIG. 17 and drive waveforms provided at the time when sustain pulses Psu rise corresponding to the respective states.

With reference to FIG. 18, in the case where the lighting rate is from 90 to 100%, if the inductance control signals SA' to SC' are output at a high level from the inductance determining unit 92, while the inductance control signal SD' is output at a low level therefrom to turn the transistors QA' to QC' on and the transistor QD' off, then the recovery coil LD' is connected between the nodes N2 and N1. Accordingly, the composite inductance value of the variable inductance unit becomes the inductance value of the recovery coil LD', that is, a minimum inductance value, e.g., 360 nH, and the resonance time is 600 ns. As a result, the waveform provided at the time the sustain pulses Psu rise has a lower peak voltage Vp and a shorter recovery time.

In the case where the lighting rate is from 80 to 90%, if the inductance control signals SA' and SB' are output at a high level from the inductance determining unit 92, while the inductance control signals SC' and SD' are output at a low level therefrom to turn the transistors QA' and QB' on and the transistors QC' and QD' off, then the recovery coils LC' and LD' are connected in series between the nodes N2 and N1. Accordingly, the composite inductance value of the variable inductance unit becomes a sum of the respective inductance values of the recovery coils LC' and LD', that is, a larger inductance value, e.g., 680 nH, and the resonance time is 800 ns. As a result, the drive waveform provided when the sustain pulses Psu rise has a higher peak voltage Vp and a longer recovery time.

In the case where the lighting rate is from 50 to 80%, the inductance control signal SA' is output at a high level from the inductance determining unit 92, while the inductance control signals SB' to SD' are output at a low level therefrom to turn the transistor QA' on and the transistors QB' to QD' off, then the recovery coils LB' to LD' are connected in series between the nodes N2 and N1. Accordingly, the composite inductance value of the variable inductance unit becomes a sum of the respective inductance values of recovery coils LB' to LD', that is, a still larger inductance value, e.g., 1300 nH, and the resonance time is 1100 ns. As a result, the drive waveform of the sustain pulses Psu has a still higher peak voltage Vp and a still longer recovery time.

Finally, in the case where the lighting rate is from 0 to 50%, if the inductance control signals SA' to SD' are output at a low level from the inductance determining unit 92 to turn the transistors QA' to QD' off, then the recovery coils LA' to LD' are connected in series between the nodes N2 and N1. Accordingly, the composite inductance value of the variable inductance becomes a sum of the respective inductance values of the recovery coils LA' to LD', that is, a maximum inductance value, e.g., 1800 nH, and the resonance time is 1300 ns. Consequently, the drive waveform of the sustain pulses Psu has a maximum peak voltage Vp and the longest recovery time.

It is possible to obtain the same effect in the variable inductance unit of FIG. 17 as in the variable inductance unit VL of FIG. 14 as described above.

The number of recovery coils and transistors to be connected is not particularly limited to the above-described 4, but may be altered to various numbers. As for the variable inductance unit, its structure is not particularly limited to each of the aforementioned examples, but another structure that an inductance value is variable on the basis of inductance control signals is also applicable.

While the recovery time, the resonance time and the sustain period are varied together depending on the lighting rate in this embodiment, only the resonance time may be varied.

Figure 19:
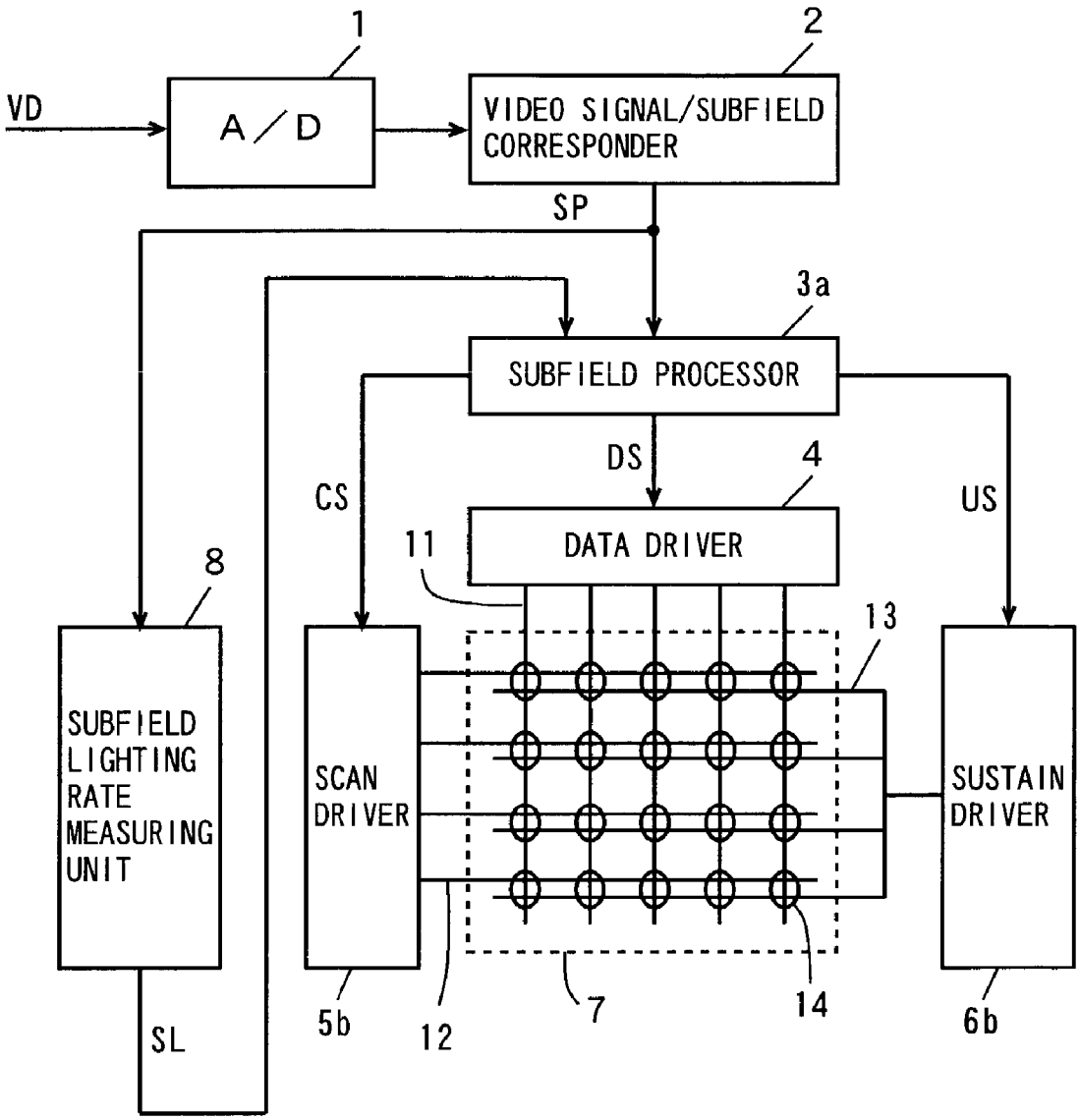
FIG. 19 is a block diagram showing the structure of a plasma display device according to a third embodiment of the present invention.

Description will now be made on a plasma display device according to a third embodiment of the present invention. FIG. 19 is a block diagram showing the structure of the plasma display device according to the third embodiment of the present invention.

The plasma display device of FIG. 19 differs from that of FIG. 1 in that the subfield processor 3 is replaced by a subfield processor 3*a* that controls a scan driver 5*b* and a sustain driver 6*b* so that the resonance time, the discharge recovery time and the sustain period are varied depending on the lighting rate. Since the plasma display device of FIG. 19 is the same as that of FIG. 1 in the respect of the other parts, the identical parts are denoted with the identical characters, and only the different parts will now be described in detail.

In addition to the operation of the subfield processor 3 shown in FIG. 1, the subfield processor 3*a* of FIG. 19 produces a scan driver driving control signal CS and a sustain driver driving control signal US for varying the resonance time, the discharge recovery time and the sustain period in response to a subfield lighting rate signal SL, so as to output the produced signals CS and US to the scan driver 5*b* and the sustain driver 6*b*, respectively.

The scan driver 5*b* and the sustain driver 6*b* operate in response to the scan driver driving control signal CS and the sustain driver driving control signal US, respectively, to vary the resonance time, the discharge recovery time and the sustain period of sustain pulses depending on the lighting rate and output the results to scan electrodes 12 and sustain electrodes 13 of a PDP 7.

Figure 20:
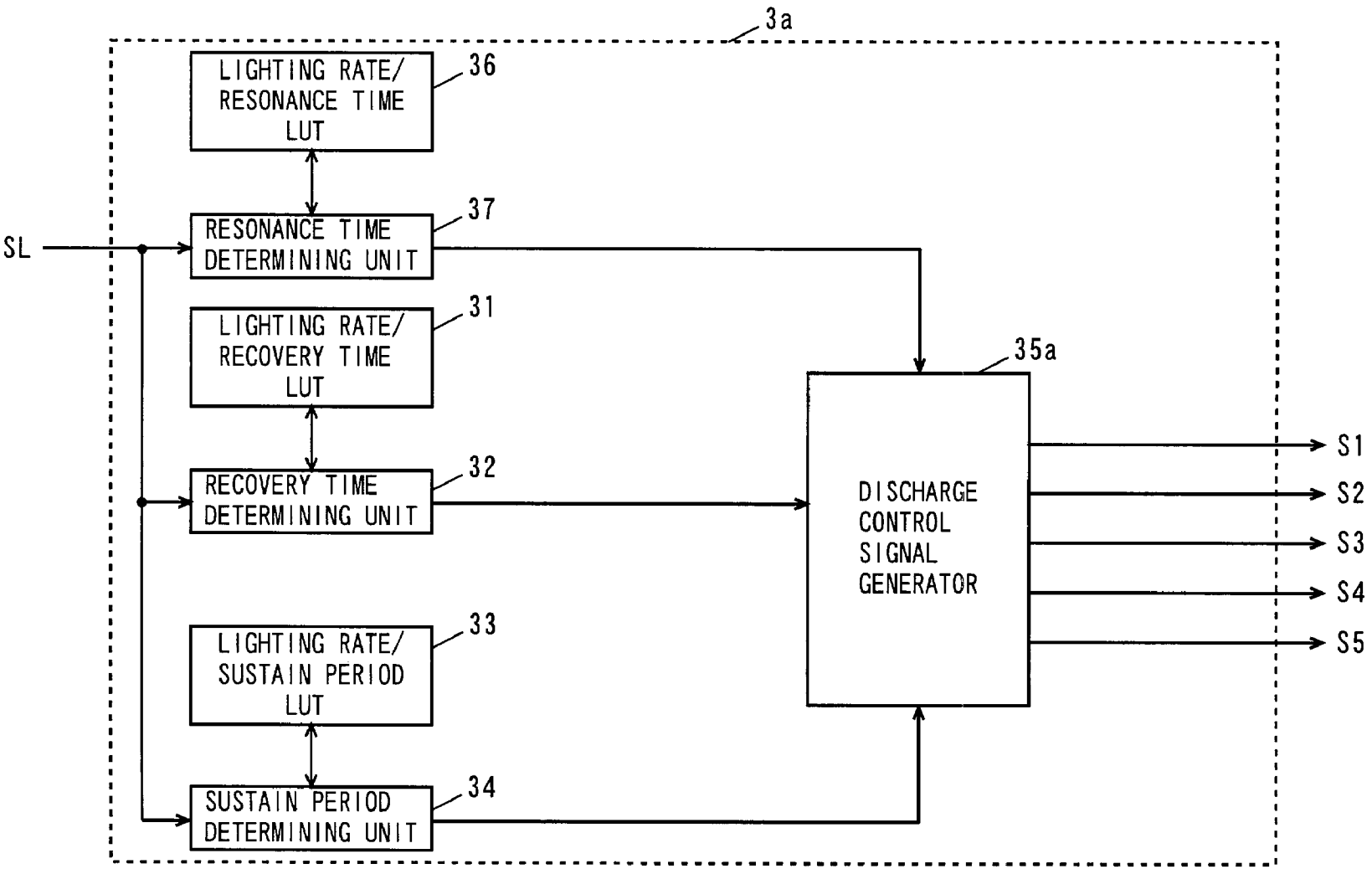
FIG. 20 is a block diagram showing the structure of a subfield processor shown in FIG. 19.

FIG. 20 is a block diagram showing the structure of the subfield processor 3*a* shown in FIG. 19. The subfield processor 3*a* of FIG. 20 is different from the subfield processor 3 of FIG. 4 in that a lighting rate/resonance time LUT 36 and a resonance time determining unit 37 are added, and a discharge control signal generator 35*a* substitues for the discharge control signal generator 35. Since the processor 3*a* is the same as the processor 3 of FIG. 4 in the respect of the other parts, the identical parts are denoted with the identical characters, and a detailed description thereof will not be given.

The lighting rate/resonance time LUT 36 shown in FIG. 20 is connected to the resonance time determining unit 37 and stores in a table format the relationship between the lighting rate and the resonance time based on experimental data. As shown in Table 1, for example, 1300 ns is stored as the resonance time with respect to the lighting rate of from 0 to 10%, 1200 ns as the resonance time with respect to the lighting rate of from 10 to 20%, 1100 ns as the resonance time with respect to the lighting rate of from 20 to 30%, 1000 ns as the resonance time with respect to the lighting rate of from 30 to 40%, 850 ns as the resonance time with respect to the lighting rate of from 40 to 50%, 800 ns as the resonance time with respect to the lighting rate of from 50 to 60%, 750 ns as the resonance time with respect to the lighting rate of from 60 to 70%, 700 ns as the resonance time with respect to the lighting rate of from 70 to 80%, and 600 ns as the resonance time with respect to the lighting rate of from 80 to 100%.

[Table 1]

| Lighting Rate(%) | Recovery Time(ns) | Resonance Time(ns) | Sustain Period(μ s) |
|---|---|---|---|
| 0 | 1100 | 1300 | 8 |
| 10 | 1000 | 1200 | 8 |
| 20 | 900 | 1100 | 7 |
| 30 | 800 | 1000 | 7 |
| 40 | 700 | 850 | 6 |
| 50 | 650 | 800 | 6 |
| 60 | 600 | 750 | 6 |
| 70 | 550 | 700 | 6 |
| 80 | 500 | 600 | 5 |
| 90 | 500 | 600 | 5 |
| 100 | 500 | 600 | 5 |

The resonance time determining unit 37 is connected to the discharge control signal generator 35*a* and reads a corresponding resonance time from the lighting rate/resonance time LUT 36 in response to the subfield lighting rate signal SL output from the subfield lighting rate measuring unit 8, so as to output the read resonance time to the discharge control signal generator 35. Determination of the resonance time is not particularly limited to the above example that the relationship between the lighting rate and the resonance time based on the experimental data is stored in the table format, but the resonance time corresponding to the lighting rate may be evaluated by an approximate expression representing the relationship between the lighting rate and the resonance time.

In this embodiment, as shown in Table 1, for example, the lighting rate/recovery time LUT 31 stores 1100 ns as the discharge recovery time with respect to the lighting rate of from 0 to 10%, 1000 ns as the discharge recovery time with respect to the lighting rate of from 10 to 20%, 900 ns as the discharge recovery time with respect to the lighting rate of from 20 to 30%, 800 ns as the discharge recovery time with respect to the lighting rate of from 30 to 40%, 700 ns as the discharge recovery time with respect to the lighting rate of from 40 to 50%, 650 ns as the discharge recovery time with respect to the lighting rate of from 50 to 60%, 600 ns as the discharge recovery time with respect to the lighting rate of from 60 to 70%, 550 ns as the discharge recovery time with respect to the lighting rate of from 70 to 80%, and 500 ns with respect to the lighting rate of from 80 to 100%.

As described above, the recovery time and the resonance time are set such that a difference between the recovery time and the resonance time becomes increased as the lighting rate becomes decreased.

Each discharge recovery time as above is set shorter than each resonance time in order to enhance the stability of discharge. Further, in this embodiment, the non-discharge recovery time is fixed to 1300 ns in order to reduce reactive power irrespective of the lighting rate.

The lighting rate/sustain period LUT 33 stores, for example, 8 μs as the sustain period with respect to the lighting rate of from 0 to 20%, 7 μs as the sustain period with respect to the lighting rate of from 20 to 40%, 6 μs as the sustain period with respect to the lighting rate of from 40 to 80%, and 5 μs as the sustain period with respect to the lighting rate of from 80 to 100%.

The discharge control signal generator 35*a* outputs control signals S1 to S5 as the sustain driver driving control signal US so that the sustain driver 6*b* outputs sustain pulses in the resonance time determined by the resonance time determining unit 37, the discharge recovery time determined by the recovery time determining unit 32 and the sustain period determined by the sustain period determining unit 34.

Likewise, the scan driver 5*b* is also controlled by the subfield processor 3*a*, and the waveform and the period of the sustain pulses to be applied to the scan electrodes 12 are likewise controlled depending on the lighting rate for each subfield.

Figure 21:
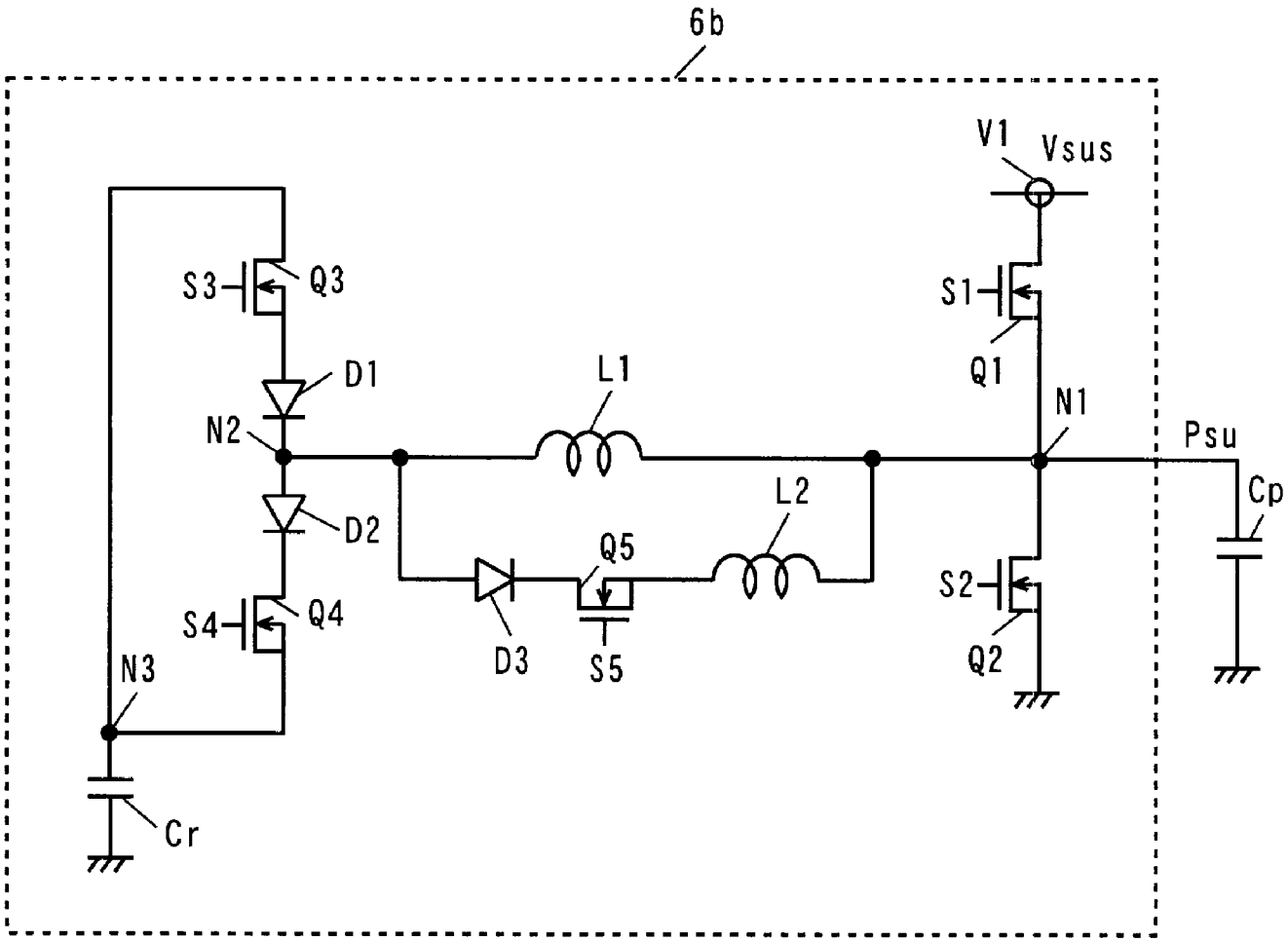
FIG. 21 is a circuit diagram showing the structure of a sustain driver shown in FIG. 19.

FIG. 21 is a circuit diagram showing the structure of the sustain driver 6*b* of FIG. 19. Since the scan driver 5*b* in this embodiment is also structured and operative like the sustain driver 6*b*, a detailed description as to the scan driver 5*b* will not be given, and only the sustain driver 6*b* will be described in detail.

The sustain driver 6*b* of FIG. 21 is different from the sustain driver 6 of FIG. 3 in that a recovery coil L1 is connected in parallel to a diode D3, a transistor Q5 and a recovery coil L2 connected in series between nodes N2 and N1. Since the sustain driver 6*b* of FIG. 21 is the same as the sustain driver 6 of FIG. 3 in the respect of the other parts, the identical parts are denoted with the identical characters, and a detailed description of the other parts will not be given.

In the sustain driver 6*b* shown in FIG. 21, the recovery coil L1 is connected between the nodes N2 and N1. The inductance value of the recovery coil L1 is, e.g., 1800 nH. The diode D3, the transistor Q5 and the recovery coil L2 are connected in series between the nodes N2 and N1. The inductance value of the recovery coil L2 is, e.g., 450 nH.

Accordingly, if a transistor Q3 is turned on and the transistor Q5 is turned off at the time sustain pulses Psu rise, i.e., in the discharge recovery time, then only the recovery coil L1 contributes to the LC resonance, and an inductance value contributing to the LC resonance becomes 1800 nH, which is the inductance value of the recovery coil L1.

On the other hand, if the transistor Q5 is turned on after a delay of a predetermined time after turning on of the transistor Q3 in the discharge recovery time, then the recovery coils L1 and L2 contribute to the LC resonance. An inductance value contributing to such LC resonance at this time becomes 360 nH, which is a composite inductance value of the recovery coils L1 and L2.

Figure 22:
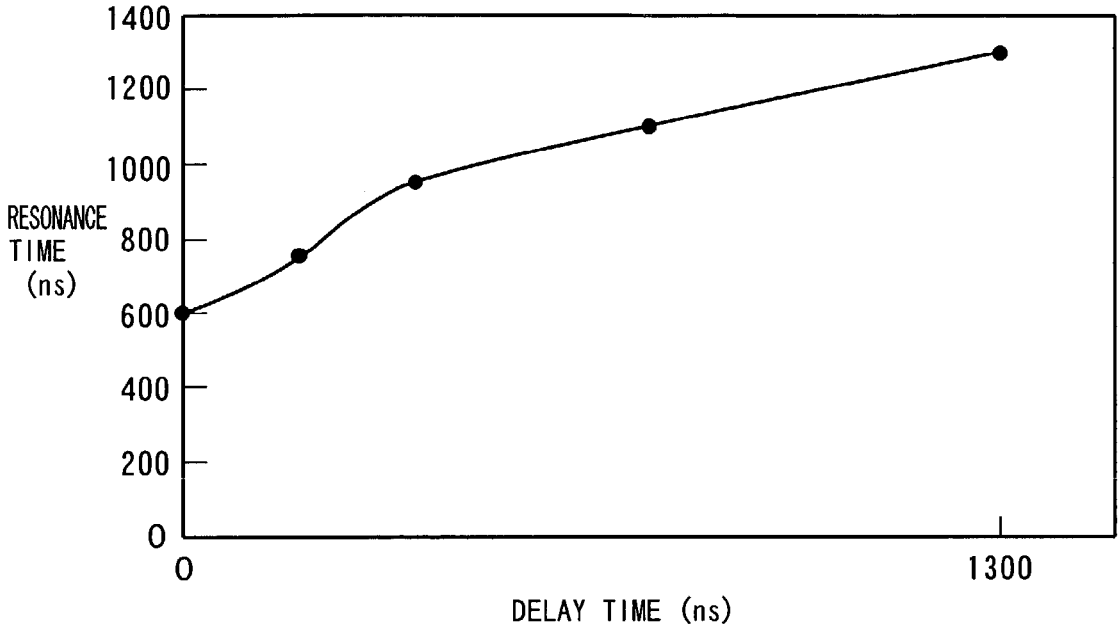
FIG. 22 is a diagram showing one example of the relationship between a resonance time attributed to two recovery coils and a delay time.

FIG. 22 is a diagram showing an example of the relationship between the resonance time and the delay time caused by the recovery coils L1 and L2. As shown in FIG. 22, in the case where the delay time is 0 ns, i.e., the transistors Q3 and Q5 are turned on at the same time, the inductance value contributing to the LC resonance is 360 nH, which is the composite inductance value of the recovery coils L1 and L2, and the resonance time is 600 ns.

Here, as the delay time becomes increased, the proportion of 1800 nH, which is the inductance value of the recovery coil L1 becomes increased, and the inductance value contributing to the LC resonance becomes increased. Thus, the resonance time becomes also increased, and finally, the inductance value contributing to the LC resonance becomes 1800 nH, which is the inductance value of the recovery coil L1, and the resonance time is 1300 ns. Accordingly, adjustment of the delay time enables the inductance value contributing to the LC resonance to be set to a predetermined value in the range of from 360to 1800 nH, and enables the resonance time to be set to a desired time from 600 to 1300 ns.

At the time when sustain pulses Psu fall, i.e., in the non-discharge recovery time, since currents are limited by the diode 3, only the recovery coil L1 contributes to the LC resonance, and the resonance time is fixed independently of the turning on/off of the transistor Q5.

In this embodiment, the transistors Q3 to Q5, the recovery capacitor Cr, the recovery coils L1 and L2, and the diodes D1 to D3 correspond to recovery means; the subfield processor 3*a* to control means; the diode D3, the transistor Q5 and the recovery coils L1 and L2 to inductance means and variable inductance means; the recovery capacitor Cr to a capacitive element; the recovery coil L1 to a first inductance element; the recovery coil L2 to a second inductance element; the diode D1 and the transistor Q3 to first switch means; and the diode D3 and the transistor Q5 to second switch means. The remaining parts are the same as those in the first embodiment.

FIGS. 23 to 26 are timing charts showing operations of the sustain driver 6*b* of FIG. 21 during the sustain time period. FIGS. 23 to 26 show the voltage on the node N1 of FIG. 21 and the control signals S1 to S5.

Figure 23:
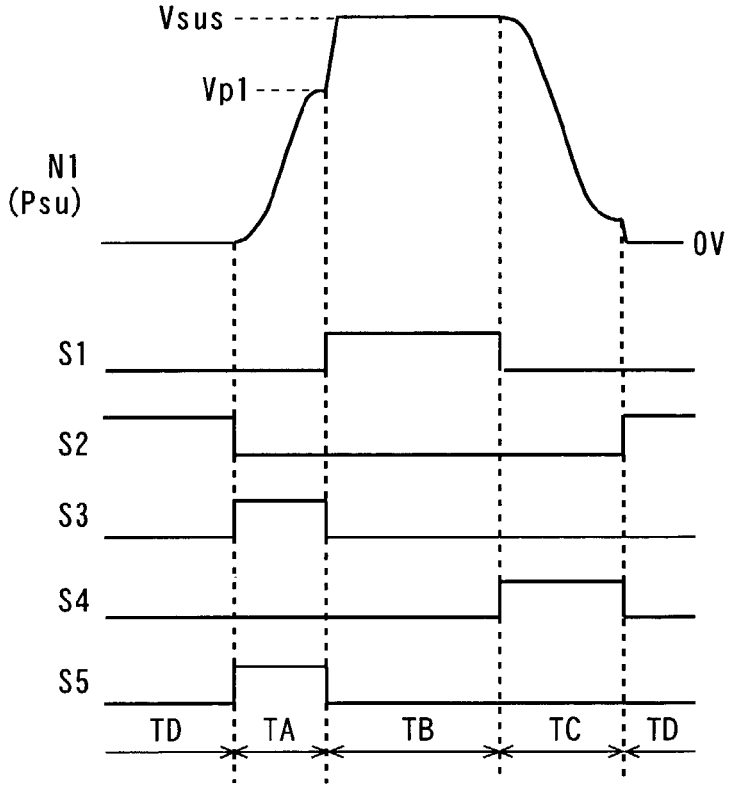
FIG. 23 is a first timing chart showing the operation of the sustain driver of FIG. 21 in a sustain time period.

As shown in FIG. 23, in the case of a higher lighting rate, e.g., the case where the lighting rate is from 80 to 100%; first of all, in a time period TA, the control signal S2 attains a low level to turn the transistor Q2 off, the control signal S3 attains a high level to turn the transistor Q3 on, the control signal S5 attains a high level to turn the transistor Q5 on, and the delay time is 0 ns. At this time, the control signals S1 and S4 attain a low level to turn the transistors Q1 and Q4 off.

Accordingly, the recovery capacitor Cr is connected to the recovery coil L1 through the transistor Q3 and the diode D1 and also to the recovery coil L2 through the diode 3 and the transistor Q5. Consequently, 360 nH, which is the composite inductance value of the recovery coils L1 and L2 contributes to the LC resonance, and the resonance time is 600 ns. The time period TA, which is the discharge recovery time at this time, is 500 ns, during which the voltage on the node N1 rises from a ground potential to a peak voltage Vp1.

At this time, if the voltage on the node N1 exceeds a discharge starting voltage, then the discharge cells 14 start discharge to carry out sustain discharge. Further, the charges in the recovery capacitor Cr are exerted to the panel capacitance Cp through the transistor Q3, the diode D1 and the recovery coil L1.

Then, in a time period TB, the control signal S1 attains a high level to turn the transistor Q1 on, and the control signals S3 and S5 attain a low level to turn the transistors Q3 and Q5 off. Accordingly, the node N1 is connected to the power supply terminal V1, so that the voltage on the node N1 rises sharply and is then fixed to a sustain voltage Vsus.

Next, in a time period TC, the control signal S1 attains a low level to turn the transistor Q1 off, and the control signal S4 attains a high level to turn the transistor Q4 on. Thus, the recovery capacitor Cr is connected to the recovery coil L1 through the diode 2 and the transistor Q4, so that the LC resonance caused by the recovery coil L1 and the panel capacitance Cp causes a gradual drop of the voltage on the node N1.

At this time, the charges stored in the panel capacitance Cp are stored in the recovery capacitor Cr through the recovery coil L1, the diode D2 and the transistor Q4 and are then recovered. In that case, only the recovery coil L1 contributes the LC resonance, so that the inductance value contributing to the LC resonance is 1800 nH, and the resonance time is 1300ns. The time period TC, which is the non-discharge recovery time at this time, is 1300 ns, that is, the non-discharge recovery time is coincident with the resonance time.

Then, in a time period TD, the control signal S2 attains a high level to turn the transistor Q2 on, and the control signal S4 attains a low level to turn the transistor Q4 off. Thus, the node N1 is connected to the ground terminal, so that the voltage on the node N1 falls and is fixed to the ground potential.

As described above, when the delay time is 0 ns, the inductance value contributing to the LC resonance is the composite inductance value of the recovery coils L1 and L2 over the entire discharge recovery time, thereby leading to a shorter resonance time and a shorter discharge recovery time.

Figure 24:
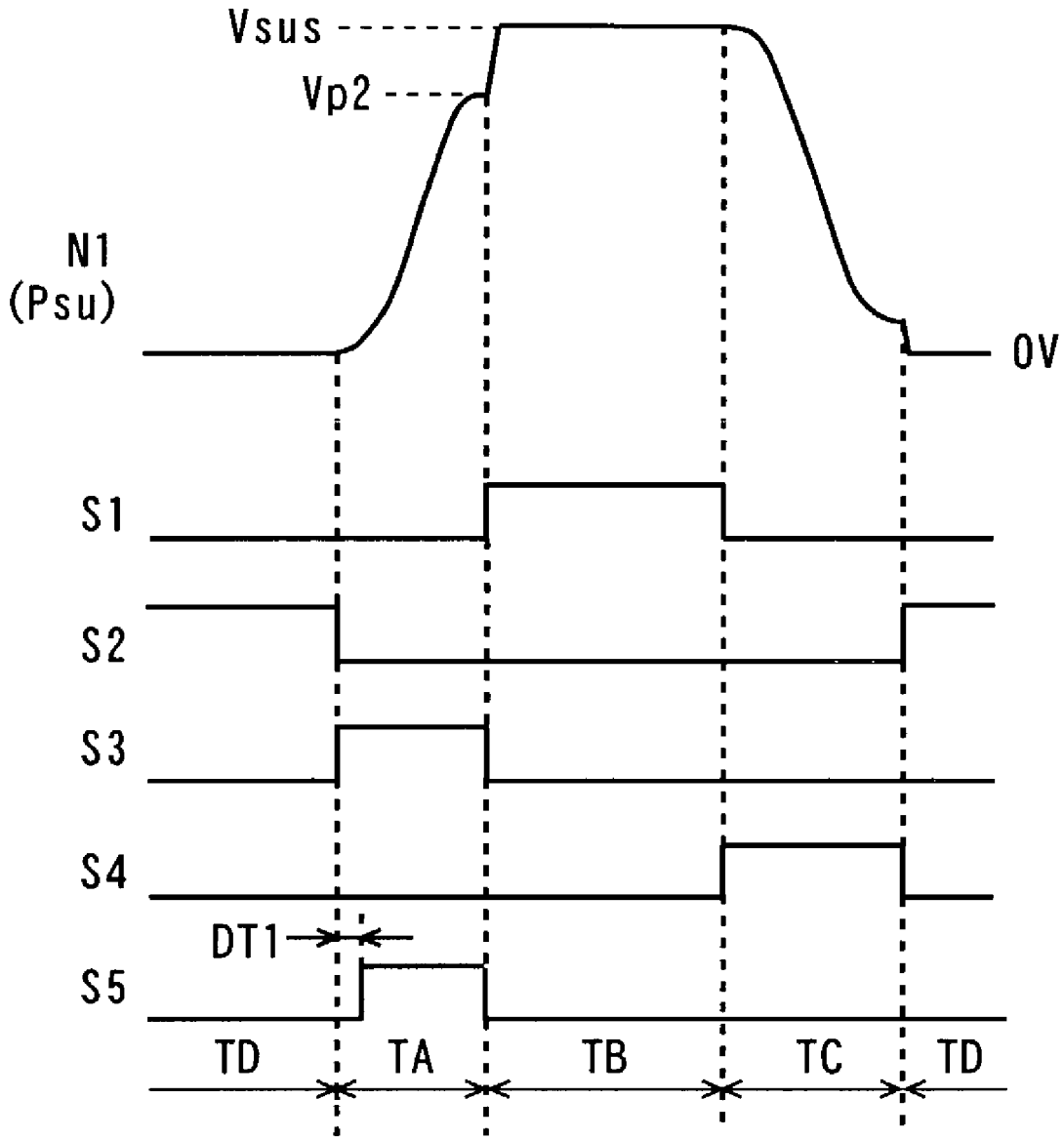
FIG. 24 is a second timing chart showing the operation of the sustain driver of FIG. 21 in the sustain time period.

Next, in the case of a smaller lighting rate, as shown in FIG. 24, the delay time of the control signal S5 is set. During the time period TA, the control signal S3 attains a high level to turn the transistor Q3 on, and after that, the control signal S5 attains a high level after delayed by a delay time DT1, so that the transistor Q5 is turned on.

Thus, during the delay time DT1, the transistor Q3 is turned on, so that the recovery coil L1 contributes to the LC resonance, whereas the transistor Q5 is off, so that the recovery coil L2 does not contribute to the LC resonance. During a subsequent time period after the delay time DT1 in the time period TA, both the transistors Q3 and Q5 are turned on, so that both the recovery coils L1 and L2 contribute to the LC resonance. This results in a larger inductance value contributing to the LC resonance and a longer resonance time.

In the case where the lighting rate is from 40 to 50%, for example, the resonance time is 800 ns, and a peak voltage Vp2 of the sustain pulses Psu becomes higher than the peak voltage Vp1. Also, the discharge recovery time is made as long as 700 ns, resulting in increased recovery efficiency and decreased reactive power.

Figure 25:
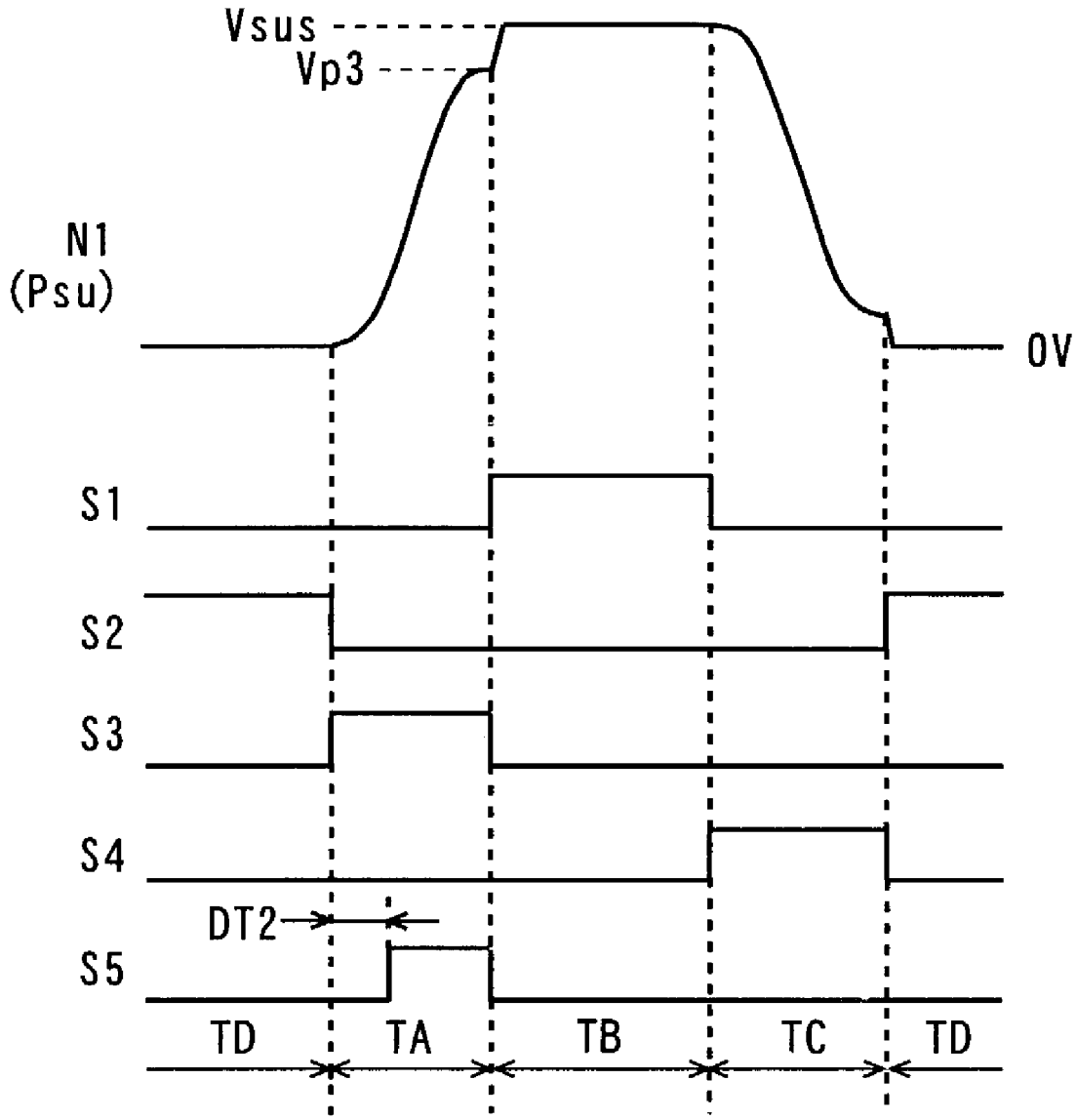
FIG. 25 is a third timing chart showing the operation of the sustain driver of FIG. 21 in the sustain time period.

In the case of a still lower lighting rate, as shown in FIG. 25, the delay time of the control signal S5 is made still longer. During the time period TA, after the control signal S3 attains a high level to turn the transistor Q3 on, the control signal S5 attains a high level after delayed by a delay time DT2, so that the transistor Q5 is turned on. Thus, the time period during which only the recovery coil L1 contributes to the LC resonance becomes longer, while the time period during which the recovery coils L1 and L2 both contribute to the LC resonance becomes shorter, resulting in a still larger inductance value contributing to the LC resonance and a still longer resonance time.

In the case where the lighting rate is from 20 to 30%, for example, the resonance time is 1100 ns, and a peak voltage Vp3 of the sustain pulses Psu becomes higher than the peak voltage Vp2. Also, the discharge recovery time is made as long as 900 ns, resulting in a more increased recovery efficiency and more decreased reactive power.

Figure 26:
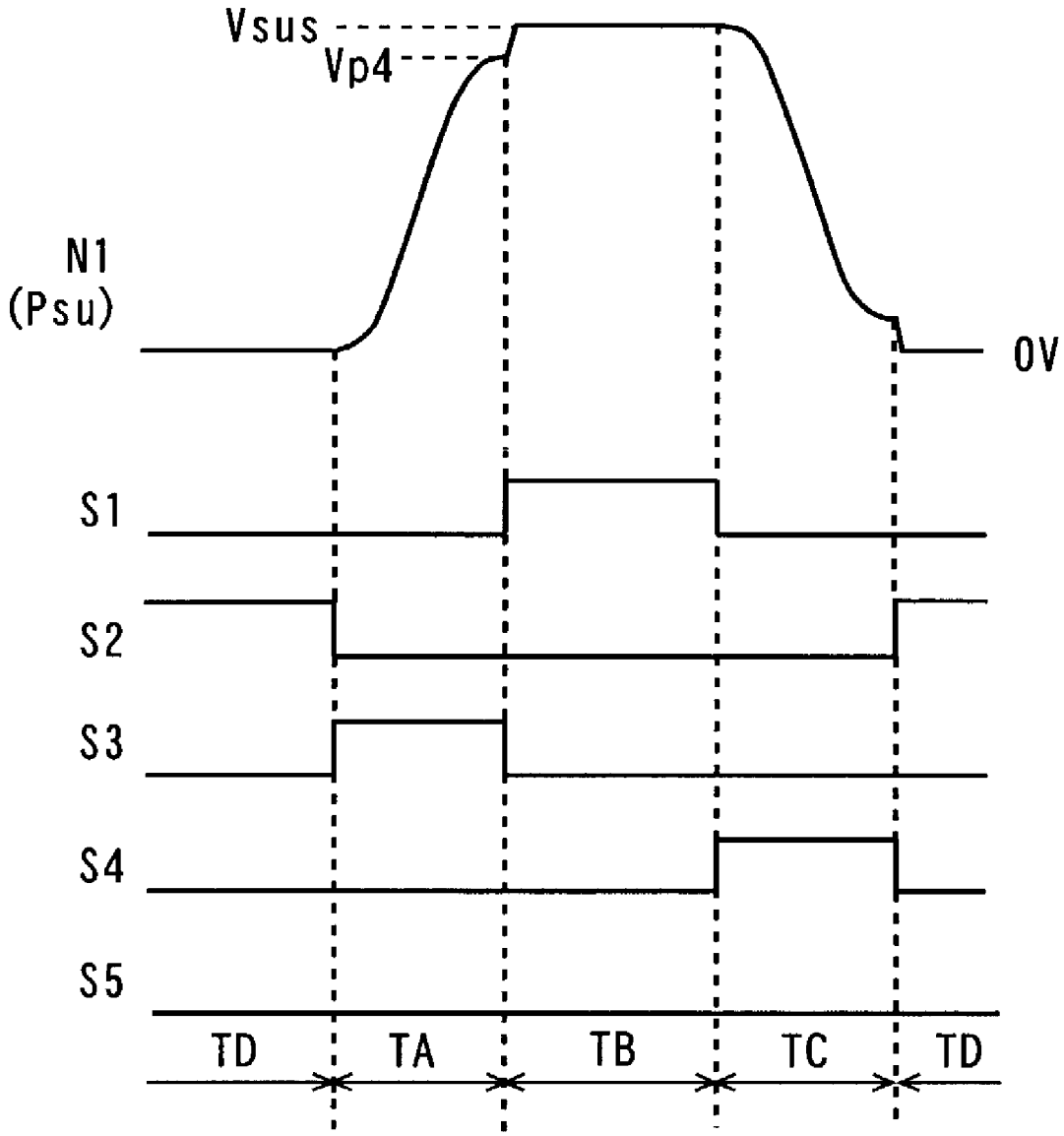
FIG. 26 is a fourth timing chart showing the operation of the sustain driver of FIG. 21 in the sustain time period.

In the case where the lighting rate is still lower from 0 to 10%, for example, as shown in FIG. 26, the control signal S5 is constantly at a low level, and the transistor Q5 is constantly off. Thus, only the recovery coil L1 contributes to the LC resonance, so that the inductance value contributing to the LC resonance becomes as large as 1800 nH, the resonance time becomes as long as 1300 ns, and the discharge recovery time is also made as long as 1300 ns. Consequently, a peak voltage Vp4 of the sustain pulses Psu is still higher than the peak voltage Vp3, leading to a more increased recovery efficiency and more decreased reactive power.

As described above, as the lighting rate becomes smaller, the time period TA, which is the discharge recovery time, is made longer, while the inductance value contributing to the LC resonance is made larger with the resonance time made longer. This makes it possible to sequentially vary the inductance value in the time period TA, which is the discharge recovery time, by using those two recovery coils L1 and L2, and to set the inductance value to an optimum inductance value depending on the lighting rate.

In this embodiment, like the second embodiment, since it is possible to control the resonance time, the discharge recovery time and the sustain period depending on the lighting rate for each subfield, as described above, it is possible to achieve the same effect as in the second embodiment as well as set the resonance time to various values by using such two recovery coils, thereby realizng a simple circuit configuration.

While the resonance time, the discharge recovery time and the sustain period are varied together depending on the lighting rate in this embodiment, only the discharge recovery time and the resonance time may be varied without variation of the sustain period.

Figure 27:
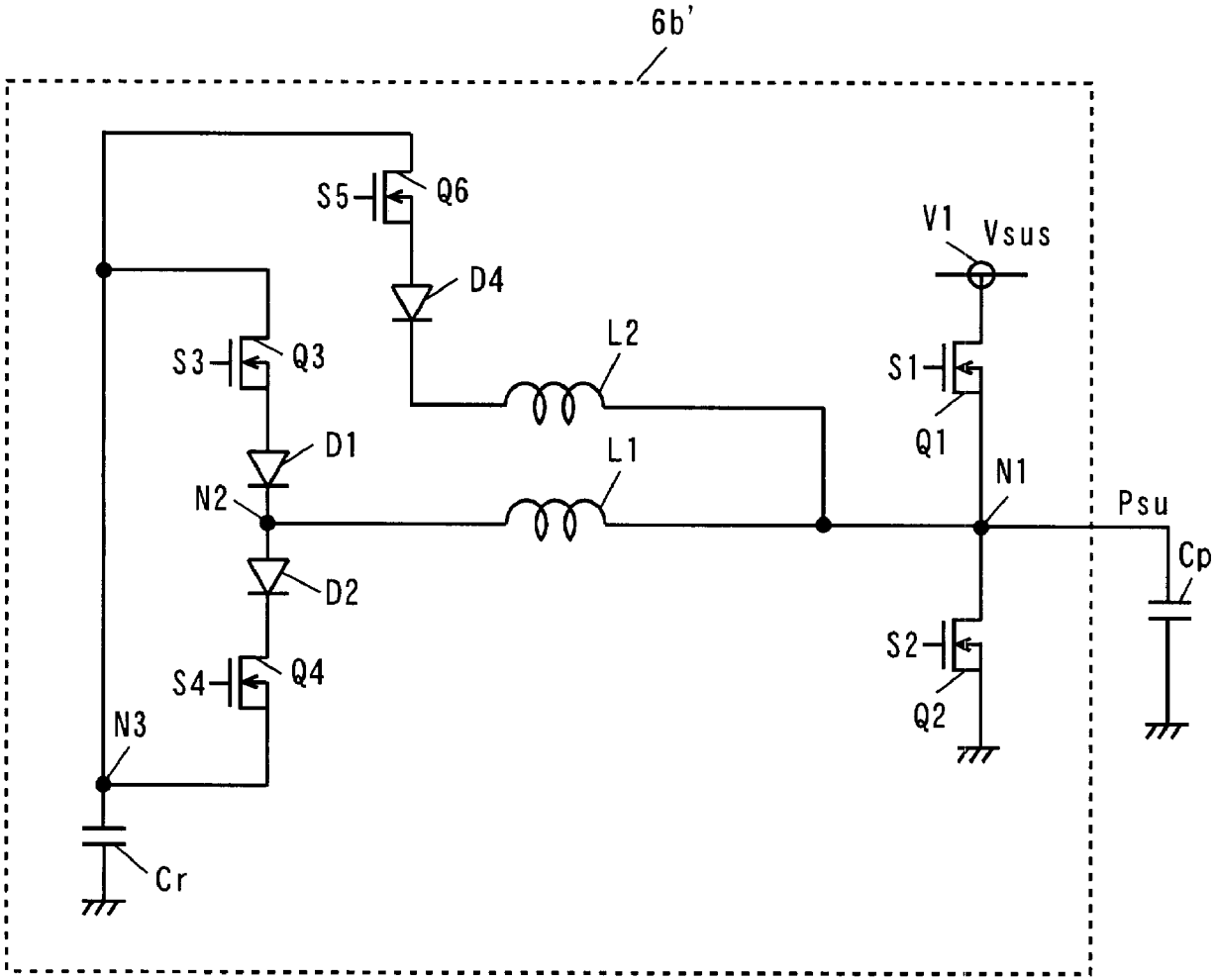
FIG. 27 is a circuit diagram showing the structure of another example of the sustain driver shown in FIG. 19.

Description will now be made on another example of the sustain driver 6*b* shown in FIG. 19. FIG. 27 is a circuit diagram showing the structure of another example of the sustain driver 6*b* of FIG. 19.

A sustain driver 6*b*' of FIG. 27 differs from the sustain driver 6*b* in that the diode D3 and the transistor Q5 are omitted, and the recovery coil L2 is connected to the recovery capacitor Cr through a transistor Q6 and a diode D4. Since the remaining parts of the sustain driver 6*b*' are the same as those of the sustain driver 6*b* of FIG. 21, the identical parts are denoted with the identical characters, and a detailed description thereof will not be given.

As shown in FIG. 27, a transistor Q3, a diode D1 and a recovery coil L1 connected in series are connected in parallel, between the recovery capacitor Cr and a node N1, to the transistor Q6, the diode 4 and the recovery coil L2 connected in series. The transistor Q6 has its gate provided with a control signal S5.

Because of the above structure, the sustain driver 6*b*' of FIG. 27 can also operate in the same manner and achieve the same effect as the sustain driver 6*b* of FIG. 21. Further, since only one transistor Q6 and one diode D4 are connected between the recovery capacitor Cr and the recovery coil L2, in the sustain driver 6b' of FIG. 27, a loss occurring along a current path can be more decreased with more decreased reactive power as compared to such a case that two transistors Q3 and Q5 and two diodes D1 and D3 are connected as in the sustain driver 6b of FIG. 21.

Figure 28:
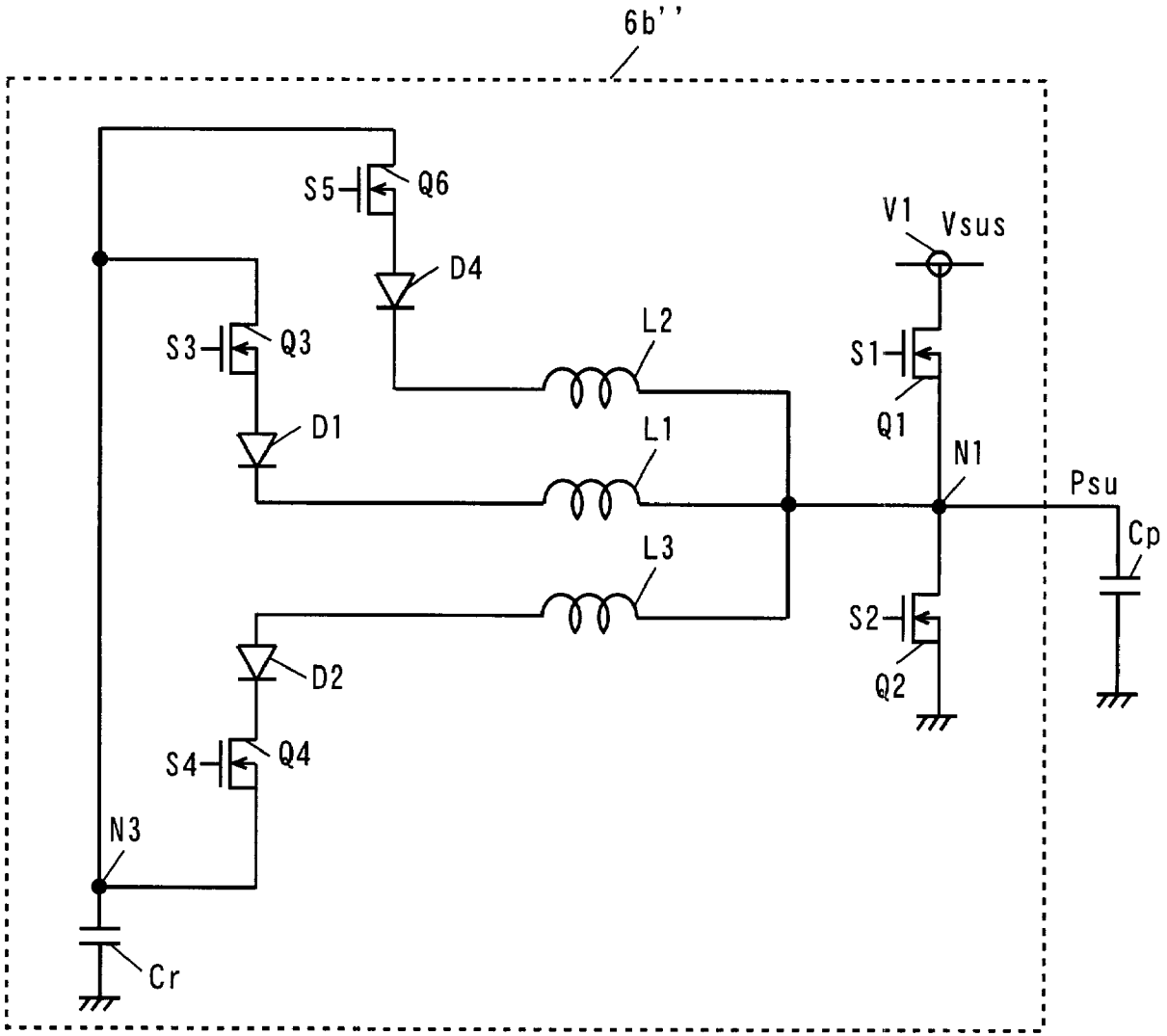
FIG. 28 is a circuit diagram showing the structure of still another example of the sustain driver shown in FIG. 19.

Description will now be made on still another example of the sustain driver 6b shown in FIG. 19. FIG. 28 is a circuit diagram showing the structure of still another example of the sustain driver of FIG. 19.

A sustain driver 6b" of FIG. 28 differs from the sustain driver 6b' of FIG. 27 in that the diode D2 is separated from the node N2, and a recovery coil L3 is provided between the diode D2 and the node N1. Since the remaining parts of the sustain driver 6b" are the same as those of the sustain driver 6b of FIG. 27, the identical parts are denoted with identical characters, and a detailed description thereof will not be given.

As shown in FIG. 28, the recovery coil has its one end connected to the node N1 and the other end connected to an anode of the diode 2. Accordingly, the recovery coil that contributes to the LC resonance in a time period TC which is the non-discharge recovery time is the recovery coil L3. The inductance value that contributes to the LC resonance in the non-discharge recovery time can be set to an arbitrary value independently of the inductance value that contributes to the LC resonance in the discharge recovery time.

In this case, since no discharge is carried out in the non-discharge recovery time, the recovery time can be made sufficiently long without consideration of any discharge stability. For example, if the recovery time is set to 2000ns, and the inductance value of the recovery coil L3 is set to such an inductance value that the resonance time is 2000ns, then the non-discharge recovery time can be made still longer, resulting in more decreased reactive power.

Figure 29:
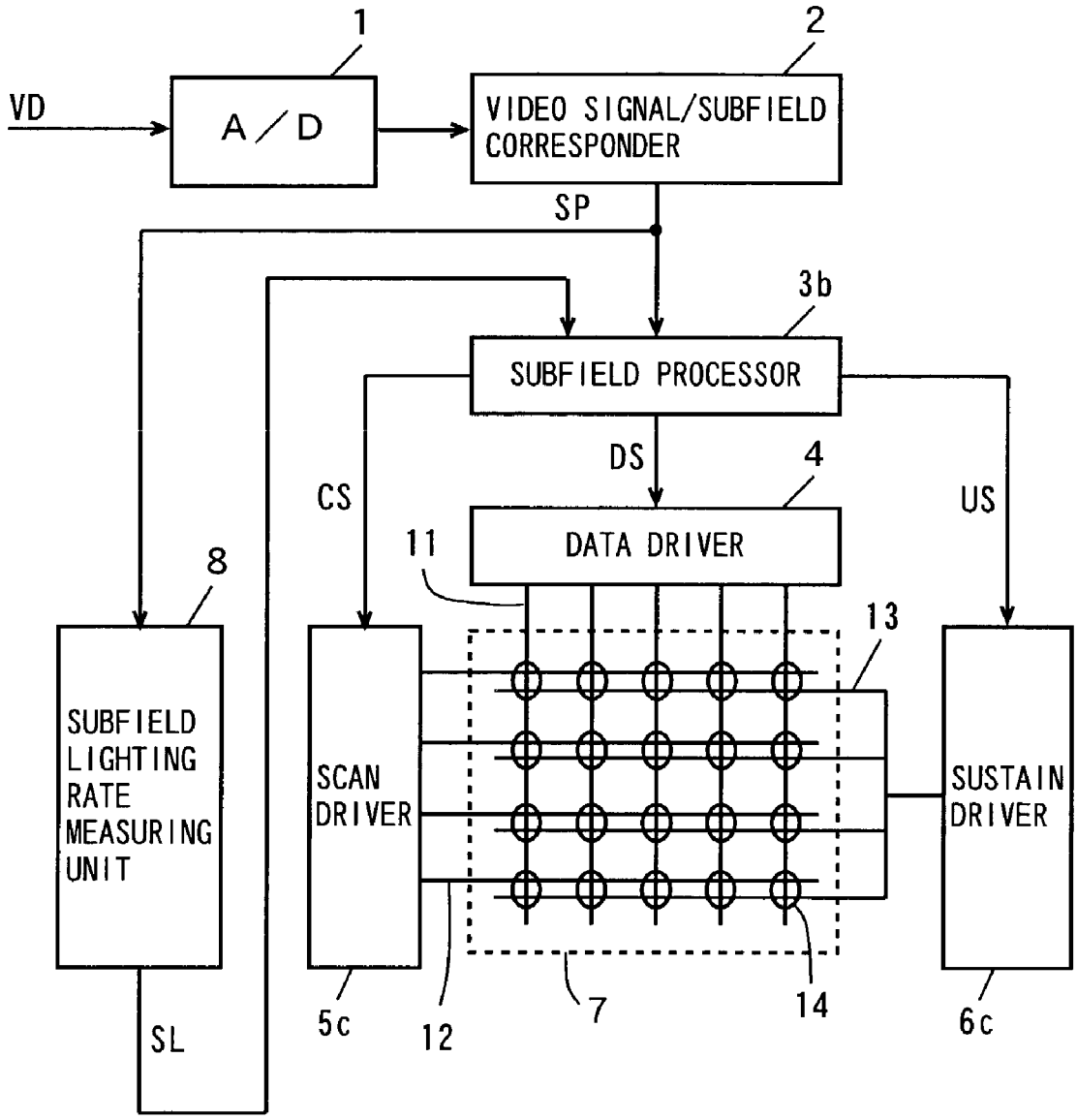
FIG. 29 is a block diagram showing the structure of a plasma display device according to a fourth embodiment of the present invention.

Description will now be made on a plasma display device according to a fourth embodiment of the present invention. FIG. 29 is a block diagram showing the structure of the plasma display device according to the fourth embodiment of the present invention.

The plasma display device of FIG. 29 differs from that of FIG. 19 in that the subfield processor 3a, the scan driver 5b and the sustain driver 6b are replaced by a subfield processor 3b, a scan driver 5c and a sustain driver 6c for varying the resonance time, the discharge recovery time, the non-discharge recovery time and the sustain period depending on the lighting rate. Since the remaining parts of the plasma display device of FIG. 29 are the same as those of the plasma display device of FIG. 19, the identical parts are denoted with the identical characters, and the different parts will be described in detail.

Figure 30:
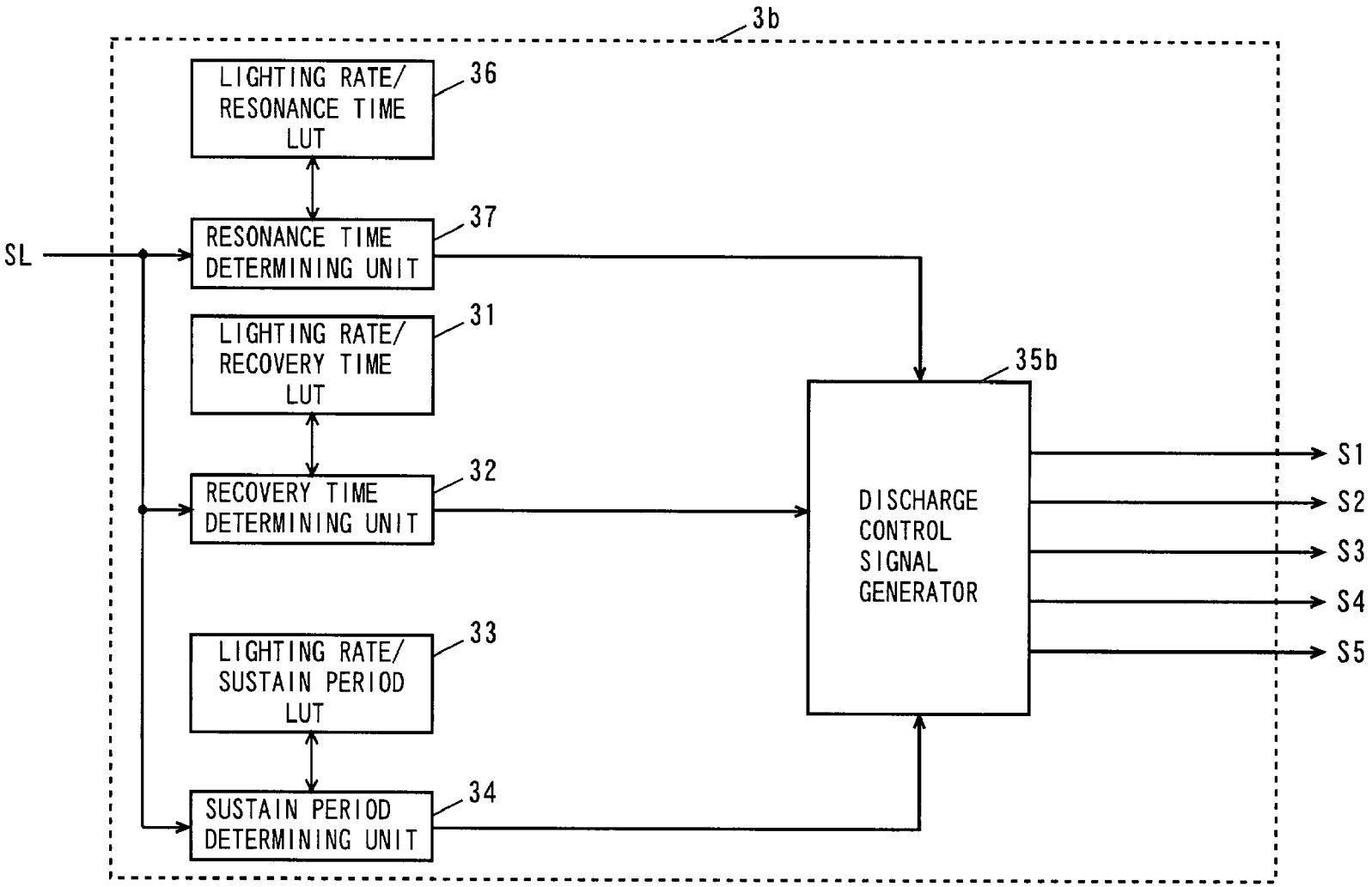
FIG. 30 is a block diagram showing the structure of a subfield processor shown in FIG. 29.

FIG. 30 is a block diagram showing the structure of the subfield processor 3b of FIG. 29. The subfield processor 3b of FIG. 30 is different from the subfield processor 3a of FIG. 20 in that the discharge control signal generator 35a is replaced by a discharge control signal generator 35b that outputs control signals S1 to S5 for varying the resonance time, the discharge recovery time, the non-discharge recovery time and the sustain period depending on the lighting rate. Since the remaining parts of the subfield processor 3b are the same as those of the subfield processor 3a shown in FIG. 20, the identical parts are denoted with the identical characters, and a detailed description thereof will not be given.

The discharge control signal generator 35b of FIG. 30 outputs control signals S1 to S5 as the sustain driver driving control signal US so that the sustain driver 6c outputs sustain pulses in the resonance time determined by the resonance time determining unit 37, the recovery time, that is, the discharge recovery time and the non-discharge recovery time determined by the recovery time determining unit 32, and in the sustain period determined by the sustain period determining unit 34.

Likewise, the scan driver 5c is also controlled by the subfield processor 3b, so that the waveform and the period of sustain pulses to be applied to the scan electrodes 12 are likewise controlled depending on the lighting rate for each subfield.

Figure 31:
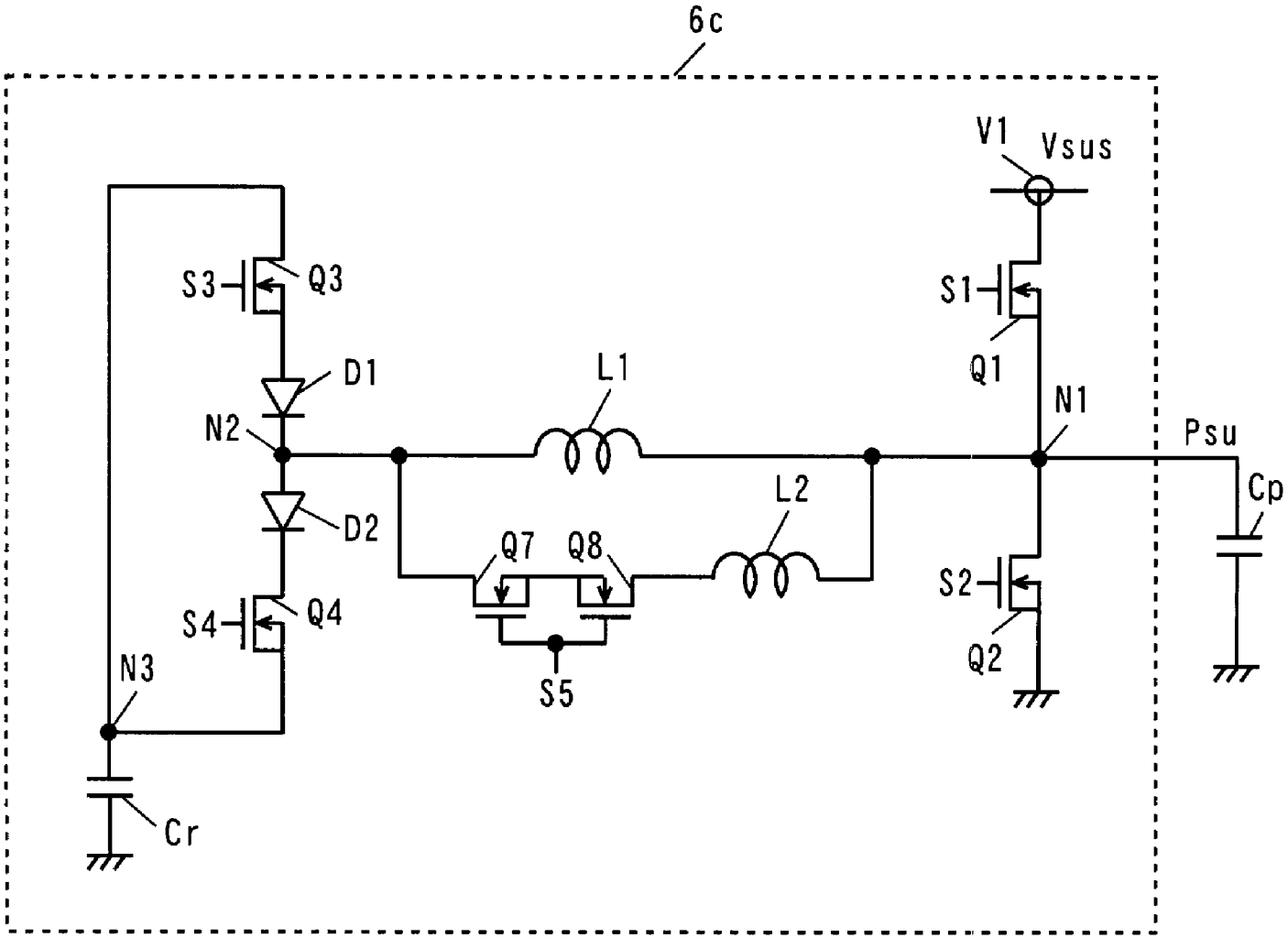
FIG. 31 is a circuit diagram showing the structure of a sustain driver shown in FIG. 29.
Figure 32:
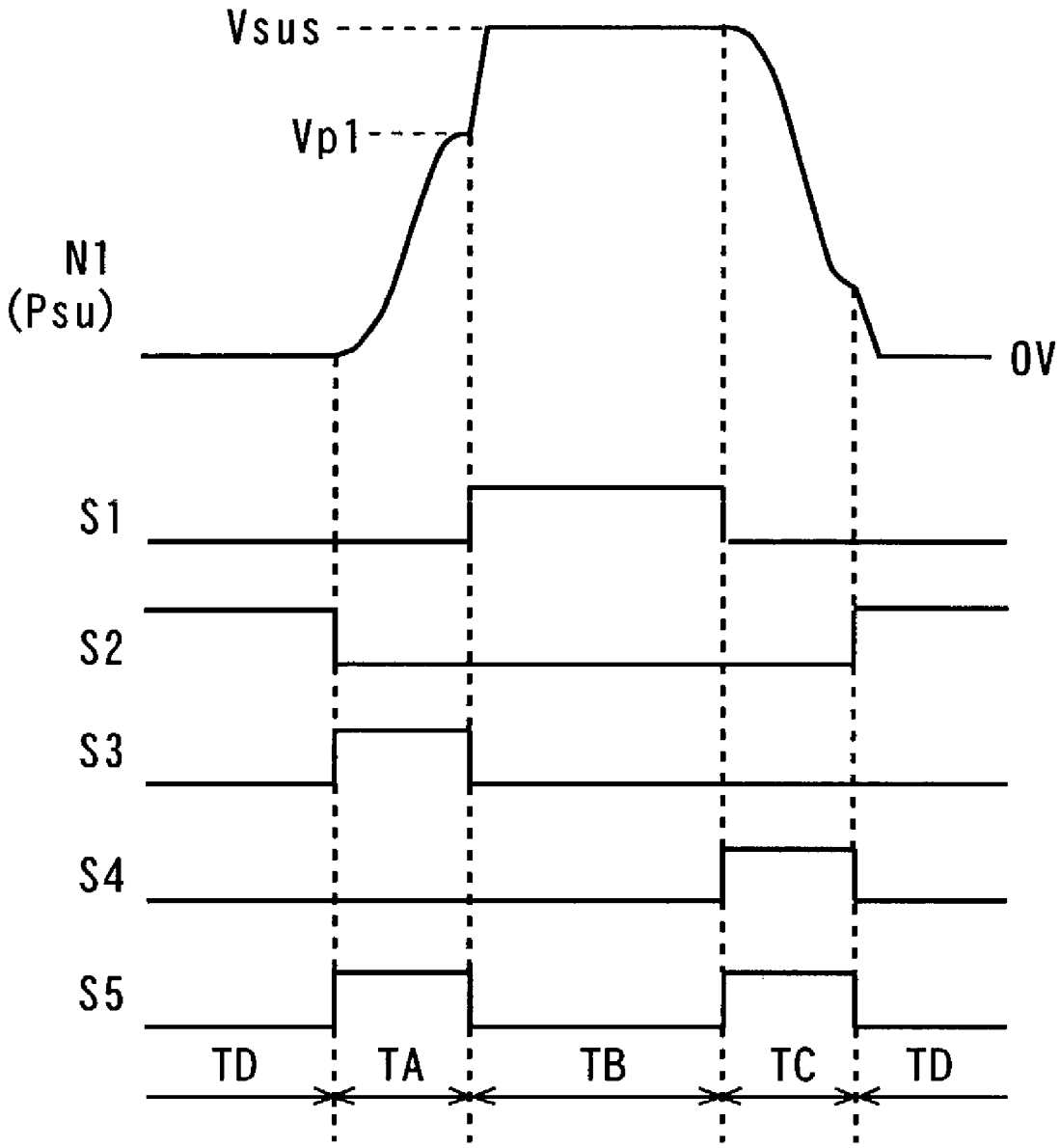
FIG. 32 is a first timing chart showing the operation of the sustain driver of FIG. 31 in a sustain time period.
Figure 33:
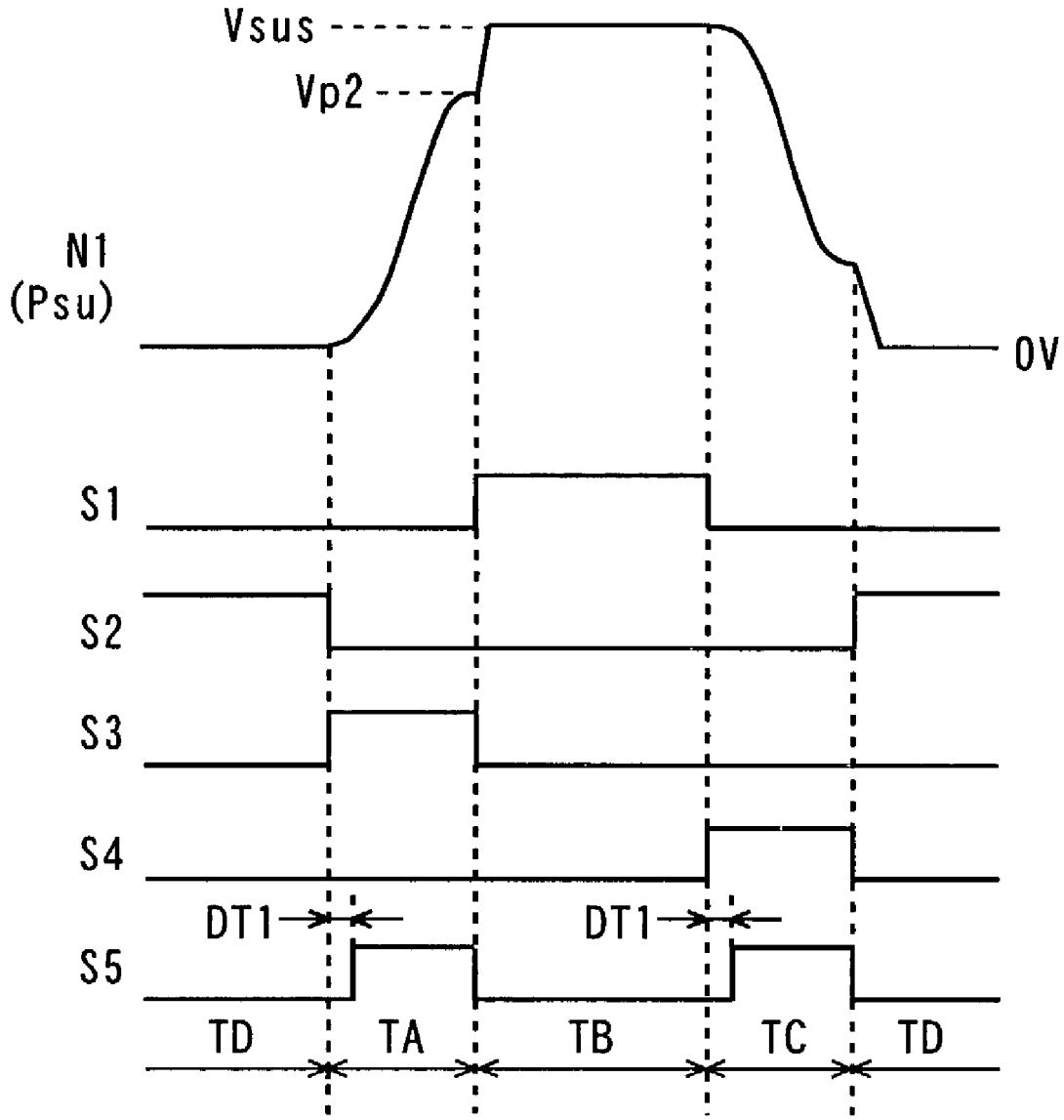
FIG. 33 is a second timing chart showing the operation of the sustain driver of FIG. 31 in the sustain time period.
Figure 34:
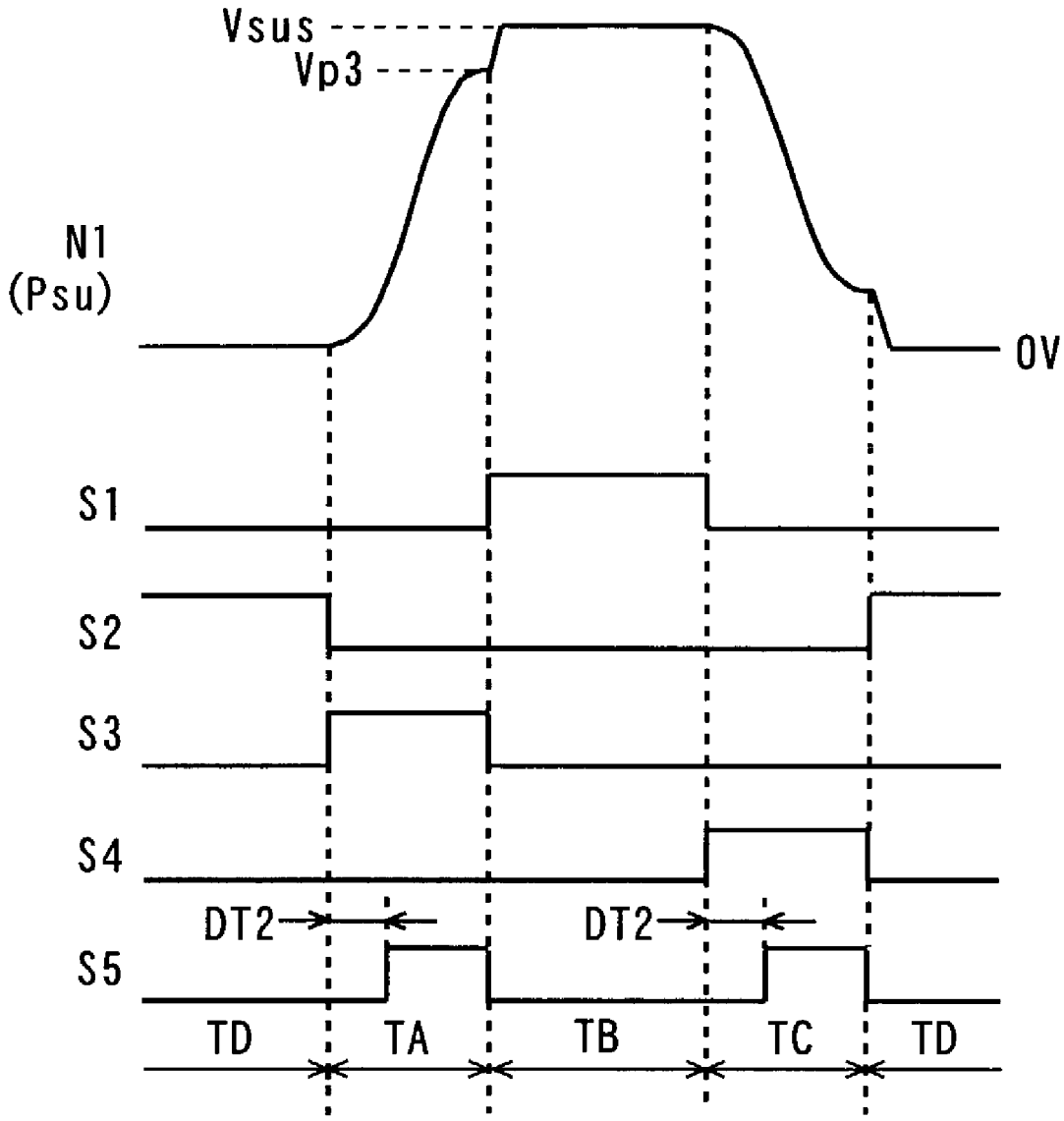
FIG. 34 is a third timing chart showing the operation of the sustain driver of FIG. 31 in the sustain time period.
Figure 35:
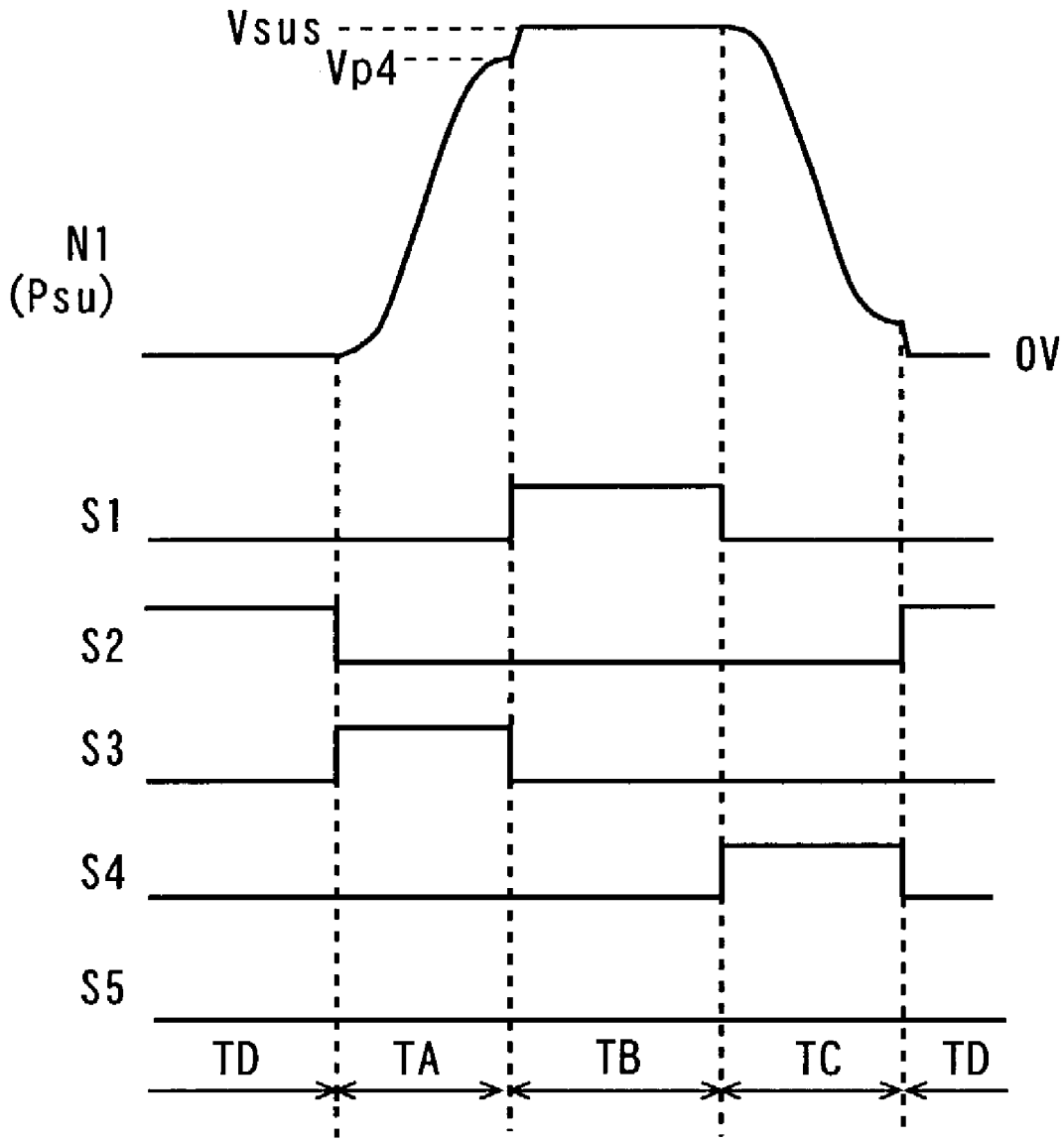
FIG. 35 is a fourth timing chart showing the operation of the sustain driver of FIG. 31 in the sustain time period.

FIG. 31 is a circuit diagram showing the structure of the sustain driver 6c shown in FIG. 29. Since the scan driver 5c of this embodiment is also structured and operates in the same manner as the sustain driver 6c, a detailed description will now be given only on the sustain driver 6c not on the scan driver 5c.

The sustain driver 6c of FIG. 31 is different from the sustain driver 6b of FIG. 21 in that the diode D3 and the transistor Q5 are replaced by two transistors Q7 and Q8. Since the remaining parts of the sustain driver 6c are the same as those of the sustain driver 6b of FIG. 21, a detailed description thereof will not be given, with the identical parts denoted with the identical characters.

As shown in FIG. 31, the transistor Q7 has its drain connected to the node N2 and its source connected to the source of the transistor Q8. The transistor Q8 has its drain connected to the recovery coil L2. Each of the transistors Q7 and Q8 has its gate provided with the control signal S5.

Because of the above structure in the sustain driver 6c of FIG. 31, it is possible to turn on/off bi-directional currents between the nodes N2 and N1, and vary the resonance time and the discharge recovery time at the time sustain pulses rise, while varying the resonance time and the non-discharge recovery time at the time the sustain pulses fall.

In this embodiment, the transistors Q3, Q4, Q7 and Q8, the recovery capacitor Cr, the recovery coils L1 and L2, and the diodes D1 and D2 correspond to recovery means; the subfield processor 3b to control means; the transistors Q7 and Q8, and the recovery coils L2 and L2 to inductance means and variable inductance means; and the transistors Q7 and Q8 to second switch means. The remaining parts are the same as those in the third embodiment.

FIGS. 32 to 35 are timing charts showing operations of the sustain driver 6c of FIG. 31 in the sustain time period. The voltage on the node N1 and the control signals S1 to S5 shown in FIG. 31 are illustrated in FIGS. 32 to 35.

As shown in FIGS. 32 to 35, in the sustain driver 6c like the third embodiment, a time period TA to be the discharge recovery time, and delay times DT1 and DT2 are controlled depending on the lighting rate, while a time period TC to be the non-discharge recovery time, and delay times DT1 and DT2 are also controlled depending on the lighting rate.

In this embodiment, as described above, the lighting rate for each subfield is detected, and as the detected lighting rate for each subfield becomes lower, the discharge recovery time, the non-discharge recovery time, the resonance time and the sustain period at the rising and falling of sustain pulses can become longer, resulting in the same effects as in the first embodiment.

In addition, since those two field-effect transistors Q7 and Q8 connected in series are employed, a loss occurring in the transistors Q7 and Q8 can be sufficiently decreased, leading to a further decrease in the reactive power.

While the discharge recovery time and its resonance time are set equal to the non-discharge recovery time and its resonance time in this embodiment, it may be controlled that they are set to be different times independently of each other.

While the transistors Q7 and Q8 are used as switch means, the switch means for use is not particularly limited to this example, but an insulated gate bipolar transistor (IGBT) which is an element that a MOS (Metal Oxide Semiconductor) FET and a bipolar transistor are combine together in one chip, and the like may be employed. While the diode D1 and the transistor Q3, the diode D2 and the transistor Q4, and the diode D3 and the transistor Q5 are used as the switch means in the third embodiment, such two field effect-transistors connected in series may be used as in the fourth embodiment, or an insulated gate bipolar transistor and the like may be used. In this respect, the same is applicable to a fifth embodiment which will be described later.

Figure 36:
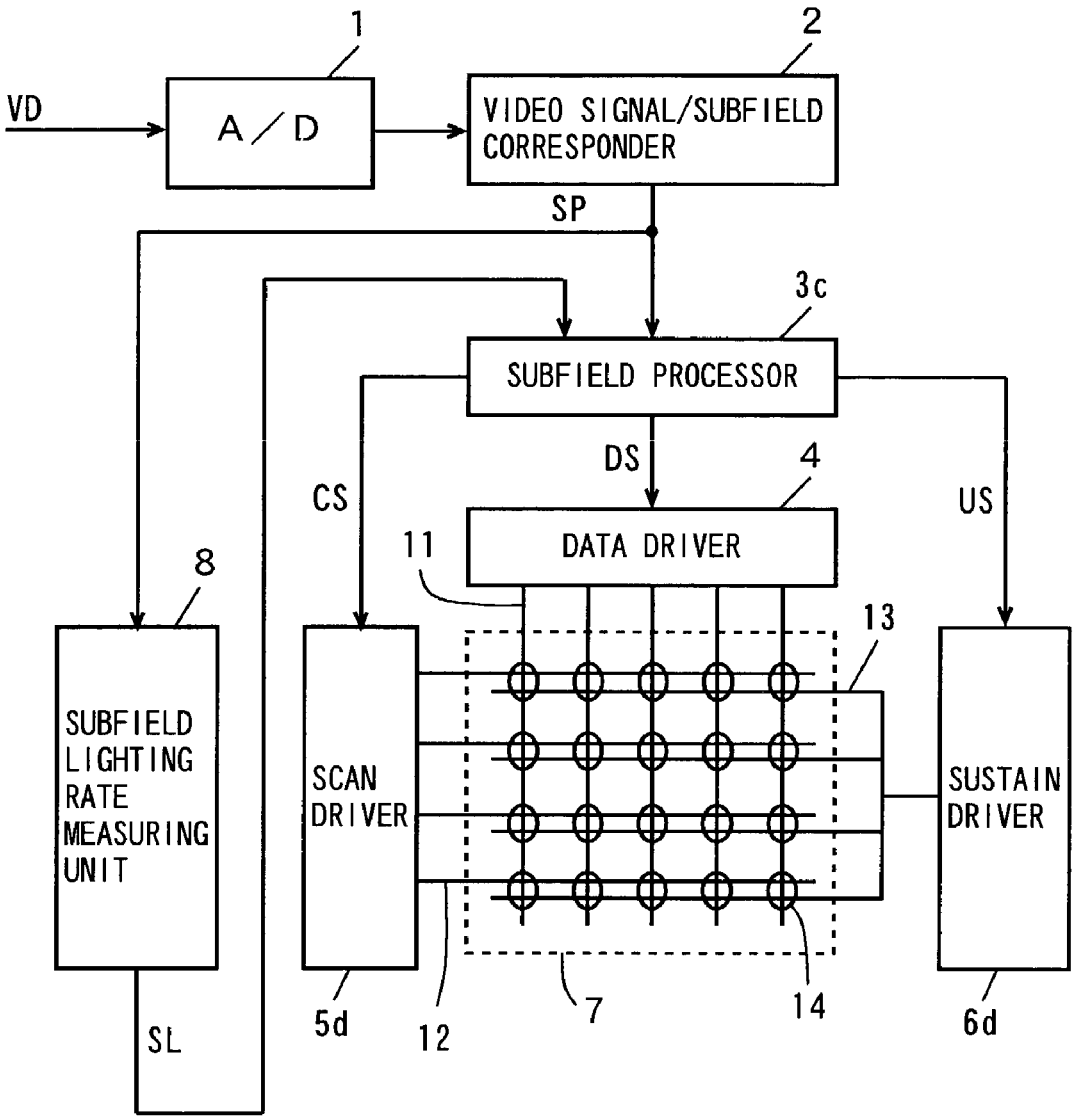
FIG. 36 is a block diagram showing the structure of a plasma display device according to a fifth embodiment of the present invention.

A description will now be made on a plasma display device according to the fifth embodiment of the present invention. FIG. 36 is a block diagram showing the structure of the plasma display device according to the fifth embodiment of the present invention.

The plasma display device of FIG. 36 differs from that of FIG. 19 in that the subfield processor 3*a*, the scan driver 5*b* and the sustain driver 6*b* are replaced by a subfield processor 3*c*, a scan driver 5*d* and a sustain driver 6*d* for varying the resonance time, the discharge recovery time, the non-discharge recovery time and the sustain period depending on the lighting rate. Since the remaining parts of the plasma display device of FIG. 36 are the same as those of the plasma display device of FIG. 19., a detailed description will now be described on the different parts, with the identical parts denoted with the identical characters.

Figure 37:
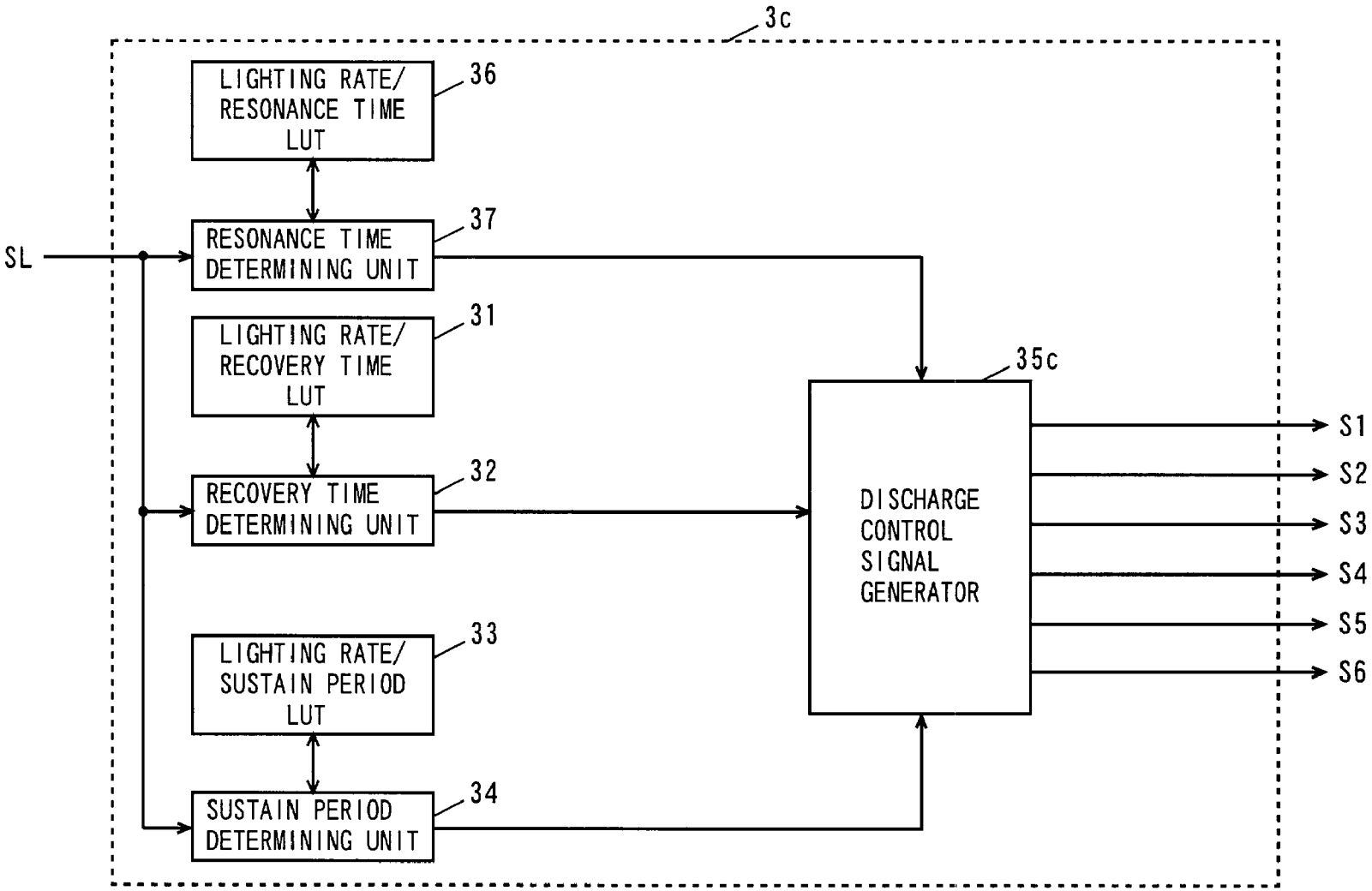
FIG. 37 is a block diagram showing the structure of a subfield processor shown in FIG. 36.

FIG. 37 is a block diagram showing the structure of the subfield processor 3*c* shown in FIG. 36. The subfield processor 3*c* of FIG. 37 is different from the subfield processor 3*a* of FIG. 20 in that the discharge control signal generator 35*a* is replaced by a discharge control signal generator 35*c* that outputs control signals S1 to S6 for varying the resonance time, the discharge recovery time, the non-discharge recovery time and the sustain period depending on the lighting rate. The remaining parts of the subfield processor 3*c* are the same as those of the subfield processor 3*a* of FIG. 20, and hence, a detailed description will not be given, with the identical parts denoted with the identical characters.

The discharge control signal generator 35*c* shown in FIG. 37 outputs control signals S1 to S6 as the sustain driver driving control signal US so that the sustain driver 6*d* outputs sustain pulses in the recovery time determined by the recovery time determining unit 32, i.e., the discharge recovery time and the non-discharge recovery time, and in the sustain period determined by the sustain period determining unit 34.

Likewise, the scan driver 5*d* is also controlled by the subfield processor 3*c*, and the waveform and the period of sustain pulses to be applied to the scan electrodes 12 are likewise controlled depending on the lighting rate for each subfield.

Figure 38:
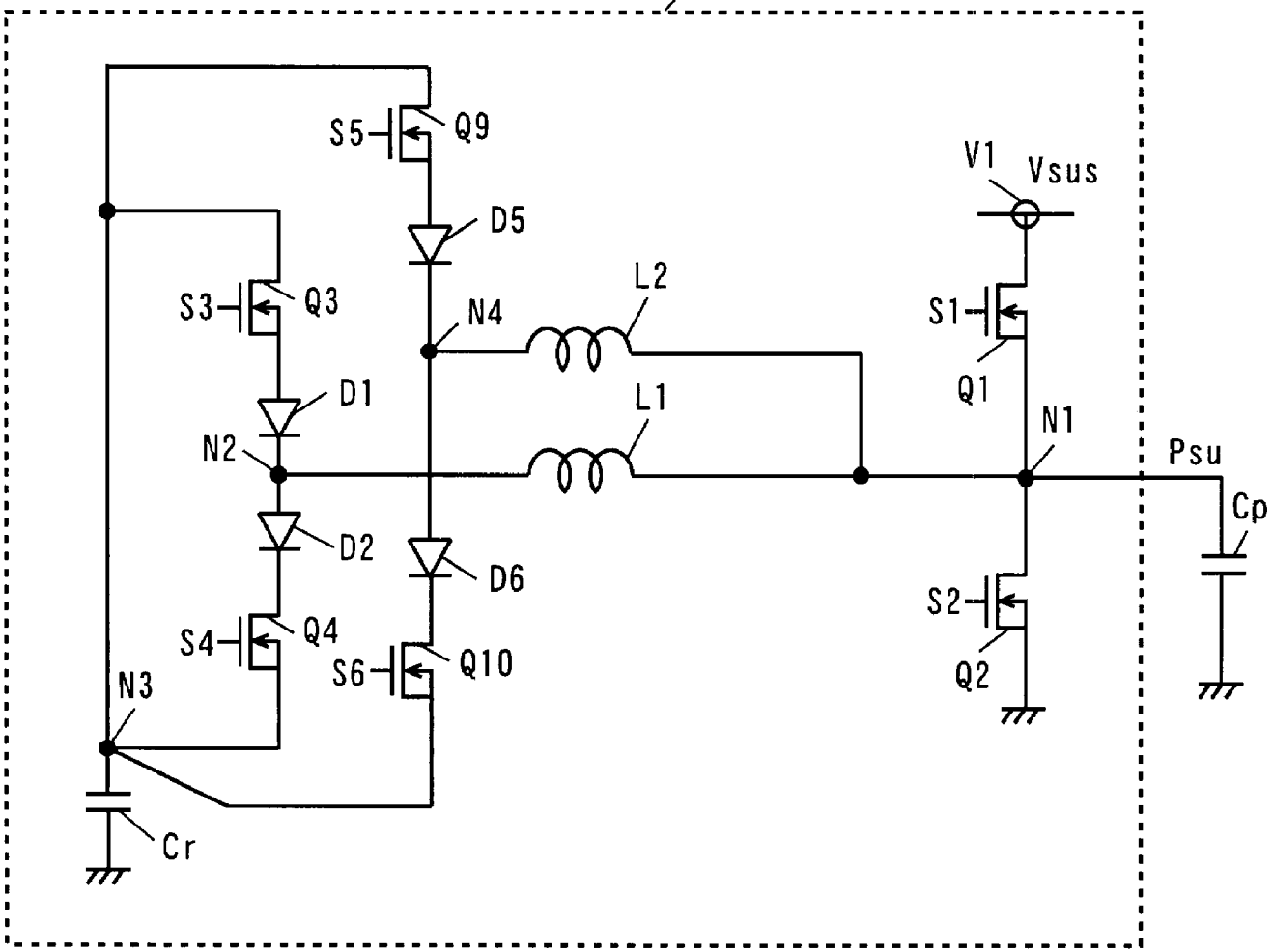
FIG. 38 is a circuit diagram showing the structure of a sustain driver shown in FIG. 36.
Figure 39:
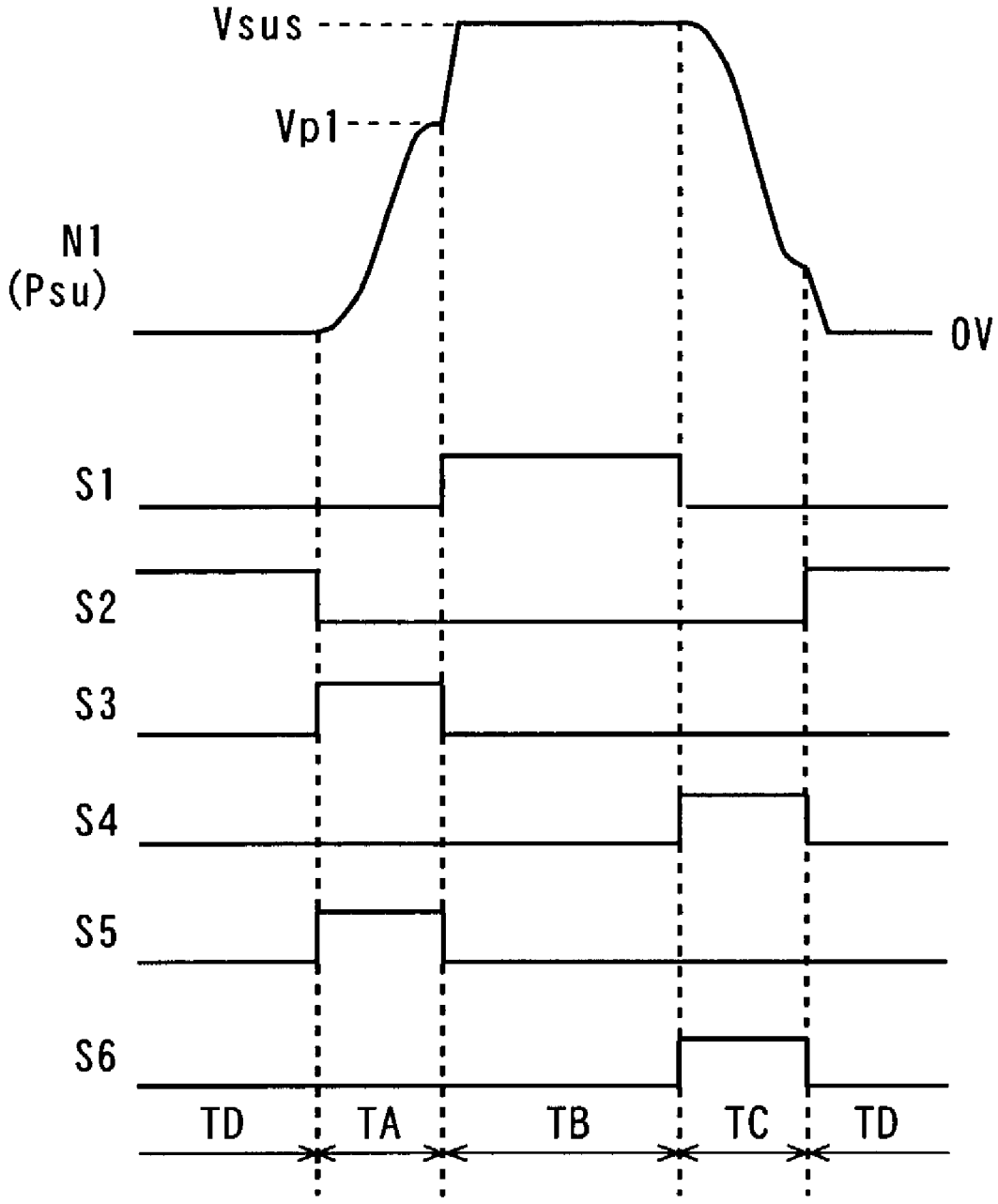
FIG. 39 is a first timing chart showing the operation of the sustain driver of FIG. 38 in a sustain time period.
Figure 40:
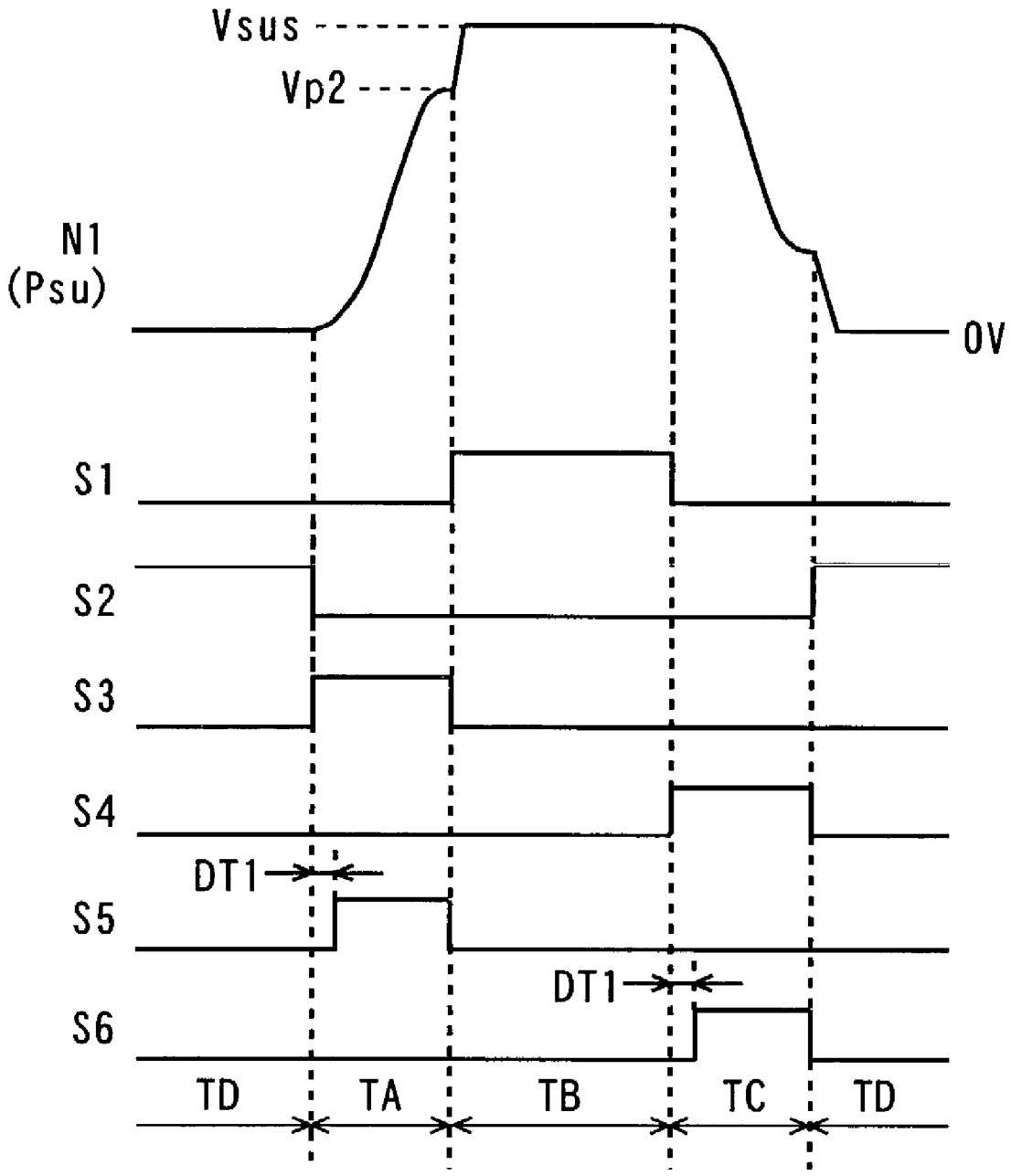
FIG. 40 is a second timing chart showing the operation of the sustain driver of FIG. 38 in the sustain time period.
Figure 41:
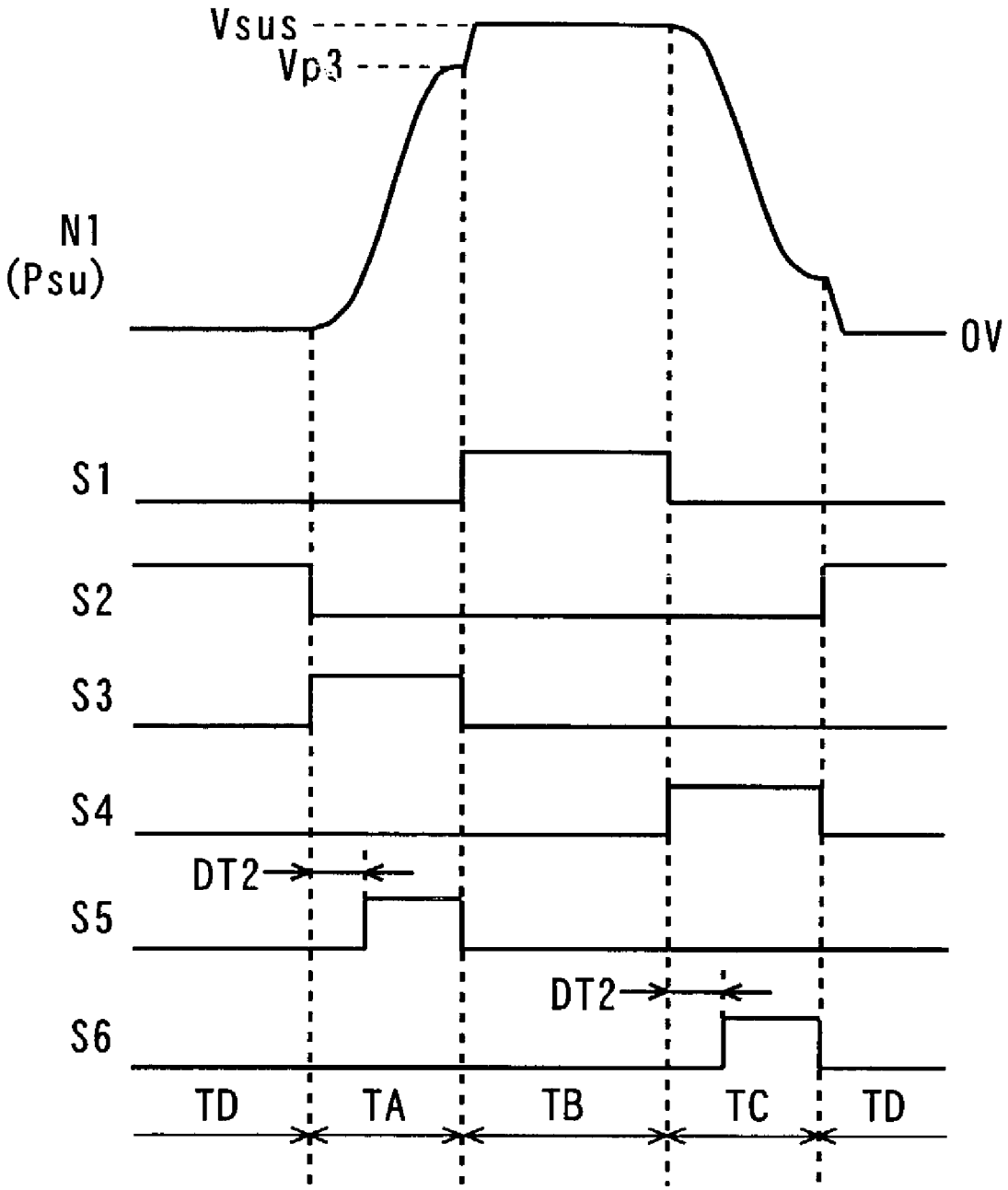
FIG. 41 is a third timing chart showing the operation of the sustain driver of FIG. 38 in the sustain time period.
Figure 42:
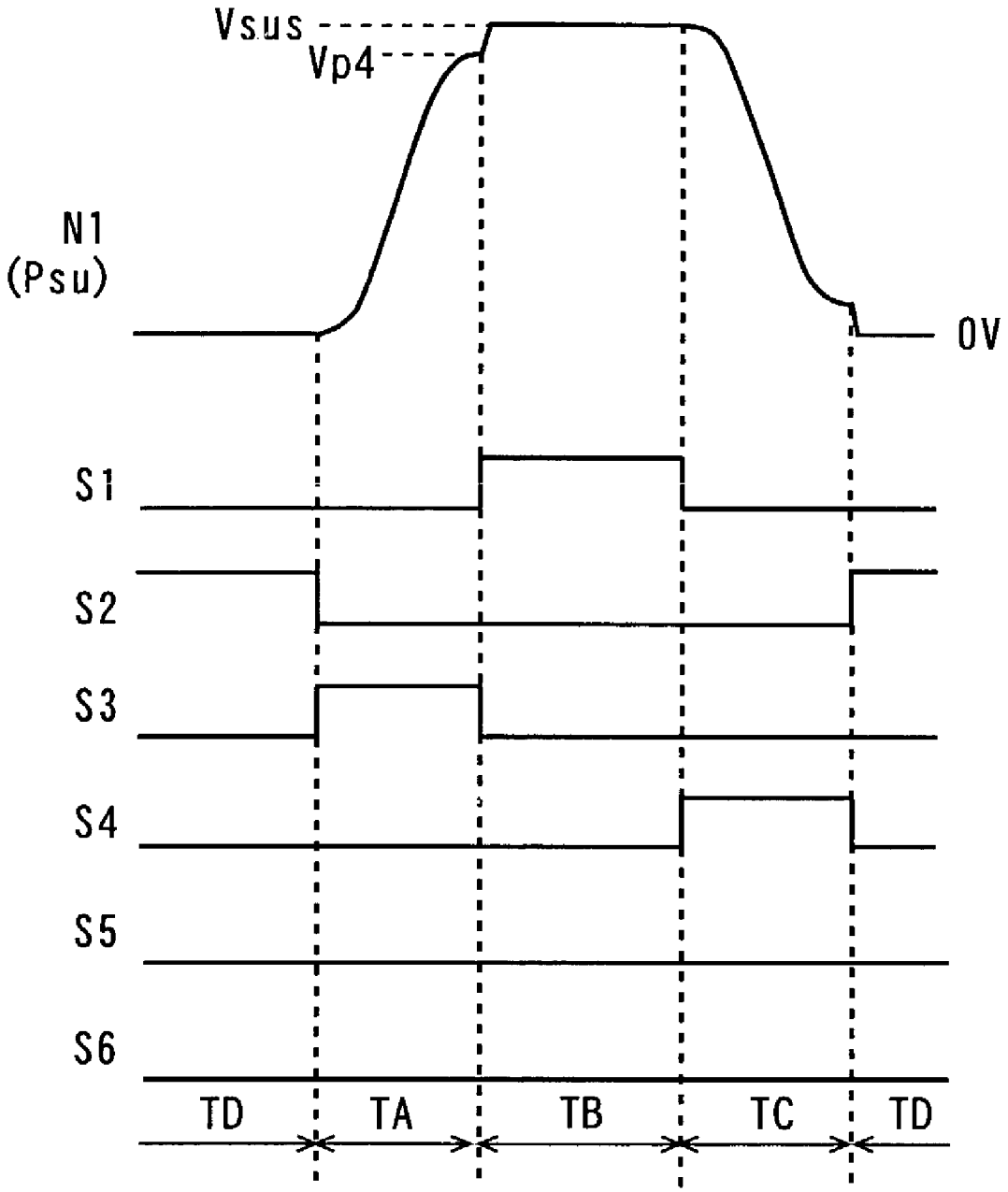
FIG. 42 is a fourth timing chart showing the operation of the sustain driver of FIG. 38 in the sustain time period.

FIG. 38 is a circuit diagram showing the structure of the sustain driver 6*d* of FIG. 36. Since the scan driver 5*d* of this embodiment is also structured and operative like the sustain driver 6*d*, a detailed description will now be made only on the sustain driver 6*d*, but not on the scan driver 5*d*.

The sustain driver 6*d* of FIG. 38 is different from the sustain driver 6*b* of FIG. 21 in that the diode D3 and the transistor Q5 are omitted, and the recovery coil L2 is connected to the recovery capacitor Cr through a transistor Q9 and a diode D5 and through a transistor Q10 and a diode D6. Since the remaining parts of the sustain driver 6*d* are the same as those of the sustain driver 6*b* of FIG. 21, a detailed description will not be given, with the identical parts denoted with the identical characters.

As shown in FIG. 38, the transistor Q9 and the diode D5 connected in series are connected in parallel to the transistor Q10 and the diode D6 connected in series, between the recovery capacitor Cr and the recovery coil L2. The transistor Q9 has its gate provided with the control signal S5, while the transistor Q10 has its gate provided with the control signal S6.

Because of the above structure, it is possible, in the sustain driver 6*d* shown in FIG. 38, to turn on/off bidirectional currents between a node N4 and the node N3, and thus, it is possible to independently control the connection state of the recovery coil L2 being connected in parallel to the recovery coil L1. This makes it possible to vary the resonance time and the discharge recovery time at the rising of sustain pulses Psu and vary the resonance time and the non-discharge recovery time at the falling of the sustain pulses Psu.

In this embodiment, the transistors Q3, Q4, Q9, Q10, the recovery capacitor Cr, the recovery coils L1, L2, and the diodes D1, D2, D5, D6 correspond to recovery means; the subfield processor 3*c* to control means; the transistors Q9, Q10, the diodes D5, D6, and the recovery coils L1, L2 to inductance means and variable inductance means; the diode D5 and the transistor Q9 to second switch means; the diode D2 and the transistor Q4 to third switch means; and the diode D6 and the transistor Q10 to fourth switch means. The remaining parts are the same as those of the third embodiment.

FIGS. 39 to 42 are timing charts showing operations of the sustain driver 6*d* of FIG. 38 in the sustain time period. The voltage on the node N1 and the control signals S1 to S6 are illustrated in FIGS. 39 to 42.

As-shown in FIGS. 39 to 42, in the sustain driver 6*d*, a time period TA to be the discharge recovery time and delay times DT1 and DT2 are controlled depending on the lighting rate, while a time period TC to be the non-discharge recovery time and delay times DT1 and DT2 are controlled depending on the lighting rate, like the fourth embodiment.

As described above, in this embodiment, the lighting rate for each subfield is detected. As the detected lighting rate for each subfield becomes lower, the discharge recovery time, the non-discharge recovery time, the resonance time and the sustain period at the rising and falling of sustain pulses can become longer, resulting in achievement of the same effect as in the first embodiment.

Furthermore, since the on/off states of the transistors Q9 and Q10 can independently be controlled by the control signals S5 and S6, it is possible to independently control the resonance time at the rising of sustain pulses and that at the falling of the sustain pulses. Also, the recovery coil L2 is employed at both the rising and falling of the sustain pulses, thereby enabling a simplified circuit configuration.

Because of the above structure, since only one transistor Q9 and one diode D5 are connected between the recovery capacitor Cr and the recovery coil L2 in the sustain driver 6*d* of FIG. 38, a loss occurring in a current path can be more decreased, and thus, reactive power can be more decreased as compared with such a case that three transistors Q3, Q7 and Q8 and one diode D1 are connected as in the sustain driver 6*c* of FIG. 31.

While the discharge recovery time and its resonance time are set equal to the non-discharge recovery time and its resonance time in this embodiment, it may be controlled that they are independently different times from each other.

Figure 43:
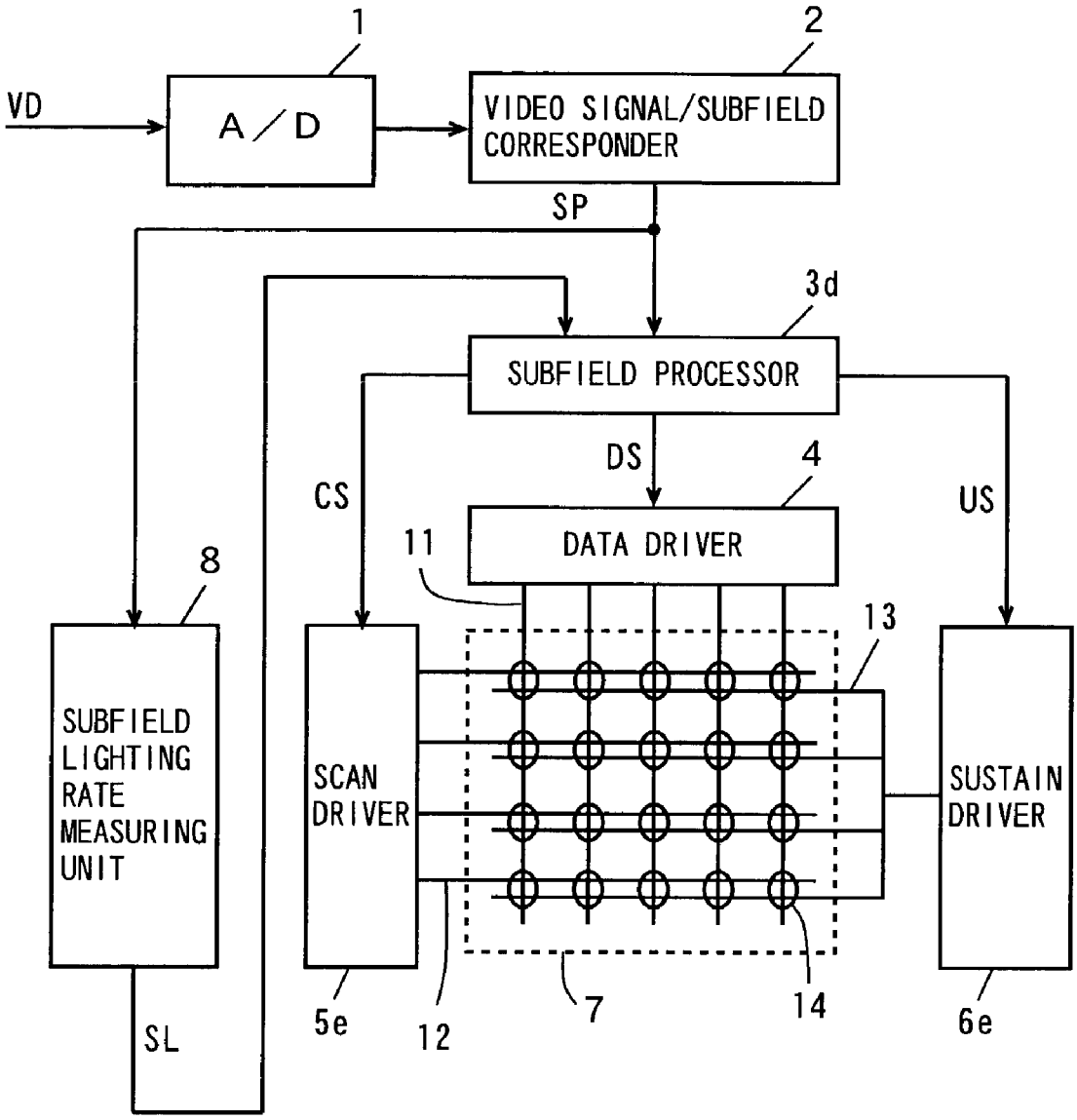
FIG. 43 is a block diagram showing the structure of a plasma display device according to a sixth embodiment of the present invention.

A description will now be made on a plasma display device according to a sixth embodiment of the present invention. FIG. 43 is a block diagram showing the structure of the plasma display device according to the sixth embodiment of the present invention.

The plasma display device of FIG. 43 is different from that of FIG. 36 in that the subfield processor 3*c*, the scan driver 5*d* and the sustain driver 6*d* are replaced by a subfield processor 3*d*, a scan driver 5*e* and a sustain driver 6*e* for varying the resonance time and the sustain period depending on the lighting rate. Since the remaining parts of the plasma display device of FIG. 43 are the same as those of the plasma display device of FIG. 36, the identical parts are denoted with the identical characters, and a detailed description will now be made on the different parts.

Figure 44:
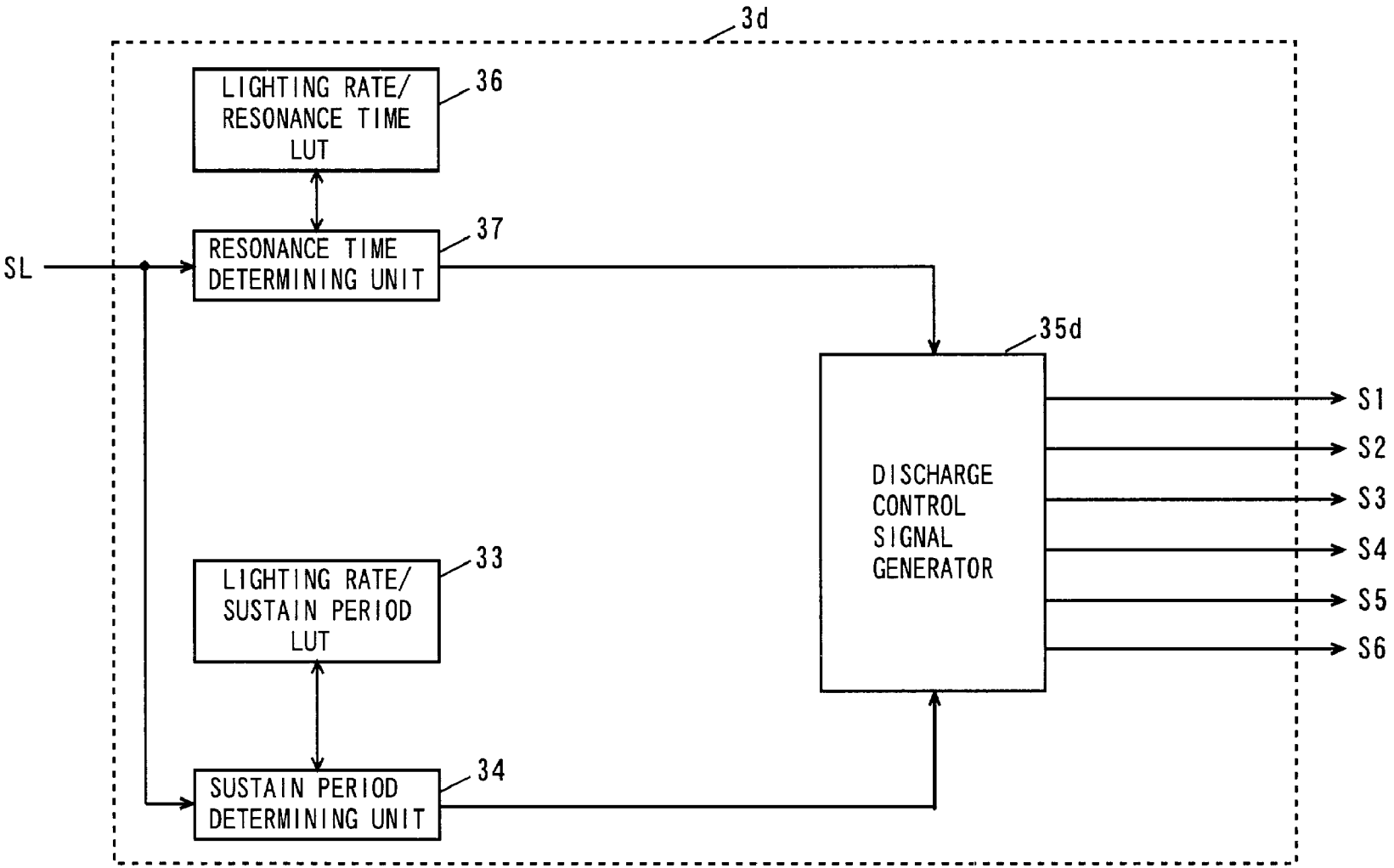
FIG. 44 is a block diagram showing the structure of a subfield processor shown in FIG. 43.

FIG. 44 is a block diagram showing the structure of the subfield processor 3*d* shown in FIG. 43. The subfield processor 3*d* of FIG. 44 differs from the subfield processor 3*c* of FIG. 37 in that the discharge control signal generator 35*c* is replaced by a discharge control signal generator 35*d* that outputs control signals S1 to S6 for varying the resonance time and the sustain period depending on the lighting rate, with the recovery time fixed, and that neither the lighting rate/recovery time LUT 31 nor the recovery time determining unit 32 is provided. Since the remaining parts of the subfield processor 3*d* of FIG. 44 are the same as those of the processor 3*c*, the identical parts are denoted with the identical characters, and a detailed description will not be given.

The discharge control signal generator 35*d* shown in FIG. 44 outputs control signals S1 to S6 as the sustain driver driving control signal US so that the sustain driver 6*e* outputs sustain pulses in the resonance time determined by the resonance time determining unit 37 and in the sustain period determined by the sustain period determining unit 34.

Likewise, the scan driver 5*e* is also controlled by the subfield processor 3*d*, and the waveform and the period of the sustain pulses to be applied to the scan electrodes 12 are likewise controlled depending on the lighting rate for each subfield.

The structure of the sustain driver 6*e* shown in FIG. 43 is the same as that of the sustain driver 6*d* shown in FIG. 38. Further, the scan driver 5*e* shown in FIG. 43 is also structured and operative like the sustain driver 6*e*.

As the structure of the sustain driver 6*e* and that of the scan driver 5*e*, such a structure as of the sustain driver 6*b* of FIG. 21, the sustain driver 6*b*' of FIG. 27, the sustain driver 6" of FIG. 28, the sustain driver 6*c* of FIG. 31 or the sustain driver 6*d* of FIG. 38 may be employed. In this case also, the subfield processor 3*d* of FIG. 44 varies the resonance time and the sustain period depending on the lighting rate, with the recovery period fixed.

A description will now be made on operations of controlling the resonance time and the sustain period of sustain pulses by the subfield processor 3*d* of FIG. 43.

Figure 45:
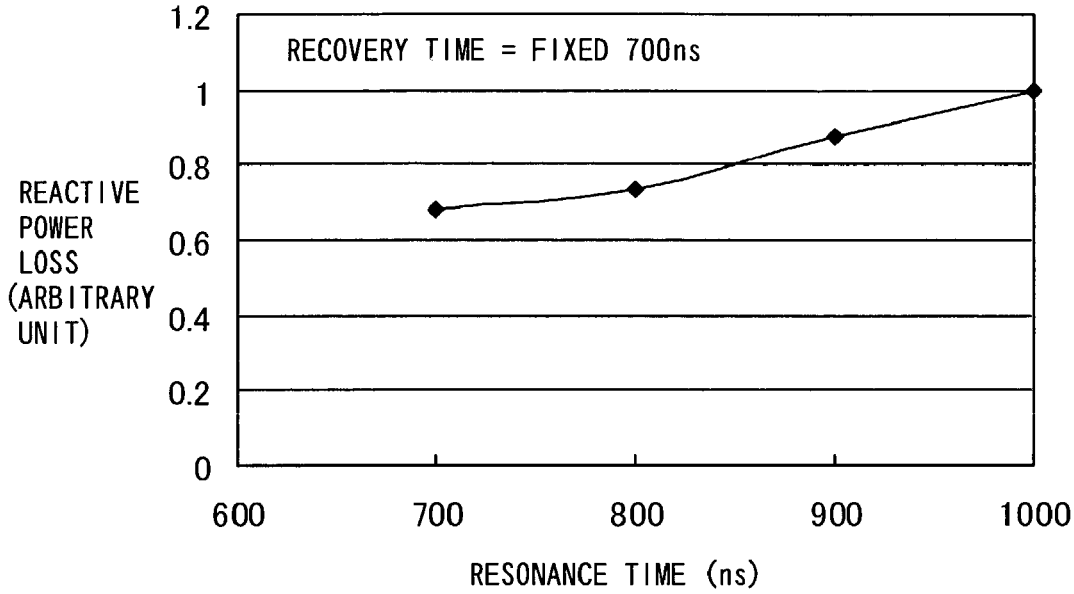
FIG. 45 is a diagram showing one example of the relationship between a resonance time and a reactive power loss.

FIG. 45 is a diagram showing an example of the relationship between the resonance time and the loss of reactive power, which exhibits data that the loss of reactive power per pulse is measured when the recovery time is fixed to 700 ns and the resonance time is varied. It is understood, as shown in FIG. 45, that the reactive power loss per pulse becomes decreased as the resonance time becomes shorter.

Figure 46:
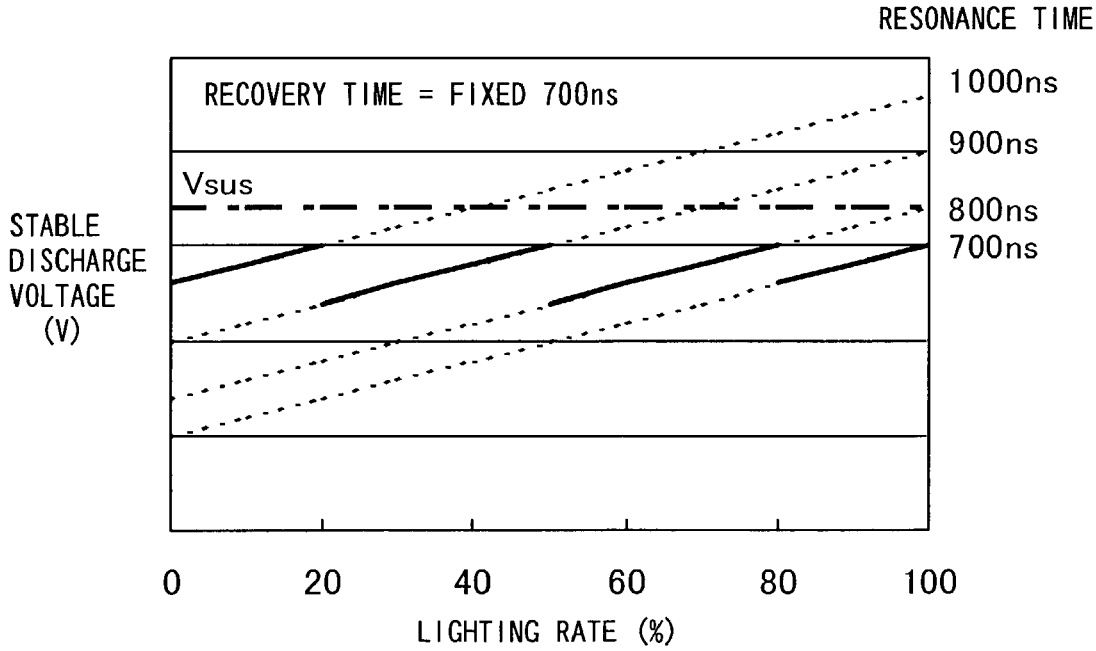
FIG. 46 is a diagram showing one example of the relationship between a lighting rate in each resonance time and a stable discharge voltage at which stable discharge can be carried out.
Figure 47:
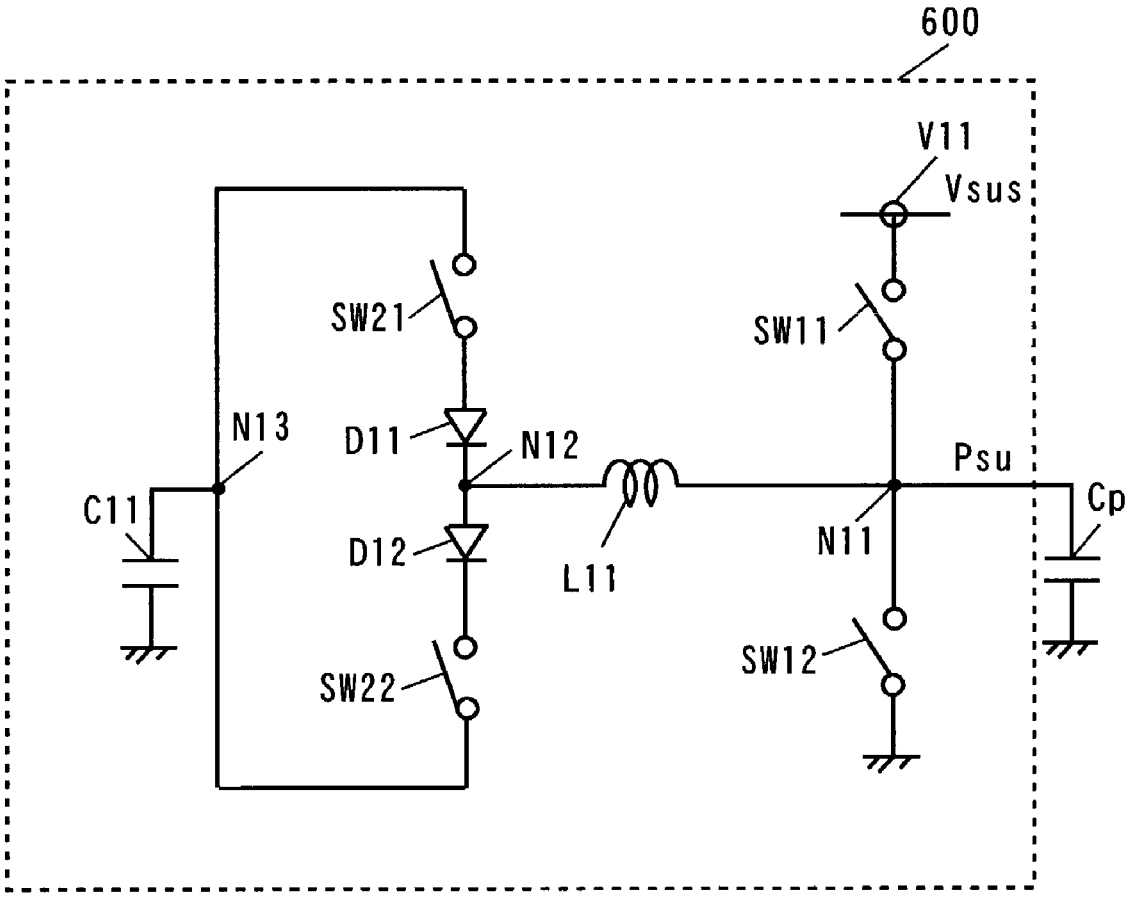
F I G. 4 7 PRIOR ART
FIG. 47 is a circuit diagram showing the structure of a sustain driver in a conventional plasma display device.
Figure 48:
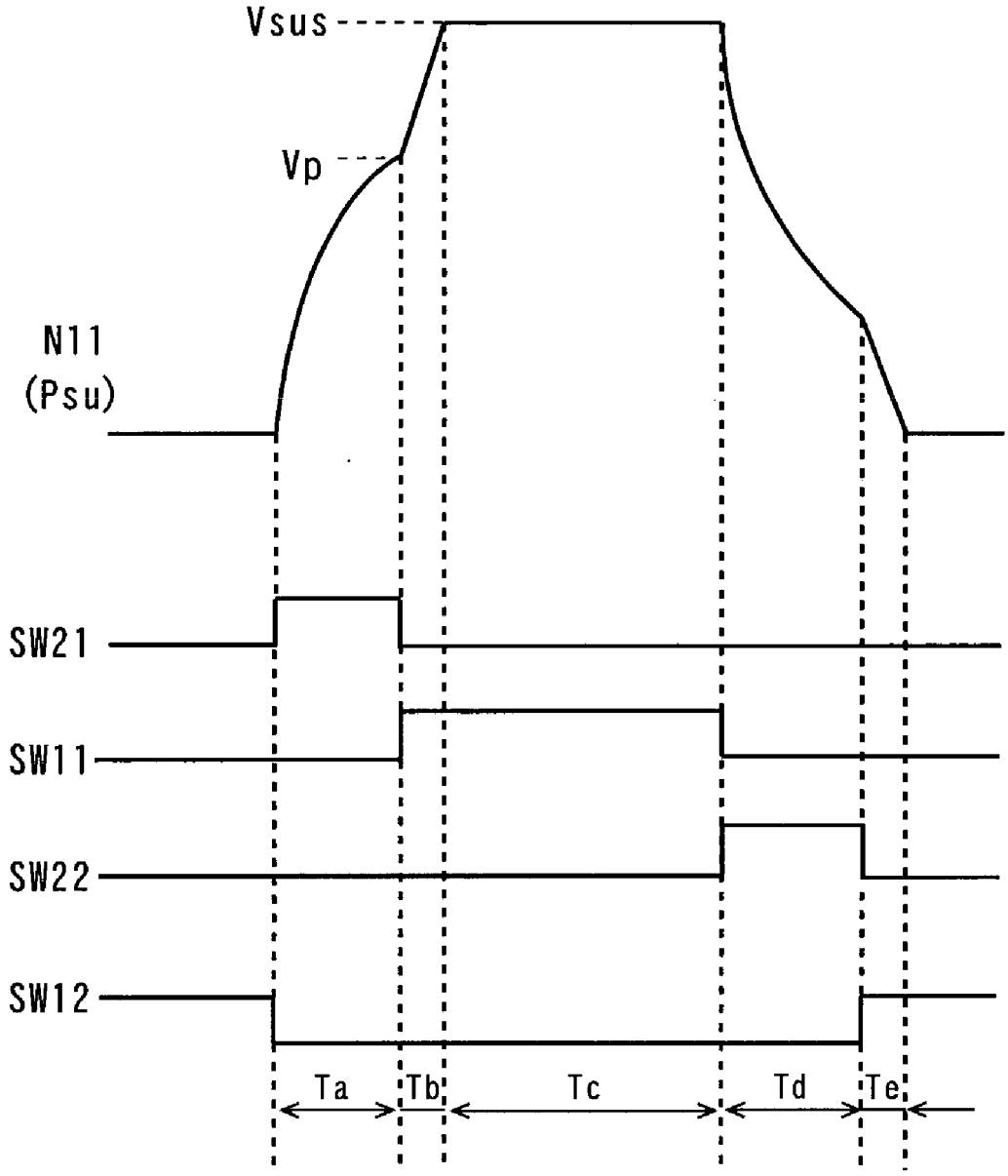
FIG. 48 PRIOR ART
FIG. 48 is a timing chart showing the operation of the sustain driver of FIG. 47 in a sustain time period.

FIG. 46 is a diagram showing an example of the relationship between the lighting rate in each resonance time and the stable discharge voltage at which stable discharge can be carried out. It is understood, as shown in FIG. 46, that the stable discharge voltage becomes higher as the resonance time becomes longer even at the same lighting rate. It is found that when the resonance time is 1000 ns, for example, the stable discharge can be carried out at or below a sustain voltage Vsus of sustain pulses Psu at the lighting rate from 0 to 40%, whereas the stable discharge cannot be carried out at the sustain voltage Vsus at the time the lighting rate exceeds approximately 40%.

As described above, when the resonance time is shorter, the stable discharge can be carried out at both a larger lighting rate and a smaller lighting rate. On the other hand, when the resonance time is longer, the stable light emission can be carried out at a smaller lighting rate, whereas the stable discharge cannot be carried out at a larger lighting rate.

Therefore, in this embodiment, the resonance time is set longer at a smaller lighting rate, whereas the resonance time is set shorter at a larger lighting rate. Thus, reactive power is reduced at a larger lighting rate while the stable discharge is carried out at both larger and smaller lighting rates.

Specifically, by use of the solid lines denoted in FIG. 46, the resonance time is set to 1000 ns at the lighting rate from 0 to 20%, 900 ns at the lighting rate from 20 to 50%, 800 ns at the lighting rate from 50 to 80%, and 700 ns at the lighting rate from 80 to 100%.

This enables the stable discharge at a sufficiently low voltage for the sustain voltage Vsus and for all lighting rates, and also, the reactive power is reduced with the increase of the lighting rate by setting the resonance time shorter as the lighting rate becomes larger.

In addition, the subfield processor 3 generates control signals S1 to S6 so that the sustain period be 8 μs at the lighting rate from 0 to 20%, 7 μs at the lighting rate from 20 to 50%, and 6 μs at the lighting rate from 80 to 100%. Accordingly, the period of drive pulses is made longer at a smaller lighting rate, so as to ensure the sufficient resonance time.

As described above, in this embodiment, the lighting rate for each subfield is detected, and thus, as the detected lighting rate for each subfield becomes smaller, the resonance time and the sustain period of the sustain pulses are made longer.

Accordingly, it is made possible to set the stable discharge voltage constant by setting the resonance time longer at a smaller lighting rate while setting it shorter at a larger lighting rate. In the case of a larger lighting rate, in particular, setting the shorter resonance time enables the stable discharge and improved reactive efficiency and decreased reactive power. In addition, since the recovery time is fixed, a period of clamping to a power supply voltage can be made constant, allowing an increased discharge stability. Consequently, even though the lighting rate varies, the stable discharge can be carried out, resulting in the decreased reactive power and decreased power consumption.

The same structures as those of the inductance control circuit 9 and the sustain driver 6*a* shown in FIGS. 11 to 13 may be used as structures for varying the resonance time depending on the lighting rate.

While both the resonance time and the sustain period are varied depending on the lighting rate in this embodiment, it may be applicable that only the resonance time be varied.

Moreover, while the description has been made on the pulses of positive polarity that discharge is carried out at the rising of sustain pulses in each of the above-described embodiments, the present invention is likewise applicable to the case with pulses of negative polarity that discharge is carried out at the falling of sustain pulses. In such a case, the recovery time and the like are set so that stable discharge can always be made depending on the lighting rate at the time of falling of sustain pulses when discharge is carried out and that the reactive power can be decreased.

According to the present invention, since the recovery time, in which drive pulses are driven, and the resonance time of LC resonance are varied depending on the lighting rate, the drive pulses can be driven in an optimum recovery time and an optimum LC resonance time corresponding to the lighting rate. Therefore, in the case of a larger lighting rate, setting a shorter recovery time enables the stable discharge, and setting a shorter resonance time enables the decreased reactive power. On the other hand, in the case of a smaller lighting rate, setting a longer recovery time enables the decreased reactive power. This makes it possible to carry out the stable discharge and decrease the reactive power and power consumption even though the lighting rate is varied.

Further, since the LC resonance time is varied depending on the lighting rate, the drive pulses can be driven in the optimum recovery time and the optimum LC resonance time corresponding to the lighting rate. Accordingly, it is made possible to make the stable discharge voltage constant by setting the inductance value of the inductance element larger to set the resonance time longer in the case of a smaller lighting rate, while setting the inductance value of the inductance element smaller to set the resonance time shorter in the case of a larger lighting rate. In the case of a larger lighting rate, in particular, setting a shorter resonance time enables the stable discharge, and increasing the recovery efficiency enables the decreased reactive power. Also, setting a fixed recovery time allows the increased discharge stability. This makes it possible to carry out the stable discharge and thus decrease the reactive power and the power consumption even though the lighting rate is varied.

The invention claimed is:

1. A display device that displays an image by causing a plurality of discharge cells to selectively discharge, comprising:

a recovery unit that recovers charges stored in said discharge cells to drive a drive pulse by using the recovered charges; and a detector that detects a lighting rate of any of said plurality of discharge cells that are to be turned on at the same time, wherein said plurality of discharge cells include a capacitive load, and said recovery unit includes an inductor having at least one inductance element that has one end connected to said capacitive load, and a resonance driver that drives said drive pulse by LC resonance of said capacitive load and said inductance element, said display device further comprising a controller that controls said recovery unit so as to vary the entire period of the drive pulse, a recovery time in which said drive pulse is driven by said recovery unit, and a resonance time of said LC resonance, based on the lighting rate detected by said detector.

2. The display device according to claim 1, further comprising a converter that converts image data in one field into image data in each of a plurality of subfields divided from one field in order to carry out a gray scale display by causing discharge of any of the discharge cells selected for each subfield, wherein said detector includes a subfield lighting rate detector that detects the lighting rate for each subfield, and said controller controls said recovery unit so as to vary said recovery time and said resonance time of said LC resonance based on the lighting rate for each subfield detected by said subfield lighting rate detector.

3. The display device according to claim 1, wherein said controller controls said recovery unit so that said recovery time becomes longer as the lighting rate detected by said detector becomes smaller.

4. The display device according to claim 1, wherein said controller controls said recovery unit so that said resonance time of said LC resonance becomes longer as the lighting rate detected by said detector becomes smaller.

5. The display device according to claim 1, wherein said controller controls said recovery unit so that a discharge recovery time of said recovery time, in which said discharge cells discharge, becomes longer than a non-discharge recovery time of said recovery time, in which said discharge cells do not discharge, depending on the lighting rate detected by said detection means.

6. The display device according to claim 1, wherein said inductor includes a variable inductor capable of varying an inductance value, and said controller varies the inductance value of said variable inductor based on the lighting rate detected by said detector.

7. The display device according to claim 6, wherein said variable inductor includes a plurality of inductance elements connected in parallel, and a selector controlled by said controller that selects an inductance element from said plurality of inductance elements.

8. The display device according to claim 6, wherein said variable inductor includes a plurality of inductance elements connected in series, and a selector controlled by said controller that selects inductance element from said plurality of inductance elements.

9. The display device according to claim 6, wherein said recovery unit further includes a capacitive element for recovering charges from said capacitive load;

said variable inductor includes a first inductance element;

said resonance driver includes a first switch connected in series to said first inductance element between said capacitive load and a capacitive element;

said variable inductor further includes a second inductance element and a second switch connected in series to opposite ends of said first inductance element; and said controller controls on/off states of said first and second switches.

10. The display device according to claim 9, wherein said controller controls the on/off states of said first and second switches so that said second switch turns on after said first switch turns on.

11. The display device according to claim 9, further comprising a converter that converts image data in one field into image data in each of a plurality of subfields divided from one field in order to carry out a gray scale display by causing discharge of any of the discharge cells selected for each subfield, wherein said detector includes a subfield lighting rate detector that detects the lighting rate for each subfield, and said controller controls a time period in which said second switch turns on based on the lighting rate for each subfield detected by said subfield lighting rate detector.

12. The display device according to claim 9, wherein said first and second switches comprise one of a field-effect transistor and a diode connected in series, a set of two field-effect transistors connected in series, and an insulated gate bipolar transistor.

13. The display device according to claim 6, wherein said recovery unit further includes a capacitive element that recovers charges from said capacitive load;

said variable inductor includes a first inductance element;

said resonance driver includes a first switch connected in series to said first inductance element between said capacitive load and said capacitive element;

said variable inductor further includes a second inductance element and a second switch connected in series between said capacitive load and said capacitive element; and said controller controls on/off states of said first and second switches.

14. The display device according to claim 13, wherein said resonance driver further includes a third switch connected in parallel to said first switch;

said variable inductor further includes a fourth switch connected in parallel to said second switch; and said controller controls on/off states of said first to fourth switches.

15. The display device according to claim 6, wherein said controller controls said recovery unit so that said resonance time of said LC resonance becomes longer as the lighting rate detected by said detector becomes smaller.

16. The display device according to claim 1, wherein said controller varies a period of said drive pulse based on the lighting rate detected by said detector.

17. A display device that displays an image by causing a plurality of discharge cells to selectively discharge, comprising:

a recovery unit that recovers charges stored in said discharge cells to drive a drive pulse by using the recovered charges; and a detector that detects a lighting rate of any of said plurality of discharge cells that are to be turned on at the same time, wherein said plurality of discharge cells include a capacitive load, and said recovery unit includes an inductor having at least one inductance element that has one end connected to said capacitive load, and a resonance driver that drives said drive pulse by LC resonance of said capacitive load and said inductance element, said display device further comprising a controller that controls said recovery unit so as to vary a recovery time in which said drive pulse is driven by said recovery unit, and a resonance time of said LC resonance, depending on the lighting rate detected by said detector, and controls said recovery unit so as to vary a discharge recovery time of said recovery time, in which said discharge cells discharge depending on the lighting rate detected by said detector, and so as not to vary a non-discharge recovery time of said recovery time, in which said discharge cells do not discharge.

18. A display device that displays an image by causing a plurality of discharge cells to selectively discharge, comprising:

a recovery unit that recovers charges stored in said discharge cells to drive a drive pulse by using the recovered charges; and a detector that detects a lighting rate of any of said plurality of discharge cells that are to be turned on at the same time, wherein said plurality of discharge cells include a capacitive load, and said recovery unit includes an inductor having at least one inductance element that has one end connected to said capacitive load, and a resonance driver that drives said drive pulse by LC resonance of said capacitive load and said inductance element, said display device further comprising a controller that controls said recovery unit so as to vary the entire period of the drive pulse and a resonance time of said LC resonance depending on the lighting rate detected by said detector.

19. A display device that displays an image by causing a plurality of discharge cells to selectively discharge, comprising:

a recovery unit that recovers charges stored in said discharge cells to drive a drive pulse by using the recovered charges; and a detector that detects a lighting rate of any of said plurality of discharge cells that are to be turned on at the same time, wherein said plurality of discharge cells include a capacitive load, and said recovery unit includes an inductor having at least one inductance element that has one end connected to said capacitive load, said inductor including a variable inductor capable of varying an inductance value, said variable inductor including a first inductance element, and a resonance driver that drives said drive pulse by LC resonance of said capacitive load and said inductance element, said display device further comprising a controller that controls said recovery unit so as to vary a recovery time in which said drive pulse is driven by said recovery unit, and a resonance time of said LC resonance, based on the lighting rate detected by said detector, wherein said recovery unit further includes a capacitive element that recovers charges from said capacitive load;

said resonance driver includes a first switch connected in series to said first inductance element between said capacitive load and said capacitive element;

said variable inductor further includes a second inductance element and a second switch connected in series between said capacitive load and said capacitive element;

said resonance driver further includes a third inductance element and a third switch, and said controller causes at least one of said first and second switches to turn on in a discharge recovery time of said recovery time, in which said discharge cells discharge, while said controller causes said third switch to turn on in a non-discharge recovery time of said recovery time, in which said discharge cells do not discharge.

20. A method of driving a display device that displays an image by causing a plurality of discharge cells to selectively discharge, wherein said plurality of discharge cells include a capacitive load, and said display device includes an inductor having at least one inductance element that has one end connected to said capacitive load, said method comprising:

recovering charges stored in said discharge cells to drive a drive pulse by LC resonance of said capacitive load and said inductance element by using the recovered charges;

detecting a lighting rate of any of said plurality of discharge cells that are to be turned on at the same time; and varying the entire period of the drive pulse, a recovery time in which said drive pulse is driven using the recovered charges, and a resonance time of said LC resonance, based on the detected lighting rate.

21. A method of driving a display device that displays an image by causing a plurality of discharge cells to selectively discharge, wherein said plurality of discharge cells include a capacitive load, and said display device includes an inductor having at least one inductance element that has one end connected to said capacitive load, said method comprising:

recovering charges stored in said discharge cells to drive a drive pulse by LC resonance of said capacitive load and said inductance element by using the recovered charges;

detecting a lighting rate of any of said plurality of discharge cells that are to be turned on at the same time; and varying the entire period of the drive pulse and a resonance time of said LC resonance based on the detected lighting rate.

22. A display device that displays an image by causing a plurality of discharge cells to selectively discharge, comprising:

a recovery circuit that recovers charges stored in said discharge cells to drive a drive pulse by using the recovered charges; and a detection circuit that detects a lighting rate of any of said plurality of discharge cells that are to be turned on at the same time, wherein said plurality of discharge cells include a capacitive load, and said recovery circuit includes an inductance circuit having at least one inductance element that has one end connected to said capacitive load, and a resonance driving circuit that drives said drive pulse by LC resonance of said capacitive load and said inductance element, said display device further comprising a control circuit that controls said recovery circuit so as to vary the entire period of the drive pulse, a recovery time in which said drive pulse is driven by said recovery circuit, and a resonance time of said LC resonance based on the lighting rate detected by said detection circuit.

23. A display device that displays an image by causing a plurality of discharge cells to selectively discharge, comprising:

a recovery circuit that recovers charges stored in said discharge cells to drive a drive pulse by using the recovered charges; and a detection circuit that detects a lighting rate of any of said plurality of discharge cells that are to be turned on at the same time, wherein said plurality of discharge cells include a capacitive load, and said recovery circuit includes an inductance circuit having at least one inductance element that has one end connected to said capacitive load, and a resonance driving circuit that drives said drive pulse by LC resonance of said capacitive load and said inductance element, said display device further comprising a control circuit that controls said recovery circuit so as to vary the entire period of the drive pulse and a resonance time of said LC resonance based on the lighting rate detected by said detection circuit.

* * * * *

UNITED STATES PATENT AND TRADEMARK OFFICE

CERTIFICATE OF CORRECTION

PATENT NO. : 7,050,022 B2
APPLICATION NO. : 10/363269
DATED : May 23, 2006
INVENTOR(S) : S. Kigo et al.

It is certified that error appears in the above-identified patent and that said Letters Patent is hereby corrected as shown below:

On the cover of the printed patent, at Item (75), Inventors, "Jumpéi" should be --Jumpei--.

Signed and Sealed this

Twelfth Day of September, 2006

JON W. DUDAS
*Director of the United States Patent and Trademark Office*